US012291951B2

(12) United States Patent
Benson et al.

(10) Patent No.: US 12,291,951 B2
(45) **Date of Patent: *May 6, 2025**

(54) SYSTEM AND METHOD FOR ENHANCED GEOTHERMAL ENERGY EXTRACTION

(71) Applicant: Hunt Energy, L.L.C., Dallas, TX (US)

(72) Inventors: Todd W. Benson, Dallas, TX (US); John S. Burkhart, Dallas, TX (US); Christopher A. Lane, Rockwall, TX (US); James D. Franks, Louisville, KY (US); Gunther H. H. von Gynz-Rekowski, Montgomery, TX (US)

(73) Assignee: Hunt Energy, L.L.C., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/488,856

(22) Filed: Oct. 17, 2023

(65) Prior Publication Data

US 2024/0044232 A1 Feb. 8, 2024

Related U.S. Application Data

(63) Continuation of application No. 18/127,302, filed on Mar. 28, 2023, now Pat. No. 11,828,147.
(Continued)

(51) Int. Cl.
*E21B 43/243* (2006.01)
*E21B 17/18* (2006.01)
(Continued)

(52) U.S. Cl.
CPC ..... *E21B 43/243* (2013.01); *E21B 17/18* (2013.01); *E21B 41/0085* (2013.01);
(Continued)

(58) Field of Classification Search
CPC ..... E21B 43/243; E21B 47/06; E21B 47/10; E21B 17/18; E21B 33/138; E21B 41/0085; E21B 43/247; E21B 43/305
See application file for complete search history.

(56) References Cited

U.S. PATENT DOCUMENTS 3,140,744 A 7/1964 Bailly
4,019,577 A 4/1977 Fitch et al.
(Continued)

FOREIGN PATENT DOCUMENTS

WO 2008033268 A1 3/2008
WO 2015095926 A1 7/2015
(Continued)

OTHER PUBLICATIONS

Bruce F. Grant et al.; Development of an Underground Heat Wave for Oil Recovery; Petroleum Transactions, AIME; SPE 348-G; May 1954.
(Continued)

*Primary Examiner* — Brad Harcourt
(74) *Attorney, Agent, or Firm* — Law Office of Bill Naifeh; Timothy F. Bliss

(57) ABSTRACT

Provided are a system and method for actively recovering thermal energy, hydrocarbons, and other energy resources from a formation. In one example, multiple fluid conduits are inserted into a borehole. Combustion fluid is injected into the formation via one of the conduits. The combustion fluid is used to ignite and maintain a combustion zone by burning fuel in the formation. To extract thermal energy, cool fluid is circulated through the borehole via another conduit and heated by the thermal energy in the combustion zone. Thermal energy may be recovered from the heated fluid or other processing may be performed for various types of energy recovery. A fluid flow and composition of the combustion fluid and a fluid flow rate of the cool fluid may
(Continued)

be individually controlled for purposes such as regulating heat transfer, balancing thermal energy recovery with enhanced oil recovery (EOR), and regulating temperature and pressure for safety.

28 Claims, 71 Drawing Sheets

Related U.S. Application Data

(60) Provisional application No. 63/476,399, filed on Dec. 21, 2022, provisional application No. 63/357,966, filed on Jul. 1, 2022, provisional application No. 63/354,452, filed on Jun. 22, 2022, provisional application No. 63/337,954, filed on May 3, 2022, provisional application No. 63/325,504, filed on Mar. 30, 2022.

(51) Int. Cl.
*E21B 41/00* (2006.01)
*E21B 43/247* (2006.01)
*E21B 47/06* (2012.01)
*E21B 47/10* (2012.01)

(52) U.S. Cl.
CPC ..... *E21B 43/247* (2013.01); *E21B 47/06* (2013.01); *E21B 47/10* (2013.01)

(56) References Cited

U.S. PATENT DOCUMENTS

| | | | | |
|---|---|---|---|---|
| 4,063,416 | A | 12/1977 | Cooper | |
| 5,054,551 | A | 10/1991 | Duerksen | |
| 5,145,003 | A | 9/1992 | Duerksen | |
| 5,287,926 | A | 2/1994 | Grupping | |
| 8,915,084 | B2 | 12/2014 | Rogers et al. | |
| RE47,024 | E | 9/2018 | Parsche | |
| 11,441,394 | B1 | 9/2022 | Joshi et al. | |
| 11,530,603 | B2 | 12/2022 | Gates et al. | |
| 11,828,147 | B2 * | 11/2023 | Benson | E21B 47/06 |
| 2009/0025902 | A1 | 1/2009 | Favier et al. | |
| 2009/0126923 | A1 | 5/2009 | Montgomery et al. | |
| 2013/0234444 | A1 | 9/2013 | Rogers et al. | |
| 2017/0248345 | A1 | 8/2017 | Parrella et al. | |
| 2021/0047905 | A1 | 2/2021 | Strem et al. | |
| 2021/0278106 | A1 | 9/2021 | O'Malley et al. | |
| 2023/0313652 | A1 | 10/2023 | Benson et al. | |

FOREIGN PATENT DOCUMENTS

| | | | |
|---|---|---|---|
| WO | 2018227303 | A1 | 12/2018 |
| WO | 2019224326 | A1 | 11/2019 |

OTHER PUBLICATIONS

Elena Soldo et al.; Geothermal Repurposing of Depleted Oil and Gas Wells in Italy; Proceedings 2020, 58, 9.
Halliburton; ExpressFiber Disposable Fiber Cable, Low-Cost Fiber for Routine Cross-Well Monitoring (2021).
International Search Report and Written Opinion, mailed Jul. 20, 2023, by the ISA/US, re PCT/US2023/016773.
Leigh Collins; Low-cost, clean hydrogen from underground oil fires could kill off green H2 sector; Recharge, Feb. 7, 2020.
Lingyu Zhang et al.; Energy from Abandoned Oil and Gas Reservoirs; Society of Petroleum Engineers; SPE 115055 (2008).
Nesrine Jaziri et al.; A comprehensive review of Thermoelectric Generators: Technologies and common applications; Energy Reports 6 (2020) 264-287.
Notice of Allowance, dated Jul. 18, 2023, by the USPTO, re U.S. Appl. No. 18/127,302.
Office Action, dated Jun. 15, 2023, by the USPTO, re U.S. Appl. No. 18/127,302.
Varfolomeev, et al.; Case Study on the Application of In-Situ Combustion for Ultra-Law Permeability Oil Shale from Natih B Formation (Oman): Synthetic Oil Generation and Micro-Scale Pore Structure Changes; SPE-211011-MS (2022).
Yuhao Zhu et al.; Geothermal Power Production from Abandoned Oil Reservoirs Using in Situ Combustion Technology; Energies 2019, 12, 4476.
Benjamin M. Storey, et al.; The Geoscience of In-Situ Combustion and High-Pressure Air Injection; Geosciences 2022, 12, 340; 36 pages.
Lingyu Zhang et al.; Energy from Abandoned Oil and Gas Reservoirs; SPE International; SPE 115055; Oct. 2008; 10 pages.
Yuhao Zhu et al.; Geothermal Power Production from Abandoned Oil Reservoirs Using In Situ Combustion Technology; Energies 2019, 12, 4476; doi: 10.3390/en12234476; 21 pages.

* cited by examiner

SYSTEM AND METHOD FOR ENHANCED GEOTHERMAL ENERGY EXTRACTION

CLAIM OF PRIORITY

This application is a Continuation of U.S. patent application Ser. No. 18/127,302, filed on Mar. 28, 2023, and entitled "SYSTEM AND METHOD FOR ENHANCED GEOTHERMAL ENERGY EXTRACTION," which claims the benefit of U.S. Provisional Patent Application 63/325,504, filed on Mar. 30, 2022, and entitled "SYSTEM AND METHOD FOR OBTAINING ENERGY USING ACTIVE GEOTHERMAL EXTRACTION"; U.S. Provisional Patent Application 63/337,954, filed on May 3, 2022, and entitled "SYSTEM AND METHOD FOR ACTIVE GEOTHERMAL ENERGY EXTRACTION"; U.S. Provisional Patent Application 63/354,452, filed on Jun. 22, 2022, and entitled "SYSTEM AND METHOD FOR ENHANCED ACTIVE GEOTHERMAL ENERGY EXTRACTION"; U.S. Provisional Patent Application 63/357,966, filed on Jul. 1, 2022, and entitled "SYSTEM AND METHOD FOR ENHANCED GEOTHERMAL ENERGY EXTRACTION"; and U.S. Provisional Patent Application 63/476,399, filed on Dec. 21, 2022, and entitled "SYSTEM AND METHOD FOR ENHANCED GEOTHERMAL ENERGY EXTRACTION", all of which are hereby incorporated by reference in their entirety.

TECHNICAL FIELD

This application is directed to the extraction of thermal energy, enhanced oil recovery, and the recovery of fluids and energy from subsurface regions.

BACKGROUND

The manner in which geothermal energy is obtained from below the earth's surface is currently limited in functionality and flexibility. Accordingly, what is needed are a system and method that addresses these issues.

BRIEF DESCRIPTION OF THE DRAWINGS

For a more complete understanding, reference is now made to the following description taken in conjunction with the accompanying Drawings in which.

DETAILED DESCRIPTION

Figure 1:
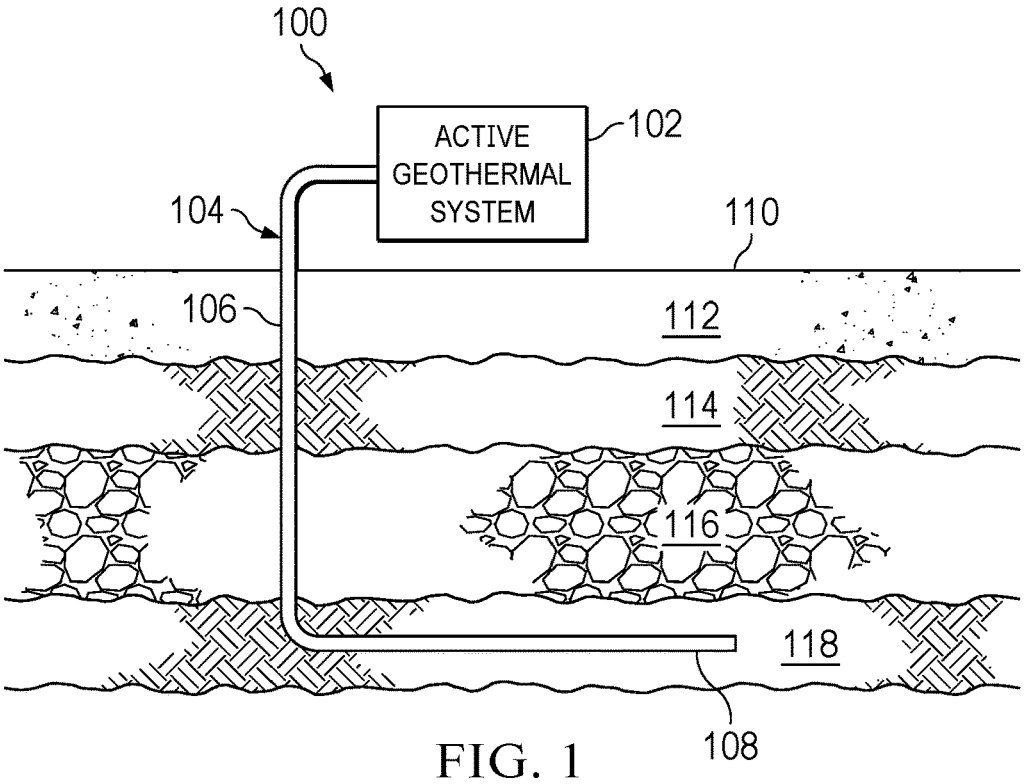
FIG. 1 illustrates one embodiment of an environment within which aspects of the present disclosure may be practiced.

Referring now to the drawings, wherein like reference numbers are used herein to designate like elements throughout, the various views and embodiments of a system and method are illustrated and described, and other possible embodiments are described. The figures are not necessarily drawn to scale, and in some instances, the drawings have been exaggerated and/or simplified in places for illustrative purposes only. One of ordinary skill in the art will appreciate the many possible applications and variations based on the following examples of possible embodiments.

Geothermal energy, provided by heat generated within the earth, is of interest as a renewable energy source. Attempts to harvest geothermal energy generally involve circulating a fluid through a subsurface geothermal reservoir having sufficient natural ambient heat to raise the fluid's temperature. This often entails pumping a liquid (e.g., water) or a gas (e.g., carbon dioxide) through a subsurface stratum in order to heat the fluid using the natural ambient heat. When the fluid is returned to the surface, the temperature difference enables some amount of energy to be harvested. However, because this process is reliant on the existing heat level of the subsurface geothermal reservoir, the amount of energy that can be harvested by such a process is limited by both the availability of such reservoirs and their natural temperature levels.

The present disclosure describes a process by which subsurface formations that have been largely depleted of combustible material, such as extractible oil, gas, and coal resources, by drilling or mining may be used to provide geothermal energy regardless of the natural ambient temperature of such formations. More specifically, because current methods are incapable of extracting all oil or gas from a formation, some varying amount of combustible material (which may be referred to herein as "fuel") may still be present within the drilled and/or fractured strata. It is understood that the amount of energy present in the remaining combustible material may vary based on many factors, such as the composition and amount of fuel present, the presence of water and/or other fire suppressants, and/or the specifics of the formation (e.g., mineral composition (shale, sand, etc.), density, and depth). Accordingly, different subsurface regions may be capable of providing different levels of thermal energy using the disclosed process, and so the viability of, and approach to, a particular region may vary at least partially due to such factors.

The present process provides a number of potential advantages in the provision of geothermal energy. Such advantages may include, for example, the use of existing depleted wells for energy (thereby negating or minimizing drilling costs and the environmental impact of additional drilling), the conversion to energy of oil, gas, and coal deposits and/or other hydrocarbons, including coal bed methane resources, that cannot be otherwise extracted due to technological, economic, or environmental reasons, the conversion to energy of other types of subterranean combustible material, and the sequestration of carbon dioxide.

By using depleted wells, the process can not only make use of a borehole that has already been drilled, but may use casing that may still be present. In holes where the casing has been pulled, the present process may either replace the casing or provide some other means for placing the needed components in place. The use of depleted wells not only provides cost savings, but also reduces the environmental impact as the drilling has already occurred and no new well needs to be drilled at that location.

Because current technologies may leave up to ninety percent of the oil or gas in the formation due to their lack of ability to extract more, the reuse of wells for geothermal energy allows at least some of the remaining hydrocarbons to be converted to energy. This provides a more efficient use of the borehole and the underlying deposits.

Because the combustion occurs deep below the surface and the well is plugged, carbon dioxide emitted during the conversion to heat may be effectively sequestered. This allows the remaining fuel to be used for energy while minimizing or eliminating the release of carbon dioxide from the fuel into the atmosphere.

The process may also provide enhanced oil recovery (EOR) activity to prolong the life of existing wells. As EOR increases the efficiency of extracting oil in existing wells, the environmental and economic costs of drilling the well or wells may be further offset by the additional hydrocarbons obtained due to the EOR afforded by the present disclosure.

Referring to FIG. 1, one embodiment of an environment 100 within which aspects of the present disclosure may be practiced is illustrated. In the environment 100, an active geothermal system 102 is positioned above or proximate to a borehole 104. Although the borehole 104 may be referred to in the present disclosure in the context of oil or gas drilling, the borehole 104 represents any manmade or natural hole or fracture in the earth that provides access to hydrocarbons or other combustible material below the earth's surface. Accordingly, the borehole 104 represents new wells and existing wells (including active wells, previously active/depleted wells, and previously abandoned wells (including abandonment for being uneconomic)), any type of well, including vertical wells, horizontal wells, and slant wells, and any well arrangement, including standalone wells and/or groups of wells, and any combination thereof. The entrance to the borehole may be on the earth's surface, in a subterranean location, or below the water table. In addition, the borehole may be onshore or offshore, or may start onshore or offshore and extend to an offshore or onshore location, respectively.

The borehole 104 may or may not contain casing from previous drilling operations, and may or may not have been plugged after those operations stopped. For purposes of example, the present disclosure assumes the casing remains in the borehole 104 and the plug, if any, has been removed. If the casing is not present, those skilled in the art will be familiar with how casing may be positioned within the borehole 104.

In some embodiments, casing may not be added (if missing) and alternate methods may be used to position the components described herein downhole. For example, fluid conduits and other equipment may be inserted into the borehole 104, followed by a concrete mix that hardens to form a concrete structure around the components in at least a portion of the hole. In other embodiments, the components may be inserted and not supported by concrete or other methods. Whether casing is or is not present, one or more plugs (e.g., formed using concrete and/or other materials) may be used to seal the borehole 104 in order to manage pressure buildup and carbon dioxide. As will be discussed below in greater detail with respect to safety, the use of multiple plugs may provide redundancy if pressure results in a blowout situation. It is understood that in embodiments where the removal of carbon dioxide and/or other fluids may be desirable (e.g., to release pressure, to control the downhole pressure, and/or to put the fluid(s) to some use), the plug or plugs may be removed and/or release or extraction mechanisms that pass through the plugs (e.g., valves or conduits) may be used for such removal.

The borehole 104 may contain one or more substantially vertical sections 106 and one or more substantially horizontal sections 108. Although not shown, it is understood that sections of the borehole 104 may have various orientations as are commonly produced during directional drilling operations. Although shown with a vertical and horizontal section, the borehole 104 may have any type of conventional or unconventional well geometry, including geometries referred to as vertical, slant (J-type), S-type, etc.

Under the surface 110, the borehole 104 may penetrate various strata layers 112, 114, 116, and extend into strata layer 118. In strata layer 118, which includes the hydrocarbon bearing formation, the borehole 104 extends horizontally. The strata layer 118 includes hydrocarbons and/or other combustible material that remains from the previous drilling operations and that may be used by the active geothermal system 102 to produce energy. In embodiments where the borehole 104 represents a new well, an abandoned well, or a natural vent or cavity, none of the hydrocarbons and/or combustible material may have been previously extracted. In other embodiments, the hydrocarbons may be positioned in one or more strata layers that are not reasonably accessible using current extraction techniques and/or may be an undesirable mixture that is not worth extracting (e.g., too shallow or deep to have formed a proper economically viable mixture), but may still offer combustible material useful for the processes disclosed in the present disclosure.

Figure 2:
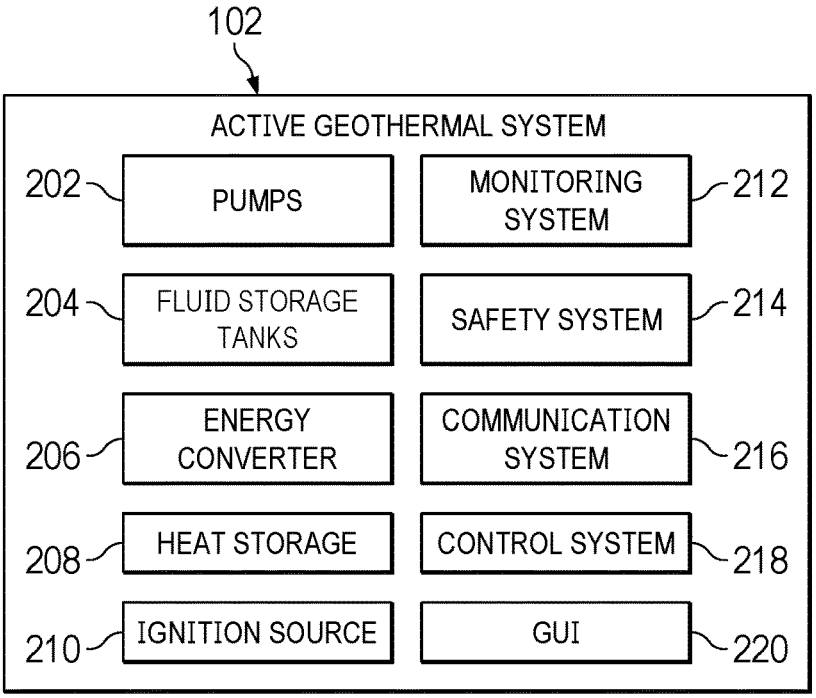
FIG. 2 illustrates one embodiment of various components that may be part of an active geothermal system.

Referring to FIG. 2, one embodiment of the active geothermal system 102 of FIG. 1 is illustrated with various components. Pumps 202 are used to force any fluid or fluid combination (e.g., liquids such as cool water and gases such as air, oxygen, nitrogen, and carbon dioxide) from fluid storage tanks 204 into the borehole 104 of FIG. 1 and/or to extract fluid from the borehole 104. The number of pumps 202 and the directional force of the pumps 202, as well as the pressures used, may depend on the particular configuration and arrangement of fluid conduits within the borehole 104, the density of the fluids, the depth of the borehole, and similar factors. The fluid storage tanks 204 may be positioned above and/or below ground. In some embodiments, some fluids (e.g., water) may be used without needing a storage tank, such as using water naturally available from the water table.

As heated fluid is retrieved from the borehole 104, an energy converter 206 (e.g., a heat exchanger, Stirling engine, thermoelectric device, Rankine cycle process, and/or heat pump) may be used to harvest energy based on the temperature difference between the injected and retrieved fluid. In other embodiments, the energy conversion may occur downhole, with electricity being generated from within the borehole 104 rather than heat being extracted. For example, electricity may be generated downhole using a thermoelectric or other device. A mechanical device or system may be used to transfer energy from downhole to the surface (e.g., a turbine coupled to a crankshaft extending through at least a portion of the borehole 104). In still other embodiments, the heat may not be immediately converted to energy, but may be stored in heat storage 208 (e.g., one or more metals, fluids, rocks or other minerals, and/or combinations thereof having appropriate thermal properties) and converted to energy at a later time.

In yet other embodiments, the heat may not be converted to energy, but may be directly provided as heat for industrial, commercial, agricultural, and/or domestic uses. For example, heat may be provided to steel mills, businesses, greenhouses, homes, etc., as well as being used to heat sidewalks, roads, and other transportation infrastructure. It is understood that the conversion, storage, and/or direct use of heat may be accomplished at a single location and may depend on such factors as current demand for a particular form of output, available storage, and/or other factors.

Ignition source 210 may be used to ignite the combustible material downhole. The presence and form of the ignition source 210 may vary based on a number of factors, such as the nature of the combustible material, the characteristics of the formation, the depth and ambient heat, the presence of fire suppressants within the formation, and similar factors. In some embodiments, the ignition source 210 may not be needed, as the provision of oxygen or some fluid mix may be sufficient to ignite and maintain combustion of the formation due to pressure and/or ambient heat. In some embodiments, the ignition source 210 may be contained in the form of a downhole tool or "sub" and be part of a permanent installation (e.g., a chemical sub).

The ignition source 210 may be mechanical, chemical, electrical, plasma (e.g., plasma arc), and/or any other device or delivery mechanism that may be used to ignite the combustible material. For example, a mechanical or electrical device may be used to provide a spark or flame. Chemicals may be used to create a volatile mixture that ignites when mixed or when subjected to the pressure and/or heat of the formation. Antennas and/or other probes may be extended into the formation to serve as sparking tools and/or for plasma arcs. A focused flame (e.g., a flame jet) with an oxygen and fuel mix may be used and, in some embodiments, may burn through the casing to reach the formation.

The ignition source 210 may be specifically designed to enable reignition after suppression has occurred and so may need to overcome the presence of suppressants. In some cases, suppressants may be pumped out of the formation or otherwise drained after the combustion has been suppressed in order to ease the process of reignition and renewed combustion. In other embodiments, simply forcing pure oxygen, an oxygen mix, or some other fluid(s) into the formation may be sufficient to cause combustion due to the pressure, ambient heat, and/or chemical compounds within the formation.

Monitoring system and equipment 212, which may include both surface and downhole components, may be used to monitor pressure, temperature, fluid flow, structural integrity (e.g., casing deformation), vibration, sound (sonic), humidity, and similar parameters. The monitoring system 212 may be configured to monitor the location of a fire front in a combustion area, or may be configured to pass monitoring information to another component of the active geothermal system 102 (e.g., the control system 208) that is able to determine the fire front's location based on the provided information. In some embodiments, the monitoring system 212 may be configured to perform corrosion detection.

The monitoring system 212 may be located at a single well or may encompass multiple wells, with monitoring occurring across the entire system to identify developing issues and to control combustion at a larger scale. Some aspects of the functionality of the monitoring system 212 are described in greater detail with respect to the multiple wells illustrated in FIGS. 60A-60D. Various sensors may be used for such monitoring, including sensors for detecting thermal, visual, seismic, acoustic, pressure, chemical, and/or vibration data, and/or may be any type of sensor, including fiber optic, tilt meters, thermal imaging, etc.

Safety system and equipment 214 may include both passive and active components. For example, using multiple concrete plugs may provide passive safety by providing redundancy if a pressure build up, including an explosion caused by flammable fluid, occurs downhole. The existence of multiple plugs may not only provide physical safety, but may also protect against the inadvertent release of carbon dioxide into the atmosphere should a blowout occur. Plug(s) may be positioned anywhere within the borehole 104, including near or at the surface (e.g., in the final casing, which may also serve to minimize plug deformation). Sensors may be positioned around and/or between plugs to serve as an early warning on potential plug failure.

Active components of the safety system 214 may, based on information from monitoring system 212 for example, be used to suppress or extinguish downhole combustion. This may be accomplished by lowering or shutting off oxygen, air, or other fluid flows that support combustion, and/or by actively flooding an area with fluids such as water or carbon dioxide. This may be done to prevent breakthrough to other well branches or other wells that are not currently to be ignited and to provide a safety valve should a combustion area become overly hot or out of control. The safety system 214 may receive data from monitoring system 212. The safety system 214 may be tied into control system 218 in order to directly take active measures, or may alert the control system 218 and/or users so that active measures can be initiated separately.

The safety system 214, in conjunction with the monitoring system 212, may be configured to identify the compromise of any tubing (e.g., the casing and/or fluid conduits) that may occur due to factors such as pressure, heat, explosions, shifting of formation faults, collapse of casing, corrosion, etc. For example, for thermally cycled fluid and/or other pressurized lines flowing into or out of the well, the safety system 214 may be configured to identify the presence of non-circulating fluids, relatively rapid temperature changes, and/or changes in circulating pressure, viscosity, chemical composition, transparency, and other fluid and/or system attributes. Various sensors may be used for such monitoring, including sensors for detecting thermal, visual, seismic, acoustic, pressure, chemical, and/or vibration data, and/or may be any type of sensor, including fiber optic, tilt meters, thermal imaging, etc.

When a discrepancy is found, the safety system 214 may activate a series of escalating alarms and actions. Such alarms and actions may be local and/or remote, and may include using visual and/or acoustic data and digital communications and/or application programming interface (API) based event triggers. Examples of automatic safety responses may include changing pump rates, injection gases, valve settings, pressure releases, and/or levels of blowout preventer (BOP) engagement. In such cases, the monitoring of hydrogen sulfide ($H_2S$) gas presence and the mitigation of such gasses in the event of a pressure release may be followed with additional alarm and automated mitigation.

Communications system and equipment 216 may be used to communicate with surface and/or downhole equipment. Such communications may include sensor data and control instructions, and may use acoustic, wire/wireless, mud/pressure pulse telemetry, electromagnetic (EM), and/or other communications channels. Accordingly, the communications system 216 may provide communications for other systems and components, including monitoring system 212, safety system 214, and control system 218.

Control system 218 may be used to interact with and control the various components, including fluid flow rates, to regulate the energy transfer, as well as perform optimizations of the combustion process as will be described later. A graphical user interface (GUI) 220 may be used to interact with the control system 218 and/or directly with various components and other systems, such as pumps 202, monitoring system 212, safety system 214, and/or communications system 216. The control system 218 may be provided by, or accessed using, mobile devices (e.g., tablets, smartphones, personal digital assistants (PDAs), or netbooks), laptops, desktops, workstations, servers, and/or any other computing device capable of receiving and sending electronic communications via a wired or wireless network connection. Such communications may be direct (e.g., via a peer-to-peer network, an ad hoc network, or using a direct connection), indirect, such as through a server or other proxy (e.g., in a client-server model), or may use a combination of direct and indirect communications.

It is understood that the various components and systems of the active geothermal system 102 of FIG. 2 are illustrated separately for purposes of example, and may be combined or further divided in many different ways. Furthermore, additional components not described herein may be added and some components (e.g., the heat storage 208 or ignition source 210) may not be present in all embodiments. In addition, some components may be located downhole, on the surface at or near the borehole, or remotely from the well depending on the particular implementation of the active geothermal system 102. For example, optimization logic may be handled offsite and provided to local components of the active geothermal system 102 as needed.

Figure 3A:
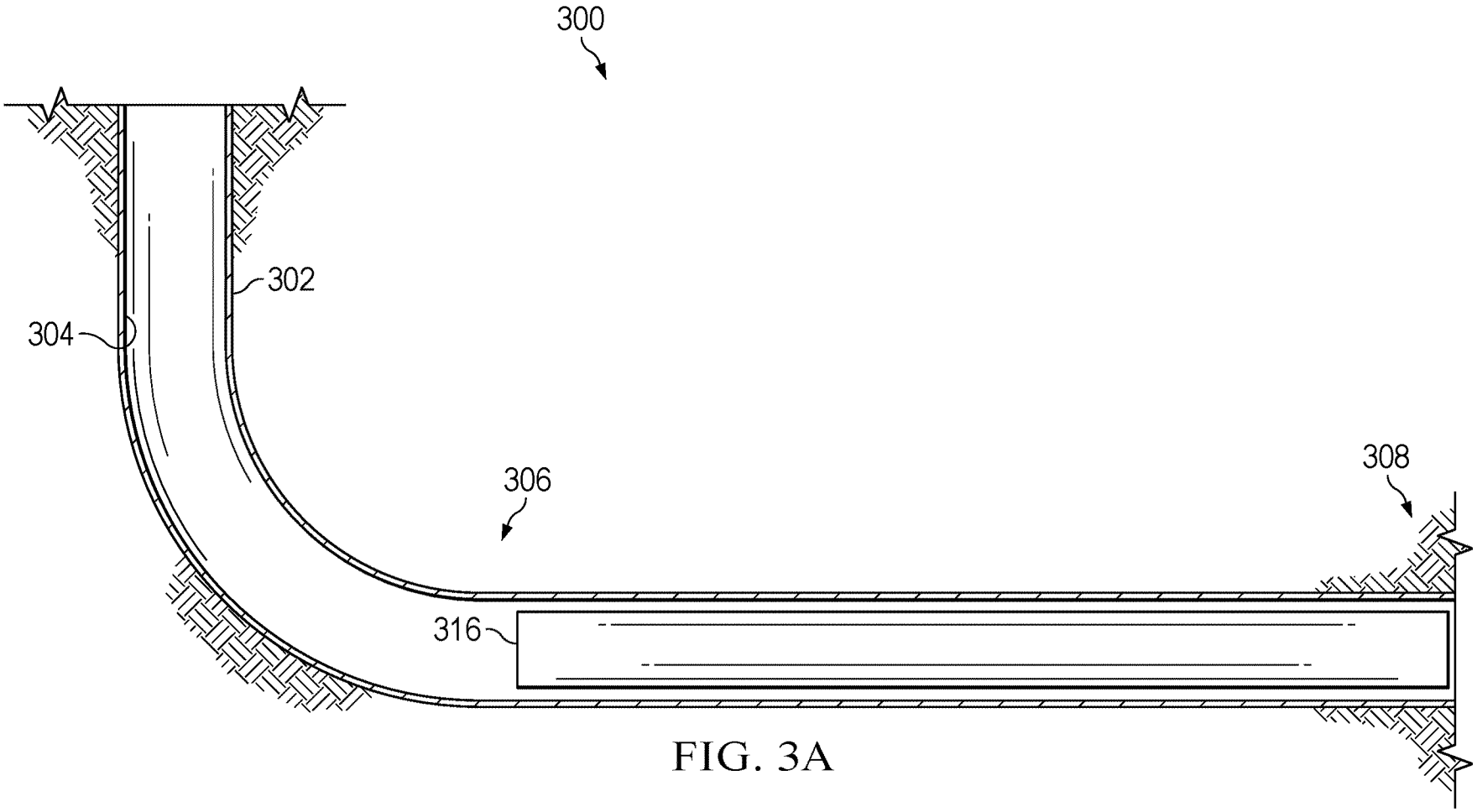
FIGS. 3A and 3B illustrate embodiments of a lateral well within a formation.

Referring to FIG. 3A, one embodiment of a section of a pipe 300 is illustrated. The pipe 300 includes an exterior casing 302 and an interior lining 304. In the present embodiment, a smaller diameter pipe such as a production pipe (e.g., tube) 316 may be installed or otherwise inserted within the casing 302, but other embodiments may not include such a pipe. The pipe 316 may extend to the surface or may be limited to a lower portion of the pipe 300. The area near the curve that transitions the section from vertical to horizontal may be referred to as the heel 306, with the opposite end referred to as the toe 308. While the toe 308 is generally the far end of the horizontal section, it is shown here relative to the heel 306.

The term "pipe" as used in the present disclosure may refer to casing pipe, production pipe, the outer tube of an umbilical section 3000 (FIG. 30) or umbilical 3100 (FIG. 31), other types of pipes and tubing that may be deployed in various embodiments described herein, and combinations thereof, and the type of pipe may vary based on how various components described herein are implemented and/or deployed. For example, in some embodiments, fluid conduits (which may be pipes) described herein may be deployed into a borehole with no casing or into casing pipe that does or does not contain production pipe. In other embodiments, deployment may occur with the fluid conduits being encased by an outer tube of the umbilical, with the outer tube being similar or identical to, or being used in a manner similar or identical to, casing or production pipe, or with the outer tube being inserted into casing or production pipe. Accordingly, it is understood that the term "pipe" as used in various embodiments is not intended to be limiting, but may refer to many different types of pipes and combinations of such pipes.

Figure 3B:
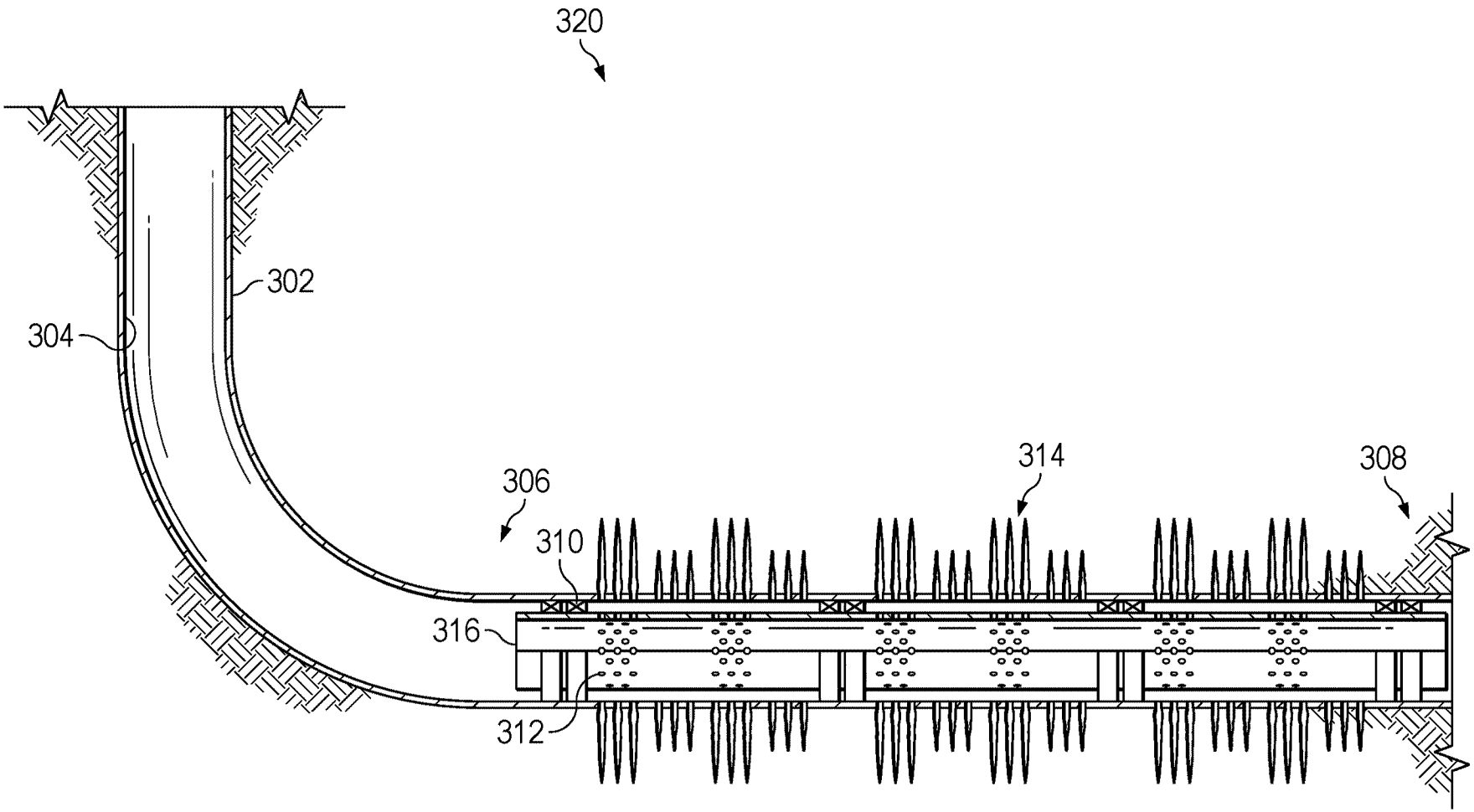

Referring to FIG. 3B, one embodiment of a section of a pipe 320 that may be used for hydraulic fracturing (fracking) operations is illustrated. The pipe 320 includes an exterior casing 302 and an interior lining 304. In the present embodiment, a smaller diameter pipe such as a production pipe 316 is installed within the casing 302, but other embodiments may not include such a pipe. It is understood that the production pipe 316 may extend to the surface. Swell packers 310 may be used to isolate sections of the pipe 320. Perforations 312 enable liquid 314 to be forced out of the pipe 316 and casing 302 into the surrounding formation, causing fractures and increasing the availability of the oil and gas present in the formation for extraction.

Figure 4A:
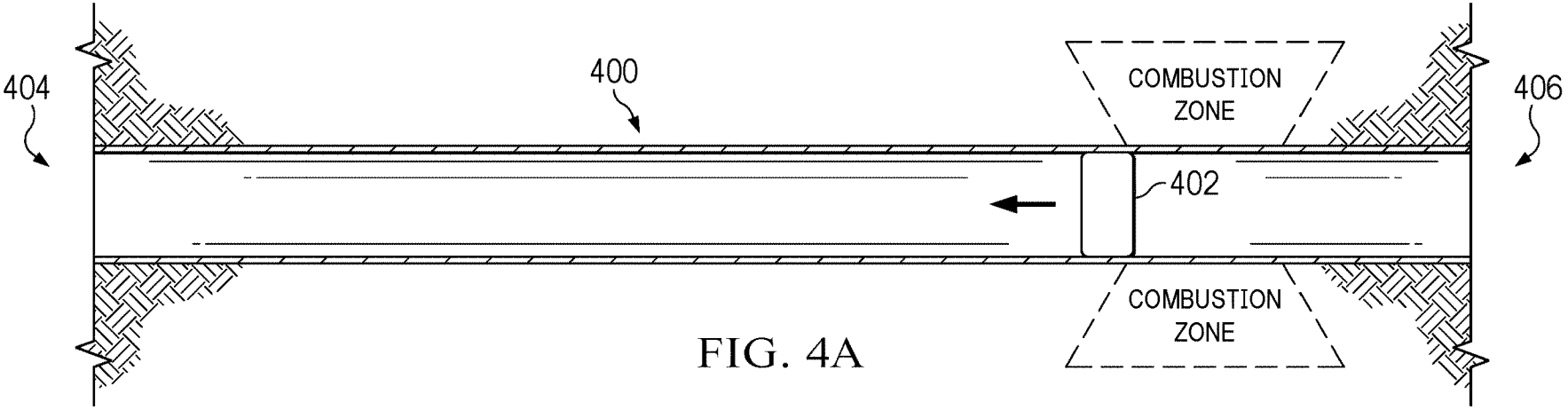
FIGS. 4A-5 illustrate embodiments of a plug being moved within a pipe to affect one or more combustion zones around the pipe.
Figure 4B:
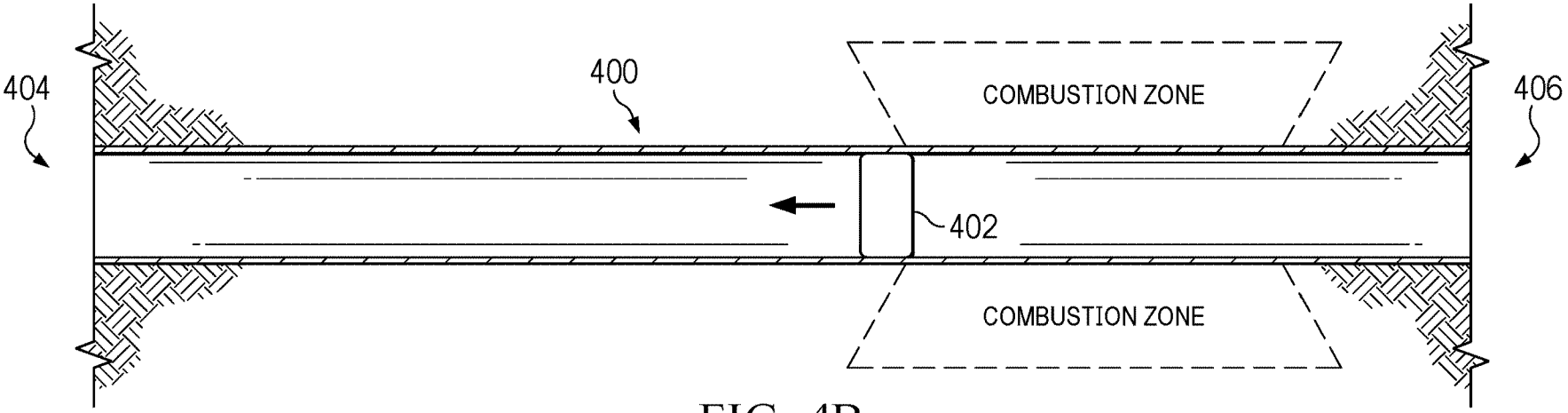
Figure 4C:
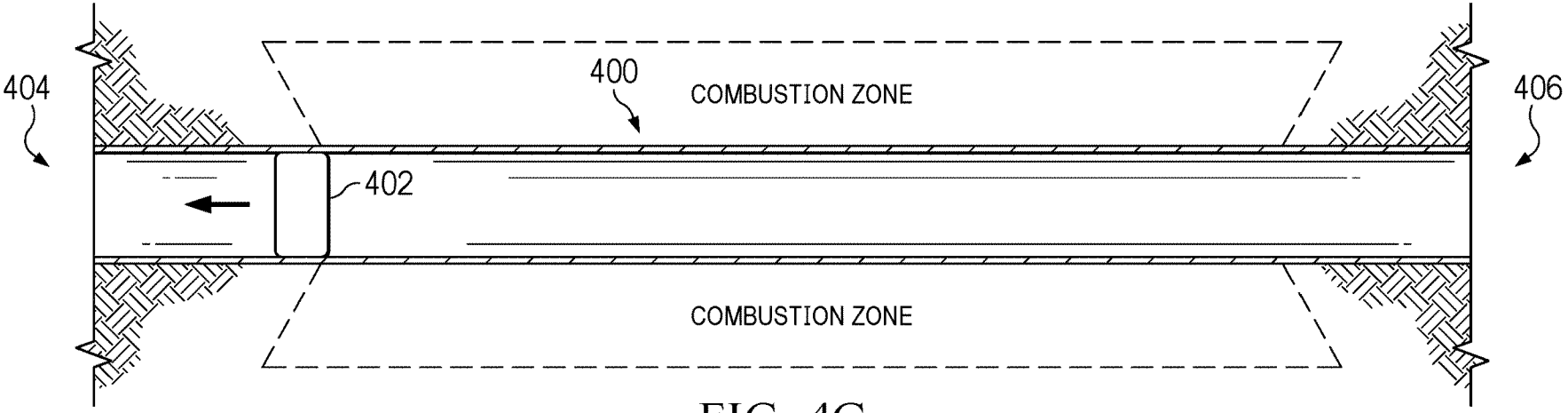
Figure 5:
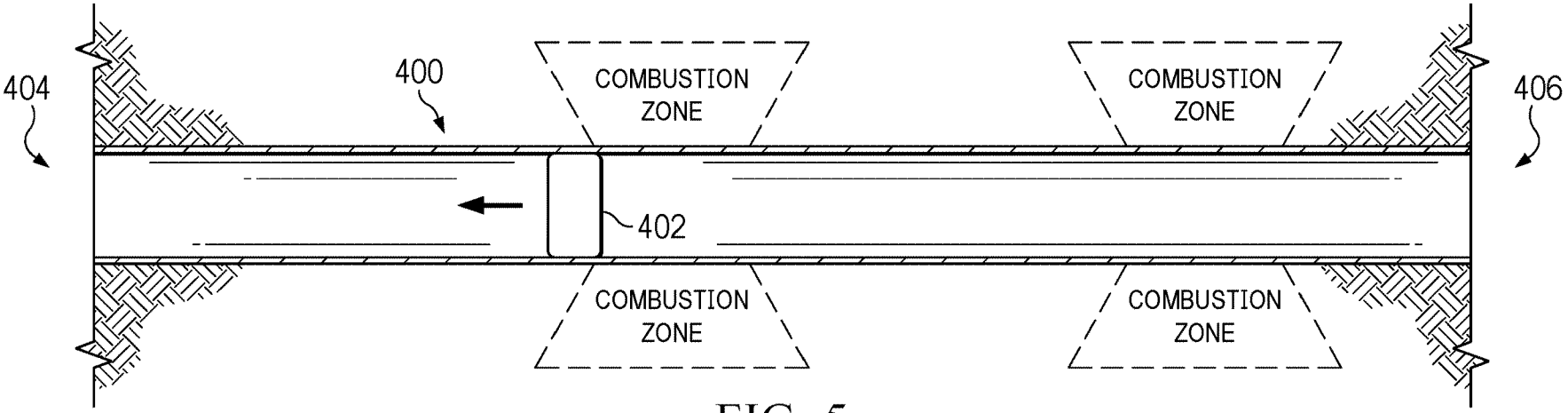

Referring to FIGS. 4A-5, one embodiment of a section of a pipe 400 according to aspects of the present disclosure is illustrated with combustion zones that may be initiated and used by the active geothermal system 102 of FIGS. 1 and 2. One or more fluids may be pumped through the pipe 400 and into the surrounding formation in order to ignite combustible material within the formation for heat harvesting and/or EOR purposes. It is understood that the combustion zones illustrated in FIGS. 4A-5 are uniform for purposes of illustration, but that such zones will likely have any number of shapes and sizes due to the density and pattern of fuel within the formation, access to oxygen, the presence of suppressants, and similar factors.

In FIG. 4A, the pipe 400 includes a plug 402 positioned towards a toe 406 rather than a heel 404. In practice, oxygen, air, and/or other fluids are passed through the plug 402 via fluid conduits (see FIGS. 6-10) and into a portion of the pipe 400 where they are used to ignite and maintain a combustion zone around the pipe.

The plug 402 may serve one or more purposes depending on the particular configuration of the pipe 400, the parameters of the borehole 104 (FIG. 1), and the operation of the active geothermal system 102. For example, the plug 402 may serve as a limiter on the combustion area as shown in FIG. 4A. While the combustion area may extend past the plug 402 towards the heel 404, the amount of fluid(s) available to support combustion towards the heel may be lessened by injecting fluid(s) only into the portion of the pipe 400 past the plug towards the toe 406.

The plug 402 may also operate to minimize or eliminate carbon dioxide from escaping up the borehole. The plug 402 may further serve to limit or minimize blowouts if there is a pressure wave due, for example, to the sudden ignition of a flammable fluid pocket that has built up. As shown, the combustion zone may be relatively limited to the formation surrounding the section between the plug 402 and the toe, although expansion of the combustion zone may occur through fissures in the formation, the amount of fuel in a particular area, and/or other factors.

Accordingly, although it may be optimal and/or unavoidable to simply ignite the entire area around the pipe 400 in some embodiments, in other embodiments a more controlled approach may be desirable for purposes such as EOR control and/or thermal control. In such embodiments, in order to maximize the thermal energy from a particular area, the plug 402 may be sequentially moved from the toe towards the heel. This may also enable the energy value (e.g., the British Thermal Units (BTUs)) for that hole to be estimated before expanding the area of combustion. Other information, such as the amount of time the zone may provide thermal energy (e.g., a burn rate) and/or the effect various fluids have on the zone's combustion process may also be obtained. Accordingly, as the current area (e.g., the toe) is depleted of fuel, the plug may be moved towards the heel and the next area may be ignited. This allows for a sequential controlled ignition along the length of pipe, although some overlap will likely occur.

It is noted that, in some embodiments, water in the formation may be a benefit rather than a hinderance. The water may vaporize, and the resulting steam may be used for downhole power, extracted, or may serve as a thermal migration (pressure) source for EOR.

In FIG. 4B, the plug 402 has been moved in the direction of the heel 404, which expands the combustion zone by providing oxygen, air, or some fluid mixture to a larger portion of the surrounding formation. By moving the plug 402 sequentially from toe to heel, the plug may be used to control the combustion zone. In FIG. 4C, the plug 402 has been moved to the heel 404, which expands the combustion zone to the entire length of the pipe 400.

In FIG. 5, the combustion zone is divided even though the plug 402 has been moved further towards the heel 404. For example, the area between the two combustion zones may not have any fuel or alternate control methods (e.g., control of oxygen or air) may be used to inhibit or prevent combustion in that area regardless of the plug's position. Accordingly, in addition to movement of the plug 402 or as an alternative to using a plug at all, the provision of oxygen, air, and/or other fluid mixtures may be separately controlled to enhance or limit the heat production along some or all of the pipe 400 (including vertical and/or near surface portions), assuming the amount of fuel remaining is sufficient to be affected and/or can be reached by the oxygen. By limiting the amount of oxygen available for the fuel's combustion process, the amount of heat produced may be lowered. By increasing the amount of oxygen available for the fuel's combustion process, the amount of heat produced may be increased.

The process of sequentially moving the plug 402 may also be used to increase EOR in the current well, as well as in surrounding wells. In the same well, this sequential movement may be used to build up pressure that forces oil or gas to flow to areas that have not been ignited and where the hydrocarbons can be extracted. Accordingly, by controlling the combustion zones as described herein, more granular control of EOR may be achieved to increase the amount of extractable hydrocarbons compared to conventional EOR methods.

Figure 6:
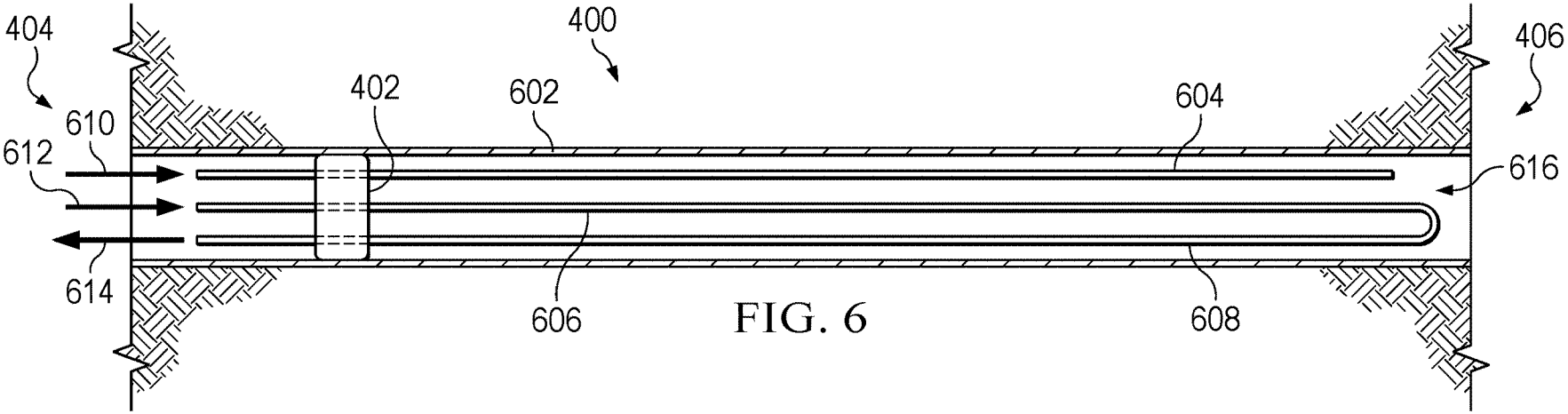
FIGS. 6-10 illustrate embodiments of a pipe section having fluid conduits positioned therein in different arrangements.

Referring to FIG. 6, one embodiment of a section of the pipe 400 of FIGS. 4A-5 according to aspects of the present disclosure is illustrated that may be used to initiate and maintain the combustion represented by the combustion zones of FIGS. 4A-5. For purposes of example, the pipe 400 includes a casing 602 and/or liner (not shown), but it is understood that the casing 602 may represent many different types of pipes as described previously with respect to FIG. 3A. The casing 602 may include perforations to allow fluid to pass through the casing as described with respect to FIG. 3B. The casing 602 may be left from a previous drilling and/or fracking operation, or may be placed specifically for the active geothermal process described herein. Accordingly, the casing 602 may be of different sizes, thicknesses, and materials depending on the various parameters of the borehole. As described previously, if a casing is not present, various components may be positioned and then secured using concrete or other suitable means, or left unsecured if desired.

In the present example, the interior of the pipe section 400 includes a fluid conduit 604 for one or more combustion fluids such as air, oxygen, or a mixture thereof, and/or other fluid mixtures (liquid or gas) to aid in the ignition and continuation of a combustion process. The fluid conduit 604 may also be used for suppressants such as carbon dioxide, nitrogen, etc. A fluid conduit 606 is used to introduce cool liquid or gas into the pipe section 400. The thermal energy produced by the combustion of the surrounding formation heats the fluid, which returns to the surface via a fluid conduit 608. In the present example, the fluid conduits 606 and 608 form a single, closed loop, and may be viewed as separate conduits that are connected or as a single conduit.

It is understood that all or portions of the fluid conduits 604, 606, and/or 608 may be formed with different diameters. This enables a desired volume of fluid to be moved per unit time, while altering the flow rate of the fluid due to the changes in diameter. For example, vertical portions of the fluid conduits 606 and 608 may be smaller in diameter than horizontal portions. This means that the flow rate in the horizontal near the thermal zone may be slower (relative to the vertical flow rate) because of the larger diameter to provide additional heating time, while the flow rate in the vertical may be faster (relative to the horizontal flow rate) due to the smaller diameter to reduce thermal changes before and/or after heating occurs. It is understood that different diameters may be used in different locations along a single fluid conduit, and the locations and/or diameters may depend on such factors as the length of the fluid conduit, the size and and/or temperature of the thermal zone, and other factors.

Although described for purposes of example as carrying particular fluids for a particular purpose, it is understood that the fluid conduits 604, 606, and 608 in FIGS. 6-9 may carry other fluids used for alternate purposes. It is understood that any combination of open and closed loop fluid conduits may be used to deliver various fluids to the pipe 400 and to extract fluids from the pipe. Accordingly, the illustrated combinations of open and closed loop fluid conduits are for purposes of example only. Furthermore, each fluid conduit 604, 606, and 608 may represent multiple fluid conduits and such fluid conduits may carry identical or different fluids. Examples of different arrangements of fluid conduits are illustrated with respect to FIGS. 13-20.

A particular fluid conduit may be formed of any suitable material for the fluid or fluid mixture used with the fluid conduit. Other properties that may be taken into consideration for selecting the material may include flexibility, rigidity, and the material's ability to withstand expected temperatures and pressures within a combustion zone. Accordingly, fluid conduits may be of different sizes, thicknesses, and materials (e.g., metals and metal alloys). In some embodiments, more expensive alloys may be used for fluid conduits that are exposed in the lateral portion. In still other embodiments, a fluid conduit may have an anti-corrosion lining and/or steps may be taken to minimize erosion, such as by injecting fluids that aid in corrosion prevention.

Although not shown, other components used by the active geothermal system 102 of FIG. 1 may be present within the pipe section 400. Ignition source 210, monitoring equipment 212, safety equipment 214, communications equipment 216, and/or control components 218 may be positioned downhole to perform various functions for the active geothermal system 102. If needed, an ignition source 210 may be present. If downhole conversion occurs, an energy converter 206 may be present. Accordingly, additional conduits and/or equipment may be present to provide power, control, monitoring, communications, and/or other functions.

One or more of the fluid conduits 604, 606, and 608 may be perforated and/or may be divided into controllable sections to allow more granular control over fluid flow. Arrows 610, 612, and 614 illustrate the flow direction in fluid conduits 604, 606, and 608, respectively, with respect to the heel 404 and toe 406. It is understood that the fluid conduits 604, 606, and 608 may not be to scale with respect to the pipe section 400.

The plug 402 may be used to seal the interior of the pipe and create a chamber 616 from plug 402 to the toe 406. The plug 402 may be used to both sequester gases such as carbon dioxide and to regulate the combustion area outside of the pipe 400. The position of the plug 402 may be controllable, enabling the plug 402 to be moved parallel to the central axis of the pipe 400. In some embodiments, a fluid may be pumped into the pipe section 400 above the plug or plugs 402 in order to provide a safety barrier through hydrostatic support of the plug. The fluid may be chosen to be insulative in nature to reduce parasitic thermal loss to the formation on the return flow to the surface.

In some embodiments, a mechanism may be used to block problematic parts of the lateral prior to and/or during combustion. For example, this may be done to isolate an area that contains too much or too little water. The blocking may be performed using a plug such as the plug 402. Additionally, or alternatively, a liquid or paste may be used that burns at a slower rate than the other parts of the lateral, thereby effectively adding a volume or time delay on the burning of that section of the lateral.

In some embodiments, an actuatable check valve and/or other components may be provided to enable a maintenance or cleanup cycle. For example, if solids from the combustion process cause clogging or other obstructions, a cleanup cycle may be executed in a preventative manner and/or after the system begins to experience negative performance.

Figure 7:
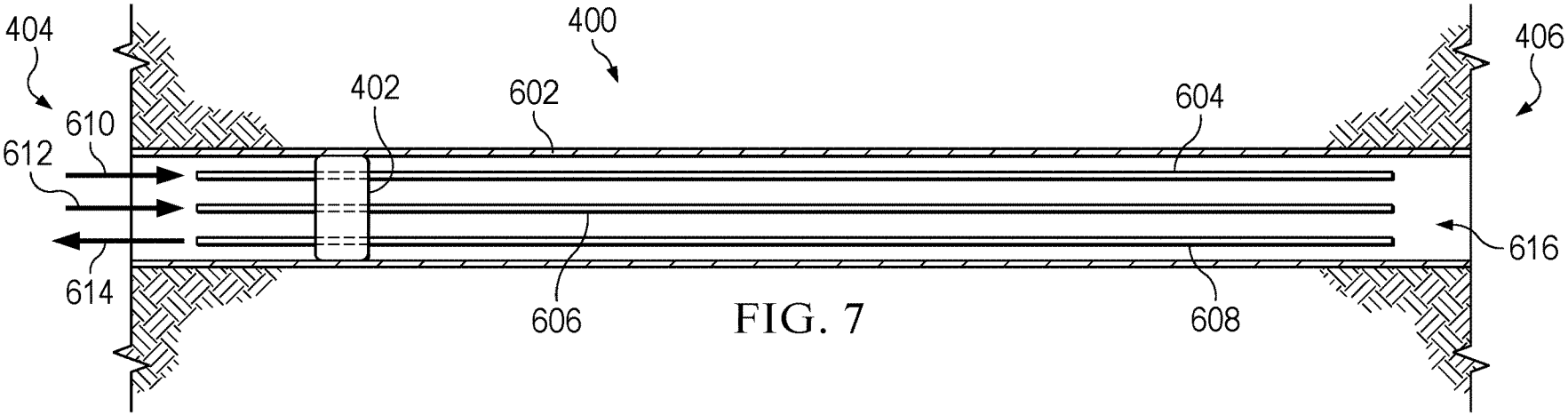

Referring to FIG. 7, another embodiment of the pipe section 400 of FIG. 4A is illustrated. In the present example, the fluid conduits 606 and 608 do not form a closed loop. In this example, a pump may be used to force heated fluid from the chamber 616 into the fluid conduit 608 and back to the surface. A pump may be positioned downhole or on the surface, and may provide positive pressure or a vacuum.

Figure 8:
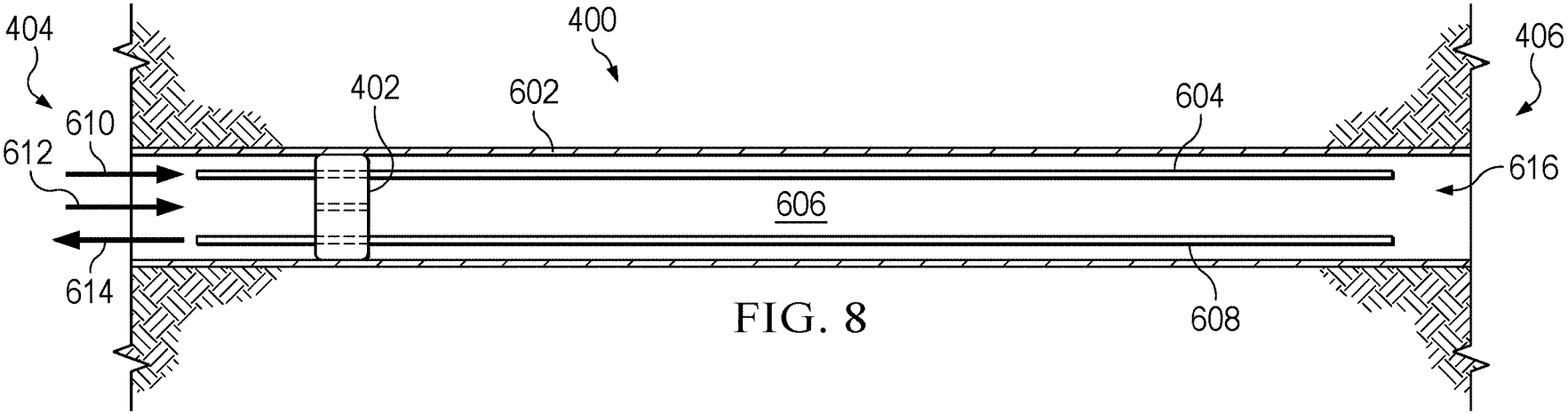

Referring to FIG. 8, yet another embodiment of the pipe section 400 of FIG. 4A is illustrated. In the present example, the fluid conduit 606 is absent and cool fluid is pumped directly into the casing 602. In such embodiments, the plug 402 may include a one-way valve, check valve, or other flow control device to prevent the flow from reversing. In addition, the pressure difference between the heel and toe sides of the plug 402 may be regulated to prevent the fluid from backing up the casing.

Figure 9:
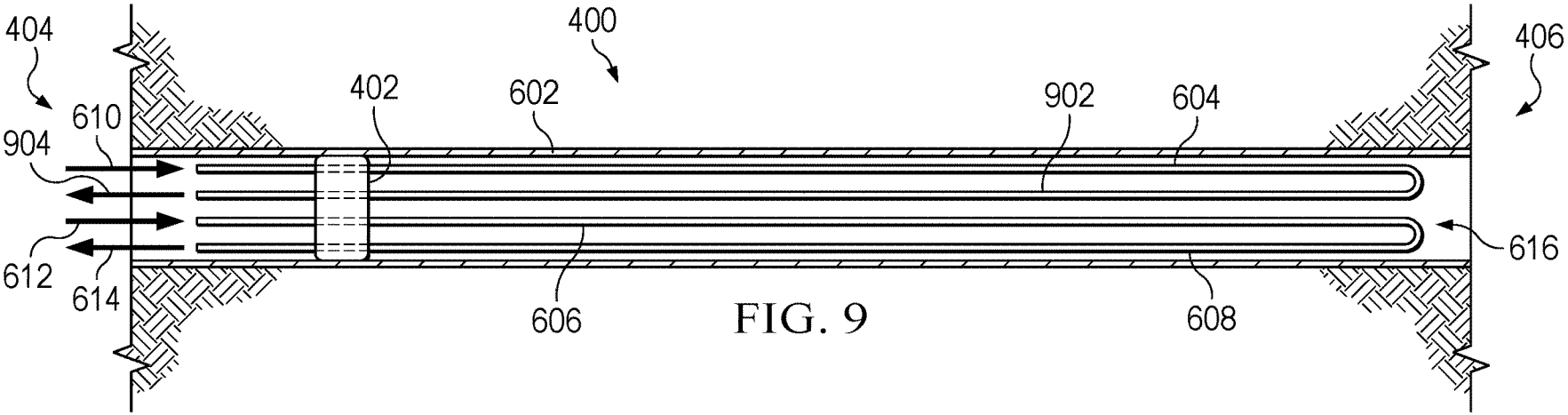

Referring to FIG. 9, still another embodiment of the pipe section 400 of FIG. 4A is illustrated. In the present example, the fluid conduits 606 and 608 form a closed loop, and the fluid conduit 604 also forms a closed loop with a fluid conduit 902. As indicated by arrows 610 and 904, fluid conduit 604 is an inlet and fluid conduit 902 is an outlet. The closed loops formed by the fluid conduits 604/902 and 606/608 may enable additional control over the fluid as illustrated below with respect to FIGS. 11A and 11B.

Figure 10:
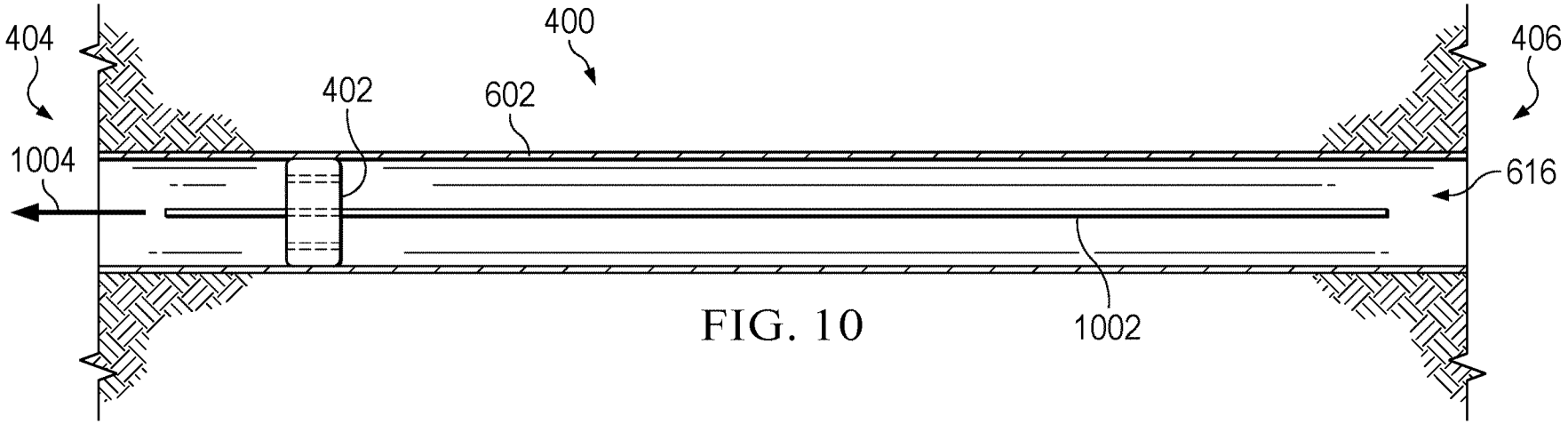

Referring to FIG. 10, another embodiment of the pipe section 400 of FIG. 4A is illustrated. In the present example, a fluid conduit 1002 provides a route by which pressurized fluid may exit the chamber 616 in a controllable manner as shown by arrow 1004. It is understood that other fluid conduits may be present, but are not shown in the present example for purposes of clarity. The fluid conduit 1002 may be used to remove pressurized fluid from the chamber 616 for safety and/or productivity. For example, the pressurized fluid may be used to generate power using pressure, including steam pressure (e.g., via turbines).

Figure 11A:
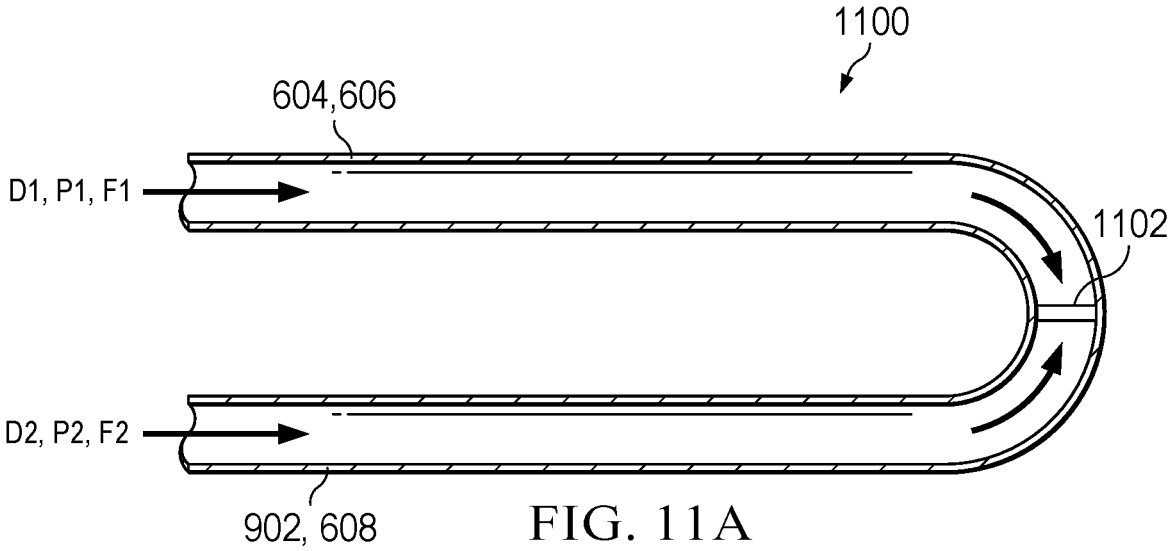
FIGS. 11A and 11B illustrate embodiments of a fluid conduit with dual entry points that enable two separate fluid flows to be offset against each other within the conduit.
Figure 11B:
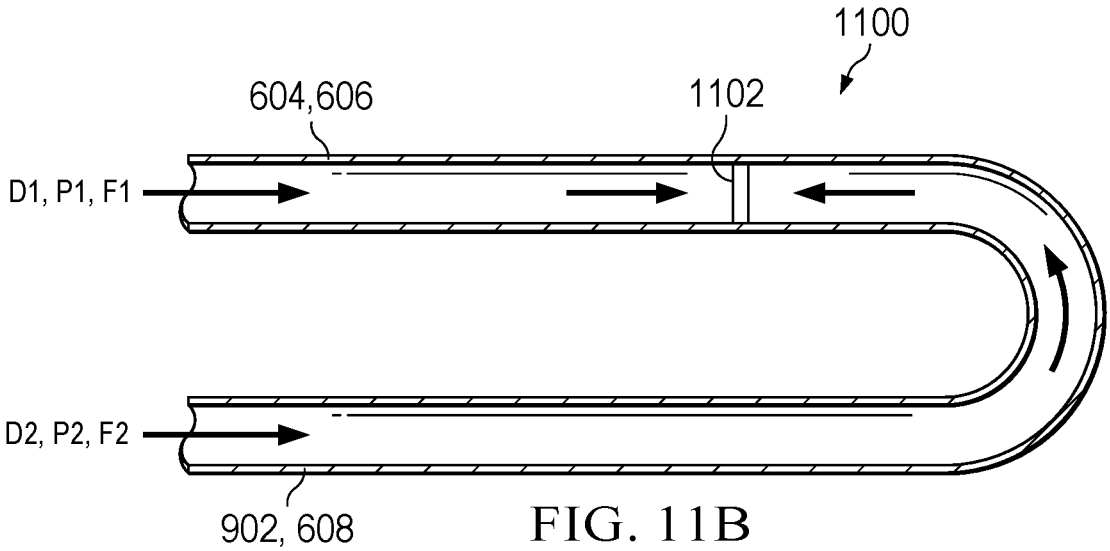

Referring to FIGS. 11A and 11B, one embodiment of a closed loop 1100 is illustrated, such as may be formed by the fluid conduits 604/902 and 606/608 of FIGS. 6 and 9. In the present example, however, both fluid conduits of each pair are inputs, rather than one inlet and one outlet as illustrated in FIGS. 6 and 9. This may provide additional control over the active geothermal process by allowing each conduit's fluid to "push" against the other depending on such factors as pressure and fluid density. It is understood that check valves and/or similar components may be used to provide additional control over mixing by regulating backflow in one or both directions.

Referring specifically to FIG. 11A, using the 604/902 pair of fluid conduits as an example, a fluid or fluid mixture having a density D1 is forced into the fluid conduit 604 using a pressure P1 at a flow rate F1. A fluid or fluid mixture having a density D2 is forced into the fluid conduit 902 using a pressure P2 at a flow rate F2. Assuming an ideal environment, if D1=D2, P1=P2, and F1=F2, the two fluids may meet at an approximate location 1102 and be somewhat stable, as both density and pressure are equal. While some mixing may occur at the boundary, the constant pressure being exerted into the fluid conduits may maintain a balance between the two fluids at the loop location.

Referring specifically to FIG. 11B, P1 has been temporarily modified to drop below P2, moving the location 1102 into the fluid conduit 604 as the higher pressure in the fluid conduit 902 pushes against the lower pressure in the fluid conduit 604. By then equalizing the two pressures P1 and P2, the location 1102 may again be stabilized.

In this manner, the closed loop formed by the two conduits 604/902 may be manipulated to, for example, provide more or less of a desired fluid to an area by altering the pressure, flow rate, and/or density of the fluid in each conduit. For example, if the fluid in the conduit 604 has a relatively high oxygen content and the fluid in the conduit 902 is regular air with a lower oxygen content, the closed loop may contain more pure oxygen in FIG. 11A than in FIG. 11B. This in turn may be used to regulate the combustion occurring outside of the pipe 400.

Such manipulation may enable the active geothermal system 102 to mix different fluids below surface, concentrate a fluid at a location within the pipe 400, offset oxygen/air with a suppressant such as carbon dioxide, and/or manipulate the fluids in other ways, whether liquid or gas. For example, a richer mixture of oxygen may be desirable in the heel relative to the toe in order to increase the burn rate at the heel in comparison to the toe. In another example, one part of the combustion zone may be burning at a faster rate, thereby causing more breakthrough potential than another part of the combustion zone, and it may be desirable to slow down the faster burning area's combustion rate by reducing the oxygen mix for that area. Accordingly, the use of a closed loop fluid conduit may enable more control over changes to the gradient of heat and/or the distance progress of the combustible area.

Figure 12A:
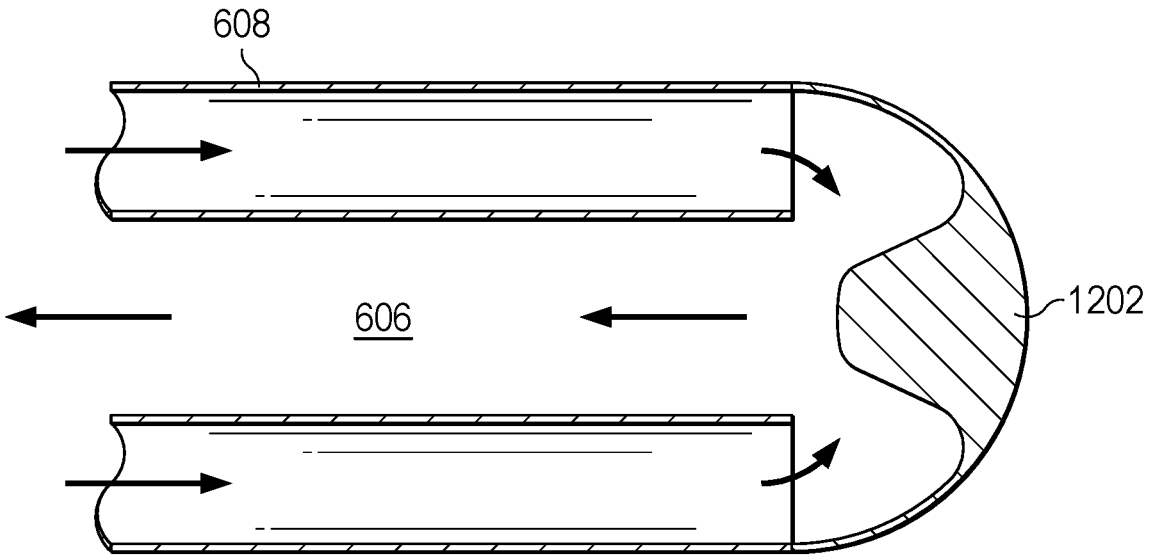
FIGS. 12A and 12B illustrate embodiments of two fluid conduits arranged so that fluid is directed from an entry conduit to an exit conduit.
Figure 12B:
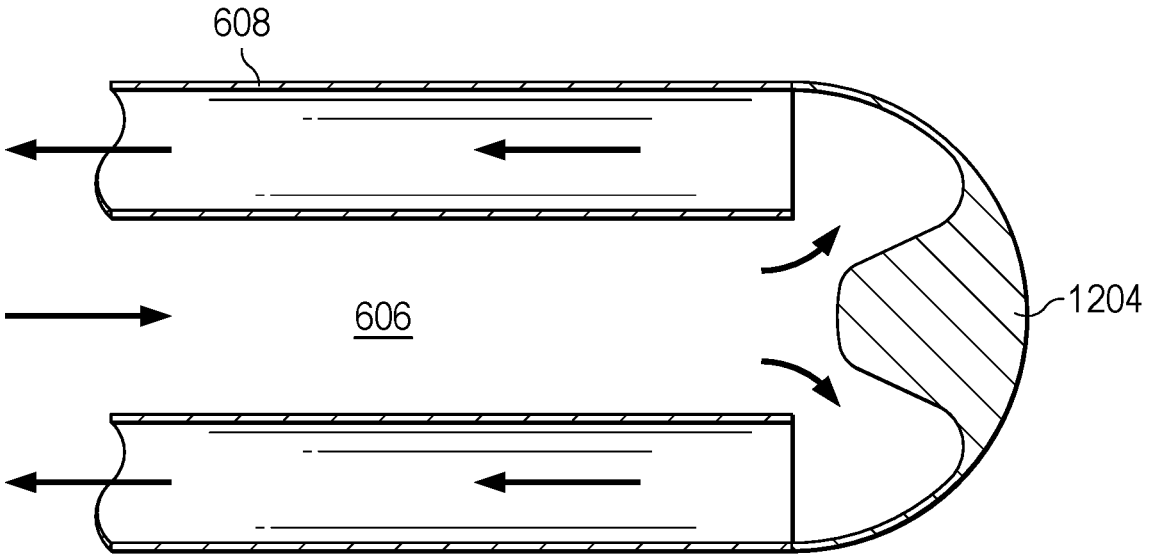

Referring to FIGS. 12A and 12B, embodiments of an open channel configuration are illustrated. In the present example, using the 606/608 pair of fluid conduits of FIG. 7 as an example, each conduit ends without forming a closed loop with the other. Accordingly, in FIG. 12A, fluid flows in via conduit 608 and out via conduit 606. One or more protrusions 1202, such as a bull nose device, a lip, or any other shape, may be used to direct the flow from one conduit to another, and may also aid in preventing erosion of the pipe 400. It is understood that such functionality may be provided in many different ways, including modifications to the conduit walls themselves. In FIG. 12B, fluid flows in via conduit 606, and out via conduit 608. Although shown as a similar shape to the protrusion 1202 of FIG. 12A, the protrusion 1204 may be shaped differently, with the shape of each protrusion based on factors such as the direction, flow rate, density of the fluid(s), and relative diameters and arrangements of the conduits 606 and 608.

Referring to FIGS. 13-20, various embodiments illustrate possible cross-sectional arrangements of the pipe 400 and the fluid conduits 604, 606, 608, and/or 902. The particular arrangement of fluid conduits 604, 606, 608, and 902 may be based at least partly on the interior space available in the casing 602, the number of conduits used, the fluid parameters (e.g., flow, pressure, and density) for each type of conduit, the type of equipment positioned on the surface, the manufacturing process, the installation process, the composition of the surrounding strata, and/or other factors. The placement, dimensions, and other organizational aspects of the conduits within the casing 602 may be optimized for heat transfer and may be balanced with the need for providing adequate equipment space for downhole equipment.

While each of the fluid conduits 604, 606, 608, and 902 may be structurally designed for the movement of a liquid or a gas, it is understood that the particular fluid phase used with a fluid conduit (and therefore the conduit's structure) may depend on the implementation details of the surface equipment and/or the particular borehole. Although various conduits in FIGS. 13-20 are labeled for illustration, it is understood that many different combinations and arrangements of conduits are possible. In addition, fluid conduits may be open or coupled via a closed loop.

Figure 13:
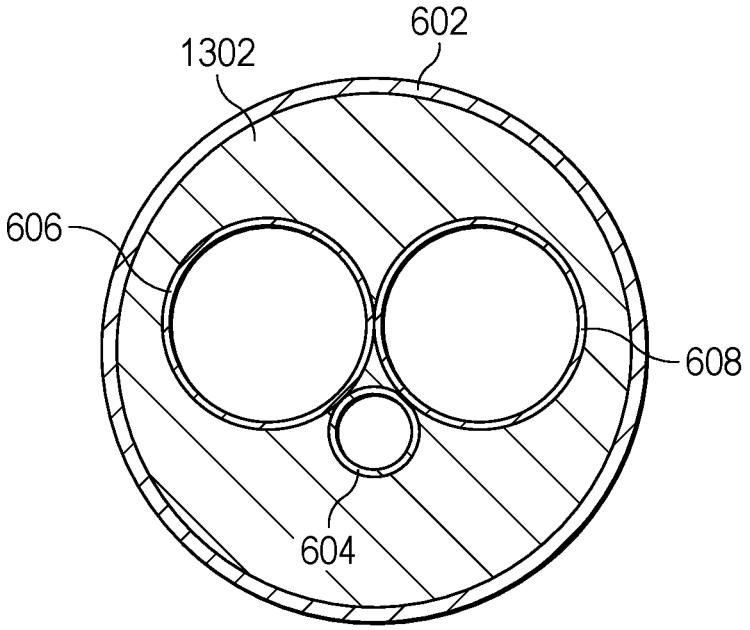
FIGS. 13-20 illustrate embodiments of various cross-sectional arrangements of fluid conduits within a pipe.
Figure 14:
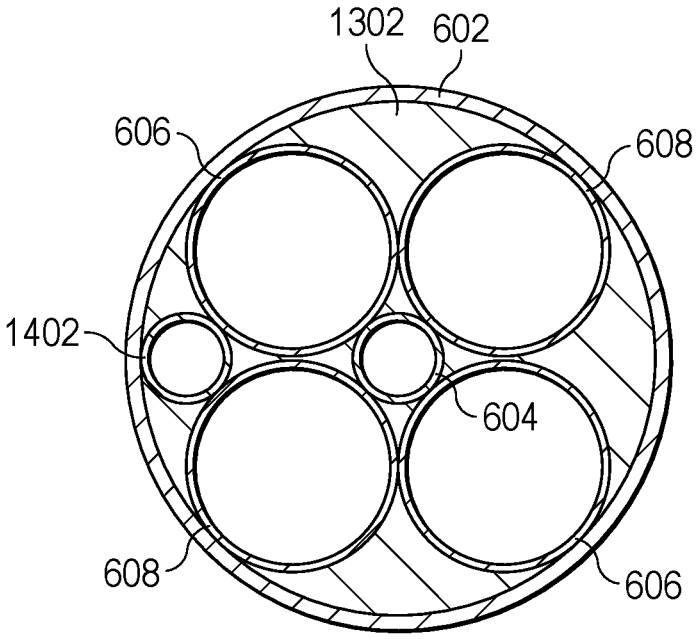

In embodiments where there is space in the casing 602 between fluid conduits, such as in FIGS. 13 and 14, the casing may be filled with a thermally conductive material 1302, whether a gas, solid, liquid, or a mixture thereof. The term "conduit" is used herein to refer generally to lines, pipes and tubes (which may be adjacent, concentric, or otherwise positioned relative to one another), channels, grooves, laminates, and any other means for directing the flow of a fluid from one point to another. Structural supports may also be present, as shown by supports 1802 in FIG. 18. Such supports may include springs, fins, and/or any type of fixed or movable structural element or device that may be used to maintain the position of a conduit within the outer tube and/or relative to other conduits. Such supports may be made of any suitable material, including materials that expand with temperature. It is understood that FIGS. 13-20 represent examples of many different possible arrangements of fluid conduits, and the number, position, and/or shape of each of the fluid conduits may be modified in many different ways.

Figure 15:
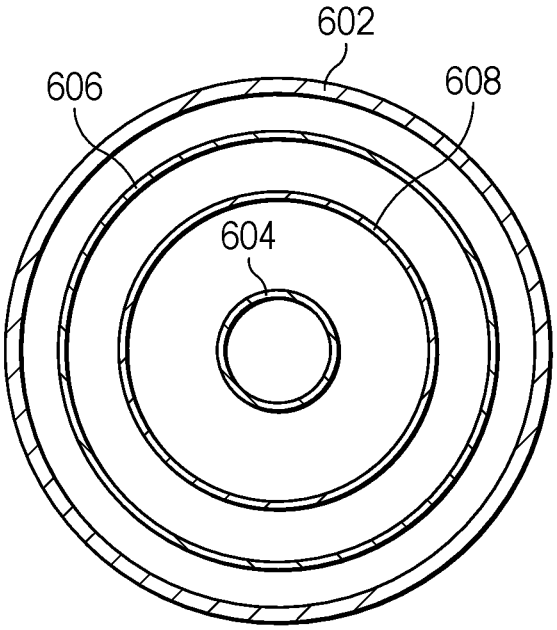
Figure 16:
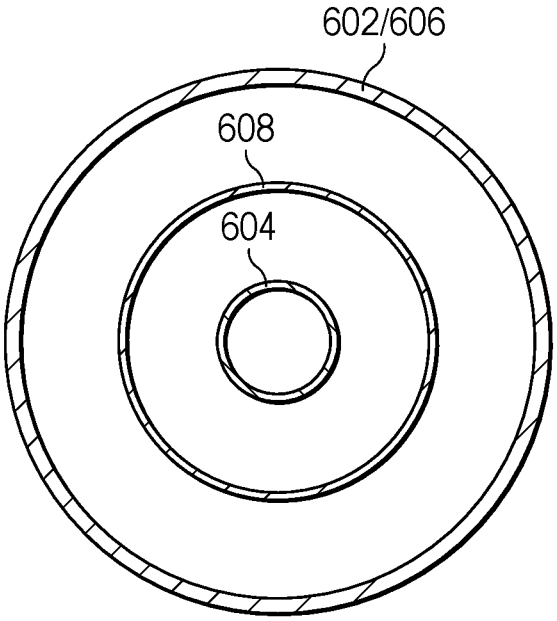
Figure 17:
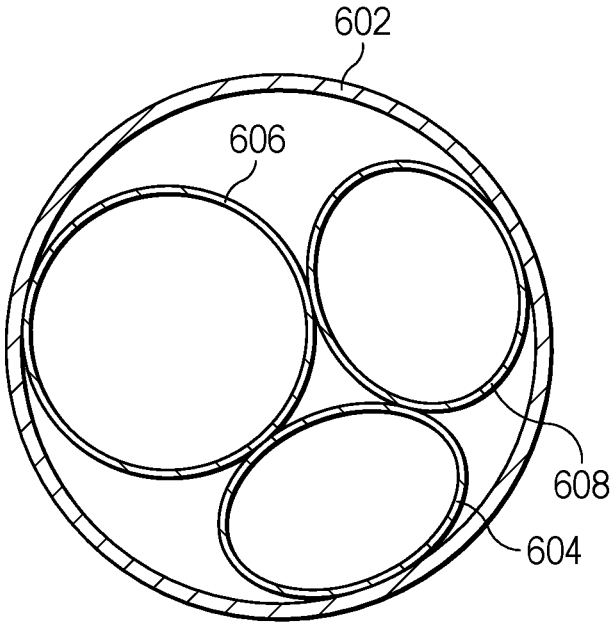
Figure 18:
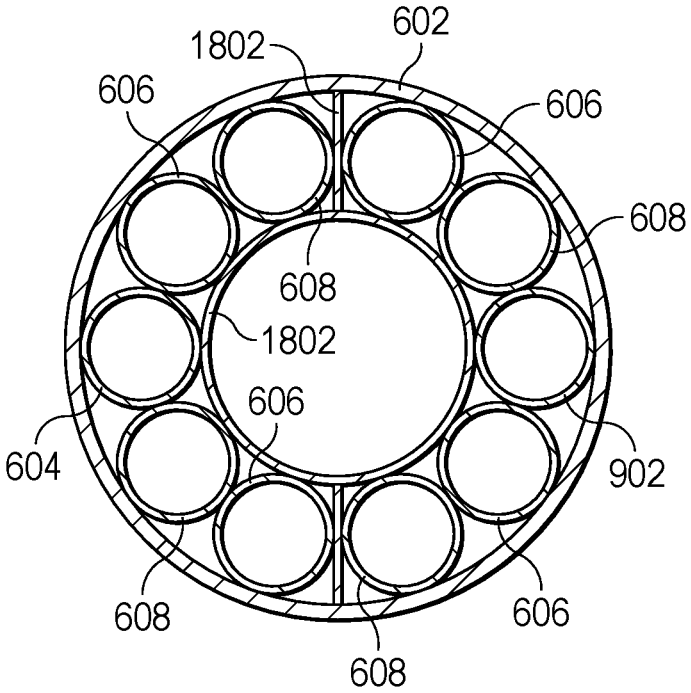
Figure 19:
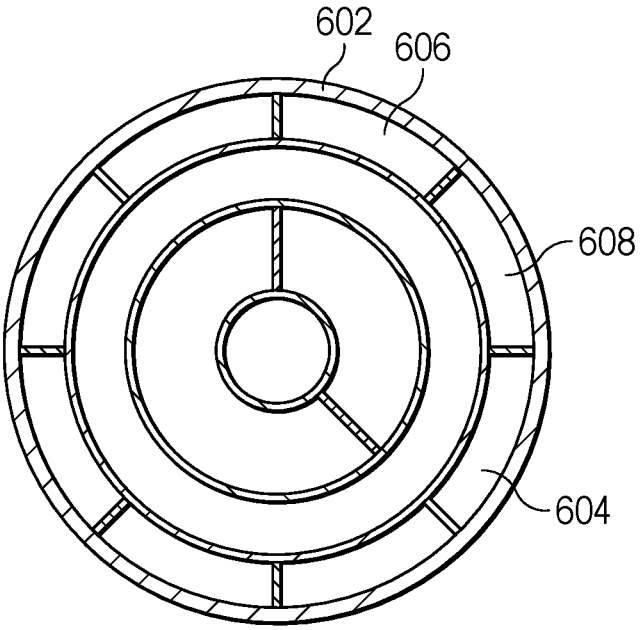
Figure 20:
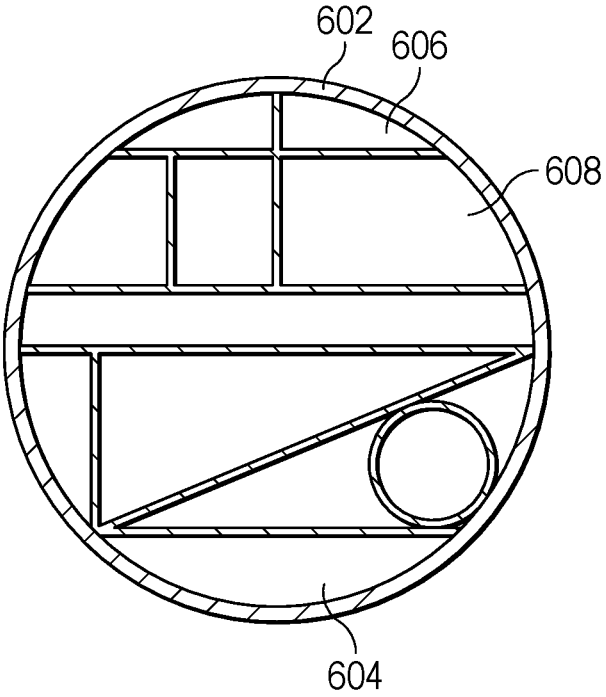

FIG. 13 illustrates a single conduit for each of the fluid conduits 604, 606, and 608. FIG. 14 illustrates a single fluid conduit 604, two fluid conduits for each of 606 and 608, and an extra fluid conduit 1402, which may be used as an additional fluid flow for an existing fluid or for a fire suppressant such as carbon dioxide, nitrogen, or water. FIG. 15 illustrates the fluid conduits arranged as a series of concentric circles, with the gaps between the walls forming the fluid conduits. FIG. 16 illustrates the fluid conduits arranged as a series of concentric circles with the casing 602 serving as the exterior of the fluid conduit 606.

Figure 21A:
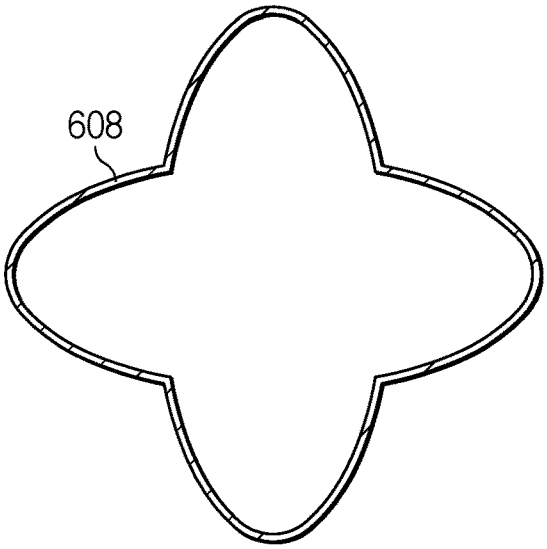
FIGS. 21A-21C illustrate embodiments of an alternate cross-sectional arrangement of fluid conduits.
Figure 21B:
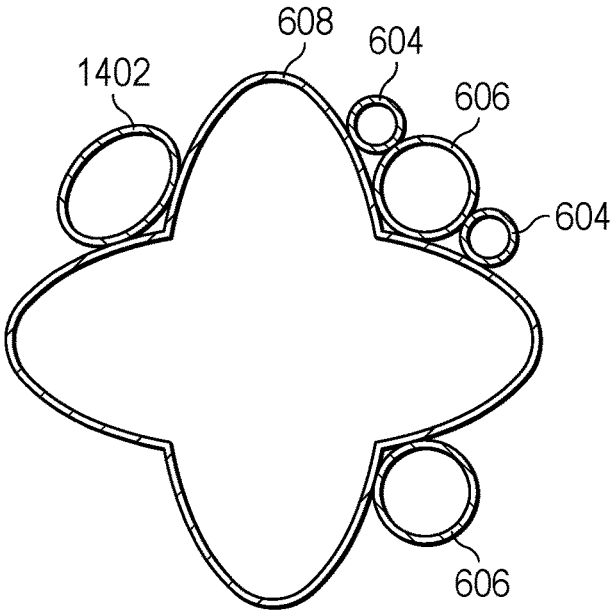
Figure 21C:
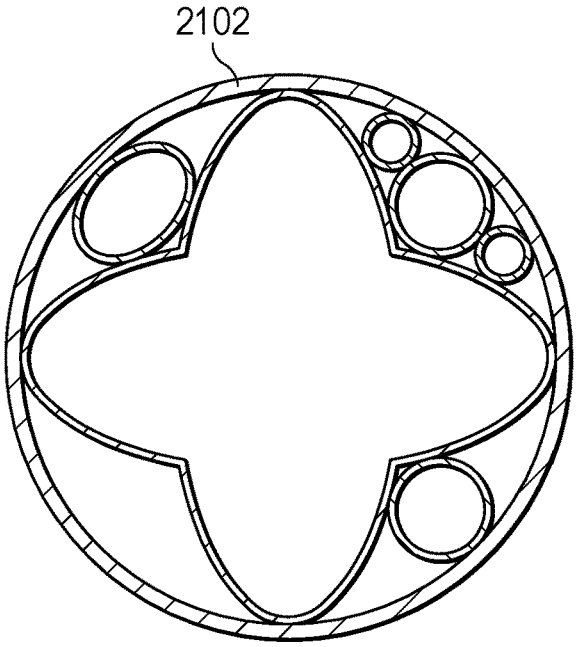

Referring to FIGS. 21A-21C, one embodiment of a modular cross-sectional approach is illustrated. A central conduit 608 may be created by rolling, machining, welding, and/or otherwise shaping a metal or other material into a desired shape. For purposes of example, the conduit 608 includes multiple convex portions positioned around a central axis, but it is understood that the conduit 608 may be designed with many different cross-sectional features. Additional conduits, such as conduits 604, 606, and 1402 may be positioned as illustrated in FIG. 21B so that the entire assembly may be wrapped in an outer layer 2102 to form a substantially cylindrical shape as illustrated in FIG. 21C.

In order to release combustion fluids into the formation using the cross-sectional approach, holes may be punched in the outer layer 2102 and one or more conduits as desired. Such holes may be punched downhole or may be pre-punched and filled with a compound that may burn off or otherwise self-remove once exposed to the combustion area, or that may be forced out of the holes by pressure from the fluid conduits. Thermally conductive paste and/or other materials may be used to fill in gaps between the outer layer 2102 and the conduits to maintain the generally cylindrical outer shape while enhancing thermal conductivity.

Referring to FIGS. 22-25, various embodiments illustrate possible cross-sectional arrangements of the pipe 400 and the fluid conduits 604, 606, 608, and 902 with and/or without insulation. Insulation of various types may be used to isolate a fluid conduit from other conduits and/or the formation thermally, electrically, and/or for other purposes. Such insulation may, for example, enable additional control over the heat of a compressed fluid to optimize combustion. The insulation may be formed by one or more fluids, foams, pastes, and/or other materials suitable for the insulation desired and the method of installation (e.g., flowing, pumping, or spraying insulation, and/or by wrapping a fluid conduit). It is understood that FIGS. 22-25 represent examples of many different possible arrangements of fluid conduits and insulation, and the number, position, and/or shape of each of the fluid conduits and the arrangement of insulation, including insulation thickness, may be modified in many different ways.

Figure 22:
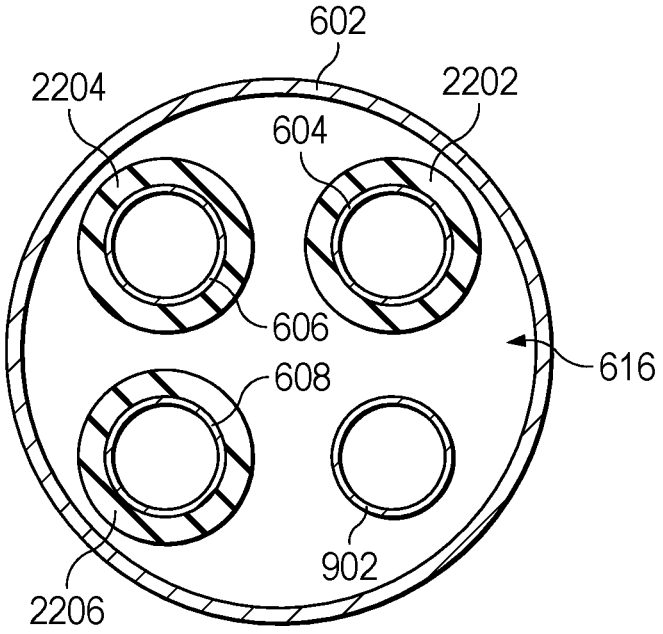
FIGS. 22-25 illustrate embodiments of various cross-sectional arrangements of fluid conduits and insulation within a pipe.
Figure 23:
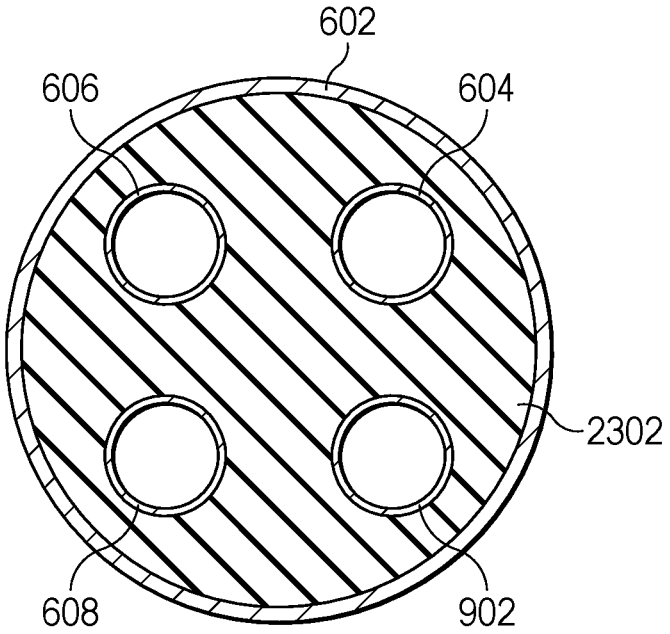

FIG. 22 illustrates the fluid conduits 604, 606, and 608 having insulation layers 2202, 2204, and 2206, respectively. The fluid conduit 902 is not insulated and the chamber 616 does not contain insulation. FIG. 23 illustrates the fluid conduits 604, 606, 608, and 902 surrounded by insulation 2302 that has been positioned within the chamber 616.

Figure 24:
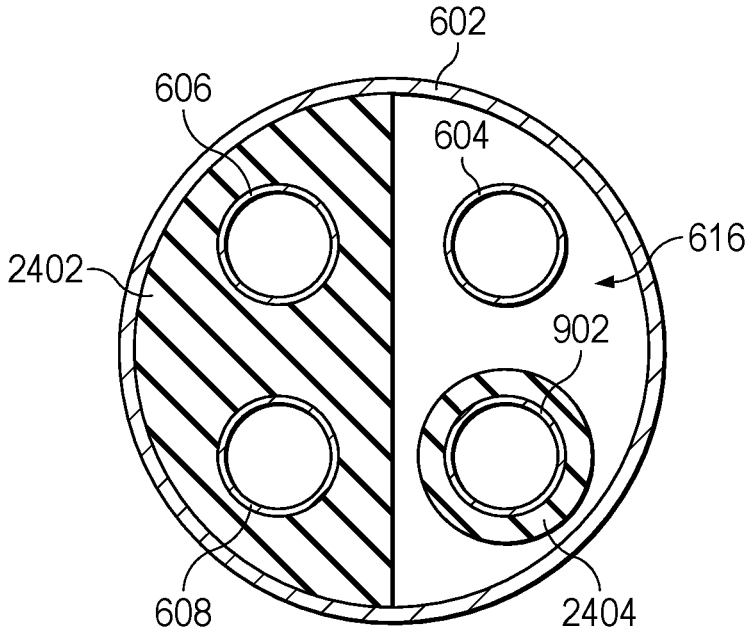

FIG. 24 illustrates the fluid conduits 606 and 608 surrounded by insulation 2402 that has been positioned within the chamber 616. The fluid conduits 604 and 902 are in a portion of the chamber 616 that does not contain insulation, with the fluid conduit 604 remaining uninsulated and the fluid conduit 902 surrounded by an insulation layer 2404.

Figure 25:
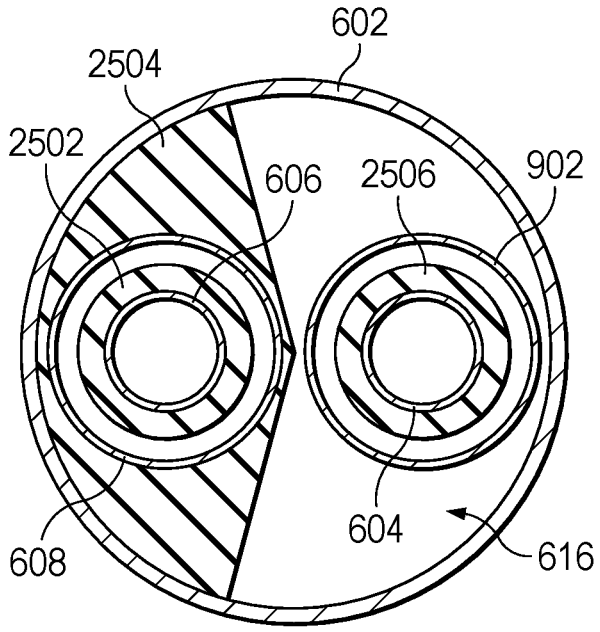

FIG. 25 illustrates the fluid conduit 606 positioned within the fluid conduit 608, with an insulation layer 2502 separating the two fluid conduits. The fluid conduit 608 is positioned within a portion of the chamber 616 filled with insulation 2504. The fluid conduit 604 is positioned within the fluid conduit 902, with an insulation layer 2506 separating the two fluid conduits. The fluid conduits 604 and 902 are in a portion of the chamber 616 that does not contain insulation.

Referring to FIGS. 26-29, various embodiments illustrate possible arrangements and configurations of fluid conduits, which may be similar or identical to some or all of the fluid conduits 604, 606, 608, 902, and 1002 described in other embodiments herein. Different arrangements and/or configurations of fluid conduits may be used to provide fluid(s) to a specific part of the pipe 400 (FIGS. 4A-5). This may be desirable, for example, to focus the delivery of combustion supporting fluids to a particular area, to concentrate thermal fluids with respect to a combustion zone, and/or to deliver combustion suppressants to a selected area. It is understood that FIGS. 26-29 represent examples of many different possible arrangements and configurations of fluid conduits, and the number, position, shape, and/or configuration of each of the fluid conduits and their relative arrangement may be modified in many different ways. Furthermore, it is understood that the various embodiments may be combined in many different ways. For example, fluid conduits may be of different lengths, with and without perforations, and with some being concentrically arranged and others not.

Figure 26:
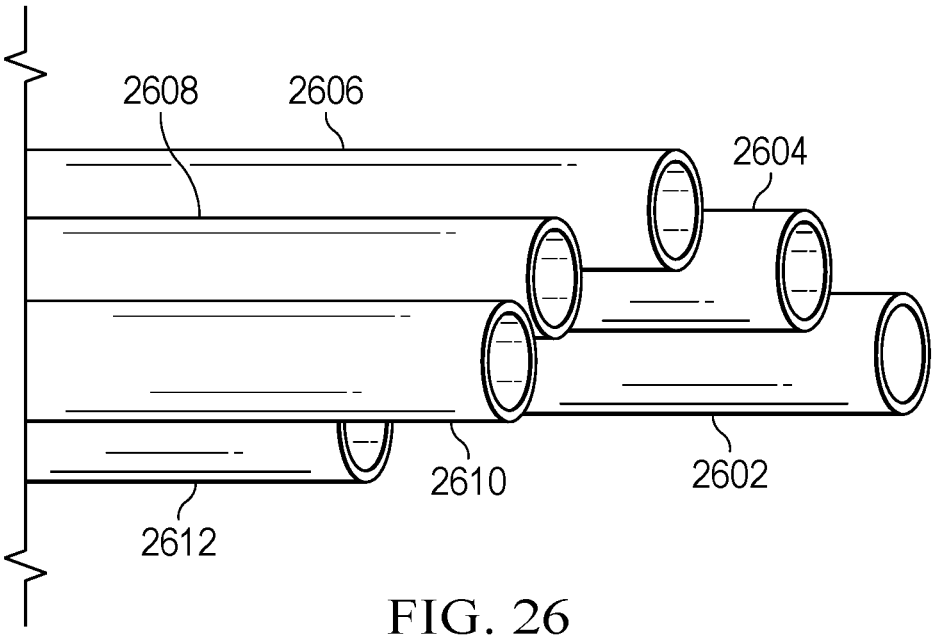
FIGS. 26-29 illustrate embodiments of various arrangements and configurations of fluid conduits.

FIG. 26 illustrates fluid conduits 2602, 2604, 2606, 2608, 2610, and 2612 configured with a fluid outlet or inlet positioned at the open end of each fluid conduit. In the present example, the fluid conduit 2602 is longer than the others and the fluid conduit 2612 is shorter than the others, and so using the fluid conduit 2602 or 2612 to deliver or receive fluids may generally have a greater effect in the area around the open end of the respective fluid conduit. It is understood that the distances between the open ends may be significant relative to the diameters of the fluid conduits themselves and/or the pipe 400 (not shown) within which they may be positioned.

For example, pumping a combustion fluid into the fluid conduit 2602 may result in the delivery of the fluid to the toe of the pipe, while pumping a combustion fluid into the fluid conduit 2612 may result in the delivery of the fluid to the heel of the pipe. Accordingly, by varying the length of different fluid conduits and then selecting one or more fluid conduits for use at any given time, some control may be achieved over the delivery and recovery of fluids. In some embodiments, some fluid conduits may be staggered in length, while others may be substantially equal (e.g., the fluid conduits 2608 and 2610).

Figure 27:
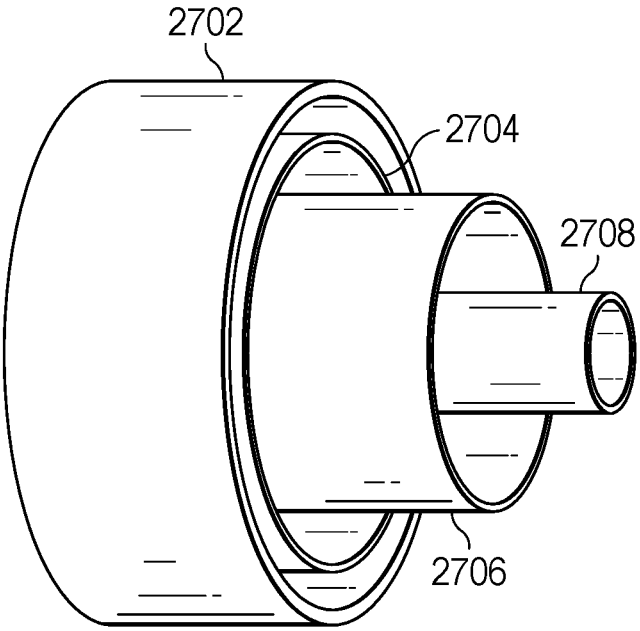

FIG. 27 illustrates fluid conduits 2702, 2704, 2706, and 2708 configured with a fluid outlet or inlet positioned at the open end of each fluid conduit. In the present example, the fluid conduits 2702, 2704, 2706, and 2708 are arranged as concentric circles. In some embodiments, some fluid conduits may be staggered in length, while others may be substantially equal (e.g., the fluid conduits 2702 and 2704).

Figure 28:
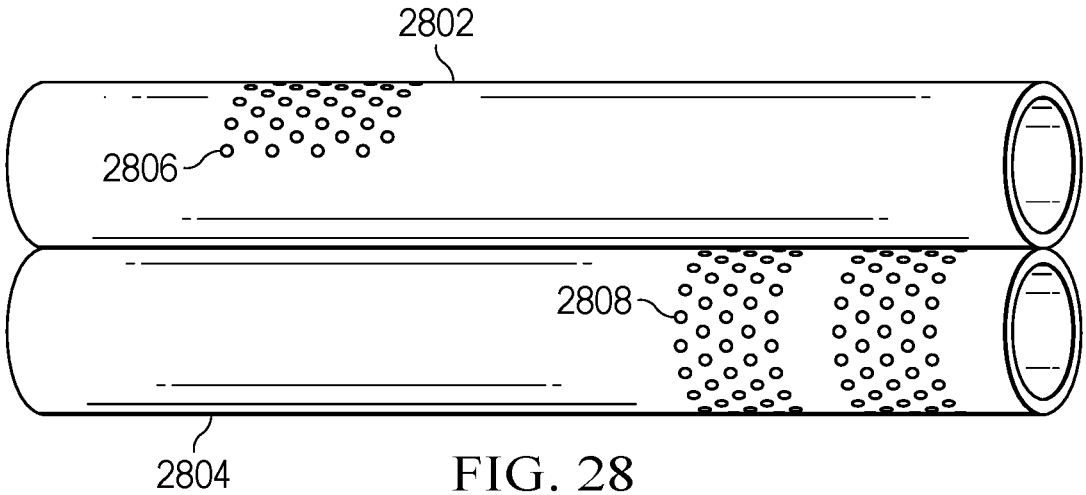

FIG. 28 illustrates fluid conduits 2802 and 2804 with perforations therein. The fluid conduit 2802 includes perforations 2806 that do not completely encircle the fluid conduit, and the fluid conduit 2804 includes perforations 2808 that do completely encircle the fluid conduit. A fluid conduit may have any number of perforations and the perforations may be of any size, shape, orientation, and arrangement. The perforations may be pre-drilled and/or may be drilled as the fluid conduit is being inserted into the borehole.

Figure 29:
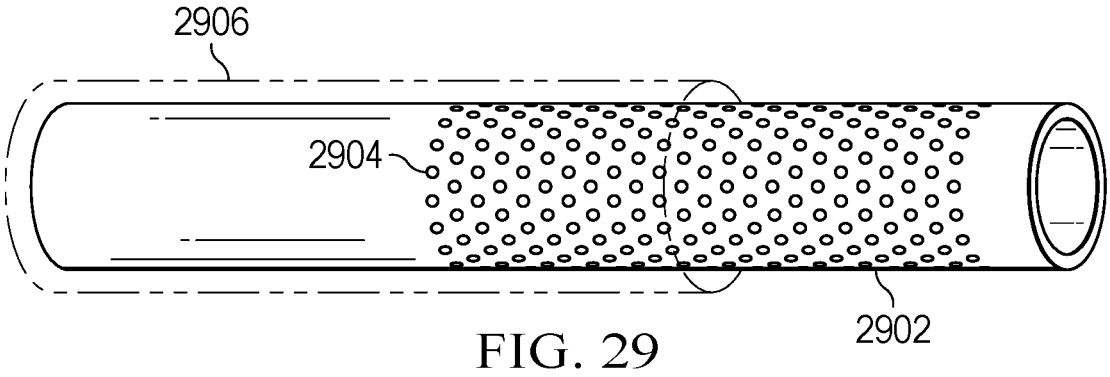

FIG. 29 illustrates a fluid conduit 2902 with perforations 2904. In the present embodiment, a sleeve 2906 (which may be external to the fluid conduit 2902 as shown or internal) may be used to block certain perforations by sliding the sleeve along the fluid conduit 2902. The sleeve 2906 may be solid or may itself contain any number of perforations of any size, shape, orientation, and arrangement.

Figure 30:
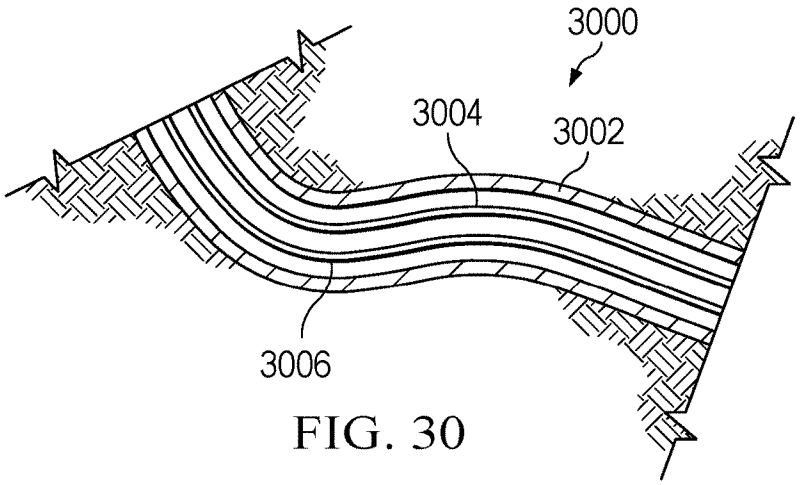
FIGS. 30-37B illustrate various embodiments of umbilical sections.

Referring to FIG. 30, one embodiment of an umbilical section 3000 is illustrated. The umbilical section 3000 includes an outer tube 3002 that contains one or more fluid conduits 3004 and 3006. In addition, other components may be contained within the outer tube 3002, such as electrical conduits and/or cables, and control and/or safety components such as valves, switches, and ignition mechanisms. It is understood that although only fluid conduits 3004 and 3006 are shown in the present example, any number of fluid conduits and/or other components may be present, and they may be arranged in many different ways. In some embodiments, electrical wires and/or other thermally sensitive components may be run alongside or within cold water and/or air conduits for additional cooling. In some embodiments, a sensor wire, such as a fiber optic wire capable of sensing temperature and pressure, may be used.

Generally, it may be challenging to insert the fluid conduits 3004 and 3006 directly into a pipe (e.g., the casing 302 or the production pipe 316 (if pre-installed) of FIGS. 3A and 3B, or the pipe 400 of FIGS. 4A-5 or casing 602 of FIGS. 6-10 if the pipe 400 or casing 602 represent pre-installed pipes) in order to position them as desired downhole. For example, factors such as the length of the existing pipe, the flexibility of the fluid conduits 3004 and 3006, friction between the pipe and the fluid conduits, friction between the fluid conduits, potential buckling and/or other structural integrity issues in the pipe, and/or other factors may make it difficult to insert the fluid conduits directly into the pipe. Accordingly, by installing the fluid conduits 3004 and 3006 in the outer tube 3002 and then inserting the outer tube downhole, the fluid conduits may be positioned as desired. In some embodiments, the umbilical 3000 may be similar or identical to the production pipe 316 of FIGS. 3A and 3B once installed, except that the umbilical may extend to the surface.

The outer tube 3002 has an outer diameter that allows insertion into the pipe 400 present in a particular borehole and so the outer diameter of the outer tube may vary depending on the inner diameter of the pipe. If the pipe 400 is tapered or has other varying dimensions, such variations may need to be accommodated unless the outer tube's diameter is selected to fit within the smallest inner diameter of the pipe. Generally, a larger diameter pipe 400 will allow the use of a larger diameter outer tube 3002, which in turn may enable the use of more and/or larger fluid conduits and other components. Accordingly, one selection criterion for identifying existing wellbores to use for active geothermal energy extraction may be the diameter of the pipe installed within the wellbore.

The outer tube 3002 may be designed to have some flexibility while still maintaining a level of rigidity needed in order to insert the umbilical section 3000 into a pipe. Accordingly, the outer tube 3002 may be made of a material (e.g., a metal or metal alloy) that enables it to be inserted in a manner such as is used for coiled tubing. In such cases, the outer tube 3002 may be flexible enough to be transported on, and installed from, a spool in a manner identical or similar to coiled tubing. The umbilical section 3000 may be manufactured in its completed form elsewhere and transported to the wellsite. In other embodiments, some or all of the umbilical section 3000 may be assembled at the wellsite, with fluid conduits and/or other components being inserted into the outer tube 3002 at the wellsite. It is understood that the material used to make the outer tube 3002 may be selected based on a number of parameters other than flexibility and rigidity, such as its ability to withstand expected temperatures and pressures within a combustion zone.

Figure 31:
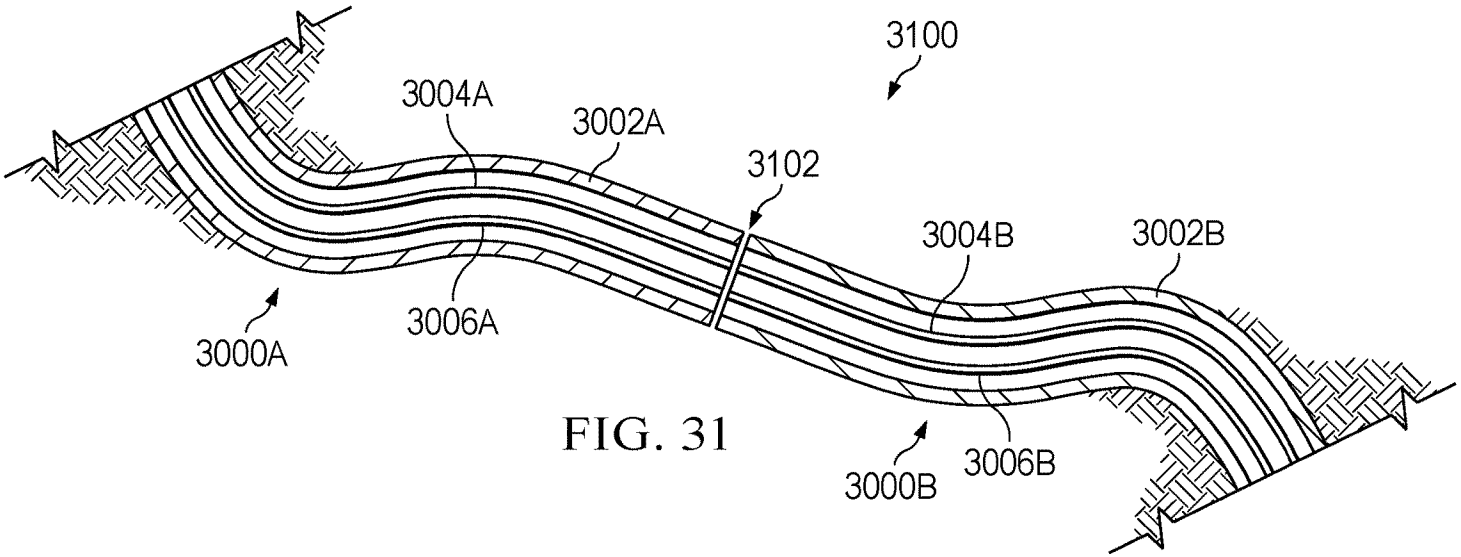

Referring to FIG. 31, depending on the length needed for an umbilical 3100, multiple umbilical sections 3000 may be used. In the present example, umbilical sections 3000A and 3000B may be coupled to form a continuous umbilical 3100. Umbilical sections 3000A and 3000B may be coupled to form a continuous umbilical either by coupling the two sections directly to one another at an interface point 3102 or using a manifold and/or other components (as will be discussed below) to couple the two sections. Such connections may be made prior to arrival at the wellsite, at the surface at the wellsite prior to or during insertion, or downhole. Although a gap is shown between the two umbilical sections 3000A and 3000B in FIG. 31 at the interface point 3102, it is understood that the two umbilical sections are connected either directly or via another component (e.g., a manifold) in practice and the gap is simply to illustrate the two sections in the figure.

It is understood that umbilical sections 3000 and/or the umbilical 3100 may be used in other embodiments in the present disclosure where fluid conduits and/or other components are described or illustrated as being downhole. For example, FIGS. 4A-29, 50, and other figures may incorporate the use of an umbilical as described herein, with references to outer casing/pipes/tubes being replaced with references to the outer tube 3002 of an umbilical 3100 or an umbilical section 3000, or with the umbilical 3100 or an umbilical section 3000 being inserted into the existing outer casing/pipe/tube with some or all of the fluid conduits contained within the umbilical or umbilical section.

The umbilical 3100 may be made as long as needed by joining additional sections 3000 to the existing umbilical. In some embodiments, umbilical sections 3000 may be of different lengths to enable more granular control over the number of connections and/or the placement of manifolds. Additionally, or alternatively, an umbilical section 3000 may be cut to a desired length, although this approach may need a connection interface to be installed on the severed end before it is connected to another umbilical section.

When two umbilical sections 3000A and 3000B are joined, the fluid conduits (3004A/3006A and 3004B/3006B, respectively) in the two sections need to be mated. This may be easier on the surface prior to insertion of the interface point 3102 into the borehole, but may be accomplished downhole in some embodiments. The mating mechanism may depend on the component being connected. For example, fluid connections may be sealed to prevent fluid from escaping the fluid conduits. Electrical connections may be sealed to prevent fluid leakage into the conduit containing the wires and also need to mate the wires with the appropriate wire(s) in the next section. Such connections and seals may be designed to be resistant to expected pressures, temperatures, corrosive fluids, movement, and/or other issues that may occur downhole, including variations between high and low pressures and/or temperatures.

Because the outer tube 3002 of an umbilical section 3000 is flexible and may bend in various directions during and after placement, the internal components need to be able to accommodate such variations. For example, dissimilar metals may expand and contract differently when exposed to different external temperatures and such changes may differ further based on internal fluid temperatures. Other factors may also cause variations along and between conduits, tubes, and/or other components, such as tensile loading and pressures along a conduit. Accordingly, some potential movement (e.g., slack) in the fluid conduits 3004 and 3006, as well as other components, may be desirable within the outer tube 3002.

Such slack may be a natural result of installation or may be intentionally designed and implemented to ensure that sufficient give is present in the fluid conduits 3004 and 3006. The slack may safeguard against fluid conduits or other components in one umbilical section pulling loose from the corresponding components in the next umbilical section if the outer tube moves during installation or after installation (e.g., the outer tube may sag in an area of the borehole where the pipe and/or casing is compromised), due to curving of the outer tube that stretches one or more of the conduits, or if the conduits themselves expand, contract, or shift due to environmental changes such as temperature and/or pressure variations.

In some embodiments, a vacuum may be used to thermally isolate two layers of conduits, tubes, and/or casing. By creating a vacuum in areas where heat transfer is not desired, additional insulation may be provided. The presence of a vacuum may also provide an additional avenue for leak detection, as loss of vacuum would indicate a compromised wall, seal, and/or other component.

Figure 32:
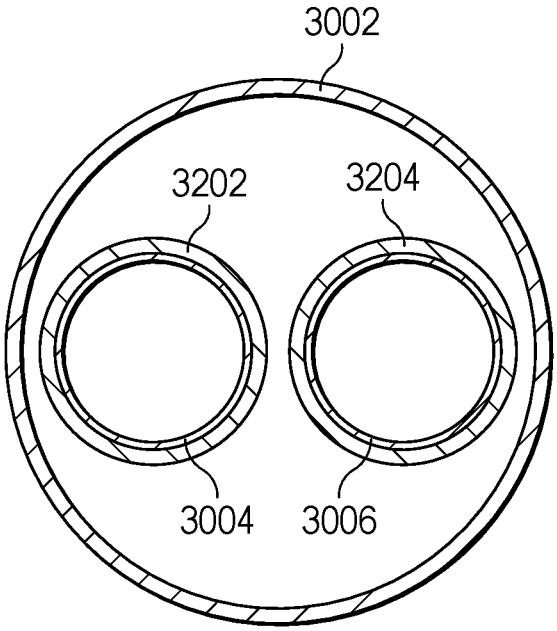
Figure 33:
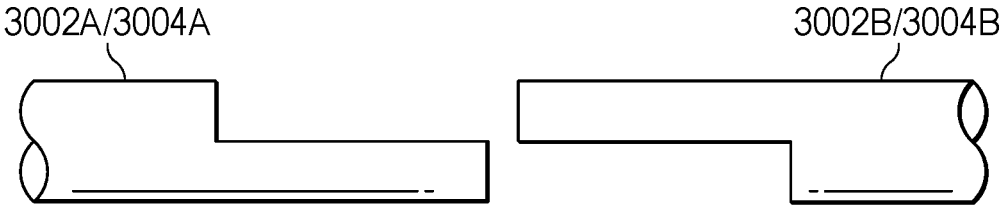
Figure 34:
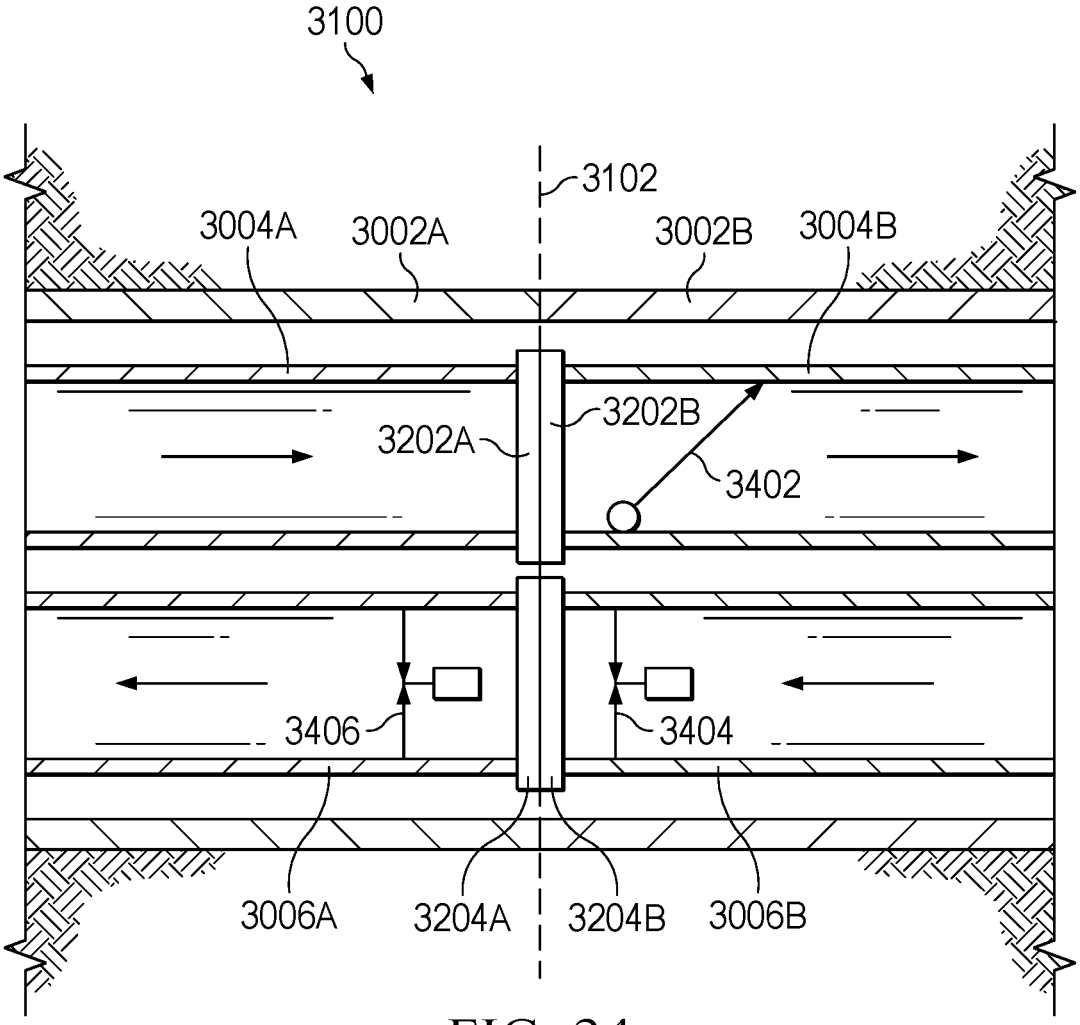

Referring to FIGS. 32-34, the umbilical sections 3000A and 3000B and/or the fluid conduits 3004 and 3006 may be coupled in many different ways using various coupling types (illustrated generally as 3202 and 3204 for fluid conduits 3004 and 3006, respectively), including the use of push-to-connect couplings, compression fittings, welds (electrical or chemical), friction welds, brazes, adhesives, nanomaterials, pins, threads, and/or other coupling mechanisms. Various compounds and/or components may be used as primary or secondary seals, including hardening gels, cements, o-rings, and/or other sealants.

In some embodiments, the two umbilical sections 3000A and 3000B and/or the fluid conduits 3004 and 3006 may include one or more alignment mechanisms to assist in lining up the two sections, such as a protrusion (e.g., a key) on one section that fits into a slot on the opposing section. In some embodiments, as illustrated in FIG. 33, rather than a vertically aligned face-to-face interface point 3102 as shown in FIG. 34, the outer tubes 3002A and 3002B and/or the fluid conduits 3004A and 3004B may be designed with an offset at the interface. Such an offset may be at a single point and serve as an alignment key or may entirely encircle the edge and serve as a male/female coupling between the two sections.

One potential issue in the umbilical 3100 may occur when the outer tube 3002, a fluid conduit, and/or another conduit is compromised. This may allow fluids, including high pressure and/or high temperature fluids, to enter the comprised conduit and migrate up the umbilical 3100 to the surface. In addition, if the conduit is not intended to internally handle high pressure and/or high temperature fluids, additional areas of the conduit may be compromised as the fluid moves through the conduit. Accordingly, it may be desirable to have safety measures in place that can eliminate or minimize the issues that may occur when a conduit is compromised, including the movement of fluids towards the surface.

Valves and/or other safety and control devices may be built into an umbilical section anywhere along the conduits and/or at one or both ends where an umbilical section is coupled to another section (e.g., at the interface point 3102) or to a manifold or other component. Valves may be built into only one umbilical section at an interface or may be provided on both sides of the interface for redundancy. Such valves and other devices may be entirely mechanical or may incorporate electrical sensors and/or other non-mechanical components, and may temporarily block flow, thereby releasing when the expected pressure or temperature differential is restored, or may permanently close the conduit once actuated.

For conduits that do not carry fluid or only carry fluid downstream, check valves and/or other safety devices may be used to prevent reverse flow. However, such check valves may be generally unusable for return flow conduits, such as the conduit 608 of FIGS. 6-9 or the conduit 1002 of FIG. 10, because the flow is expected to move towards the surface. For return flow conduits, threshold triggered flow valves and similar devices may be used to shut off upstream flow if a certain temperature, pressure, and/or other threshold is detected. For example, a temperature triggered piston valve may use a substance with a desired solid/fluid melting point to engage a piston to close the valve when the substance shifts from solid to fluid due to a temperature increase.

In some embodiments, such upstream sealing events may be triggered automatically and may be permanent. For example, if a pressure differential increases to a certain threshold, an auto-seal process may be initiated to prevent fluids from reaching the surface. Such a process may include chemical reactions, plugs, cements, and/or any other mechanism or combination thereof suitable for automatically sealing the conduit when the threshold event occurs.

In other embodiments, a ball drop or other process may be used to trigger a mechanical seal when it hits a certain stage. Such mechanisms may be multi-tiered to shut off different areas of the conduit. For example, a ball of a particular diameter may be dropped that falls past one or more shut off mechanisms that are higher in the pipe until it reaches the shut off mechanism that is small enough to catch it and therefore be actuated by the ball. In this manner, a particular ball may be used to close a particular shut off mechanism at a desired point based on diameter and/or weight, or a series of balls may be used to sequentially shut off a series of mechanisms. It is understood that balls need not be used, and many different approaches may be applied to selectively shut off fluid flow within a conduit.

Using the example of FIG. 34, assume that the fluid conduit 3004 is moving fluid downstream from fluid conduit 3004A to 3004B and the fluid conduit 3006 is moving fluid upstream from fluid conduit 3006B to 3006A. A check valve 3402 may be present in the fluid conduit 3004B to prevent fluid from entering the fluid conduit 3004A if a failure occurs along the fluid conduit 3004B. A temperature triggered piston valve 3404 may be present in the fluid conduit 3006B to prevent high temperature fluid from entering the fluid conduit 3006A if a failure occurs along the fluid conduit 3006B, and a redundant temperature triggered piston valve 3406 may be present in the fluid conduit 3006A. It is understood that the valves 3402, 3404, and 3406 may be any type of valve suitable for partially or completely closing their respective conduits.

Figure 35:
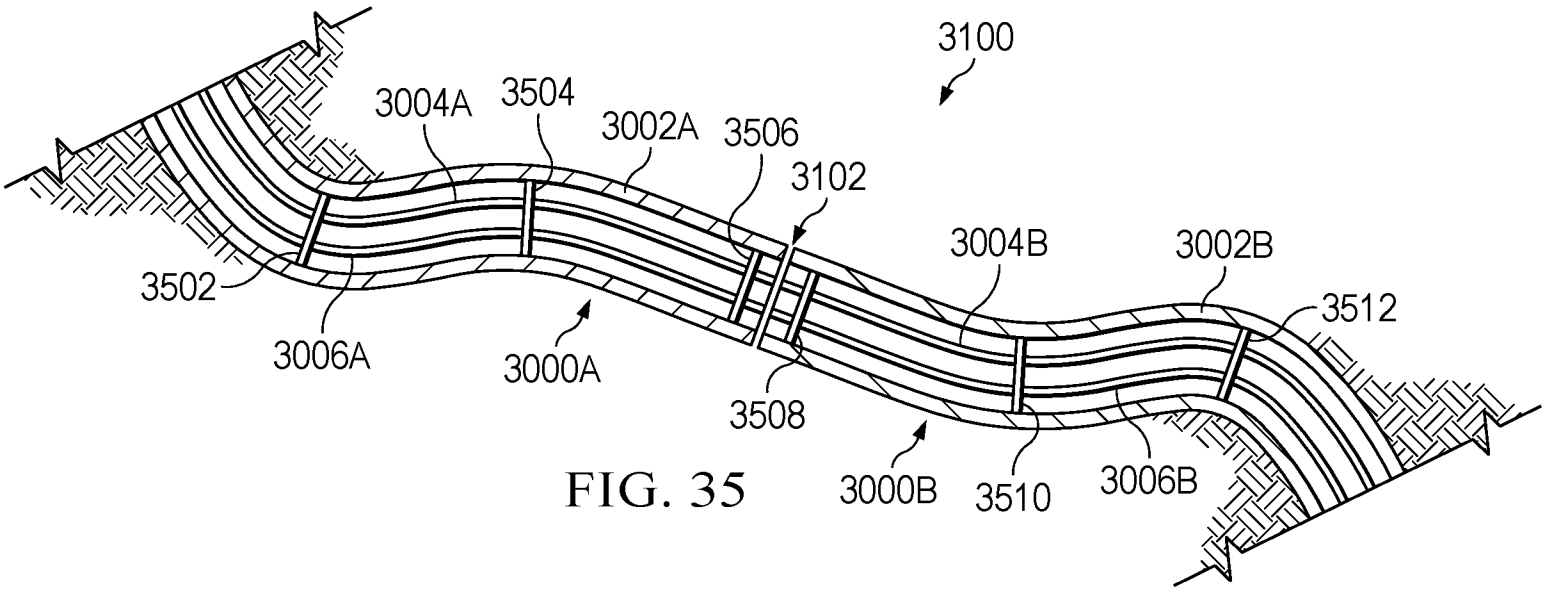

Referring to FIG. 35, one embodiment of the umbilical 3100 of FIG. 31 is illustrated with multiple valves 3502, 3504, 3506, 3508, 3510, and 3512. Although the valves 3502, 3504, 3506, 3508, 3510, and 3512 are built into the umbilical sections 3000A and 3000B, they may be viewed as valves for the entire umbilical 3100. For example, a failure in the outer tube 3002 may result in the entire umbilical 3100 being compromised, rather than only a single conduit. Accordingly, some valves may be used to close the entire outer tube 3002, either as a set of valves positioned within the conduits or as one or more valves that close the entire umbilical 3100 (which may require cutting of the umbilical and conduits).

The decision on whether to close a single conduit, multiple conduits, and/or the entire umbilical may depend on the design of the umbilical 3100, the condition of the outer tube 3002, and/or the conduit(s) affected. With respect to the design of the umbilical 3100 and the condition of the outer tube 3002, some designs may be more susceptible to complete failure than other designs. As described above with respect to FIGS. 13-29, the umbilical 3100 may be designed in many different ways. If the interior space of the outer tube 3002 is filled with a material through which the conduits are run (e.g., FIG. 23), then a breach in the wall of the outer tube may not compromise the entire umbilical 3100 because the filler material may minimize or eliminate movement of an encroaching fluid through the interior portion of the outer tube. However, if the interior space of the outer tube 3002 is relatively empty other than the conduits (e.g., FIG. 22) or is only loosely filled with material, then a breach in the wall of the outer tube may compromise the entire umbilical 3100 due to fluids entering the outer tube and moving along the interior.

In cases where undesired fluid is moving along the interior of the outer tube 3002, it may be possible to save upstream umbilical sections 3000 or an upper portion of the umbilical where the failure occurred. For example, assume undesired fluid has breached the umbilical section 3000B and is moving upstream towards umbilical section 3000A. It may be possible to pull the conduit that has been compromised or close the interface point 3102 on side of the umbilical section 3000A and/or 3000B. In such scenarios, the umbilical section 3000A may continue to operate. It is understood that this may not work in all embodiments, such as when there is a loop in the far end of one or more fluid conduits, such as is shown in FIGS. 6 and 9. Although a gap is shown between the two umbilical sections 3000A and 3000B in FIG. 35 at the interface point 3102, it is understood that the two umbilical sections are connected either directly or via another component (e.g., a manifold) in practice and the gap is simply to illustrate the two sections in the figure.

Figure 36A:
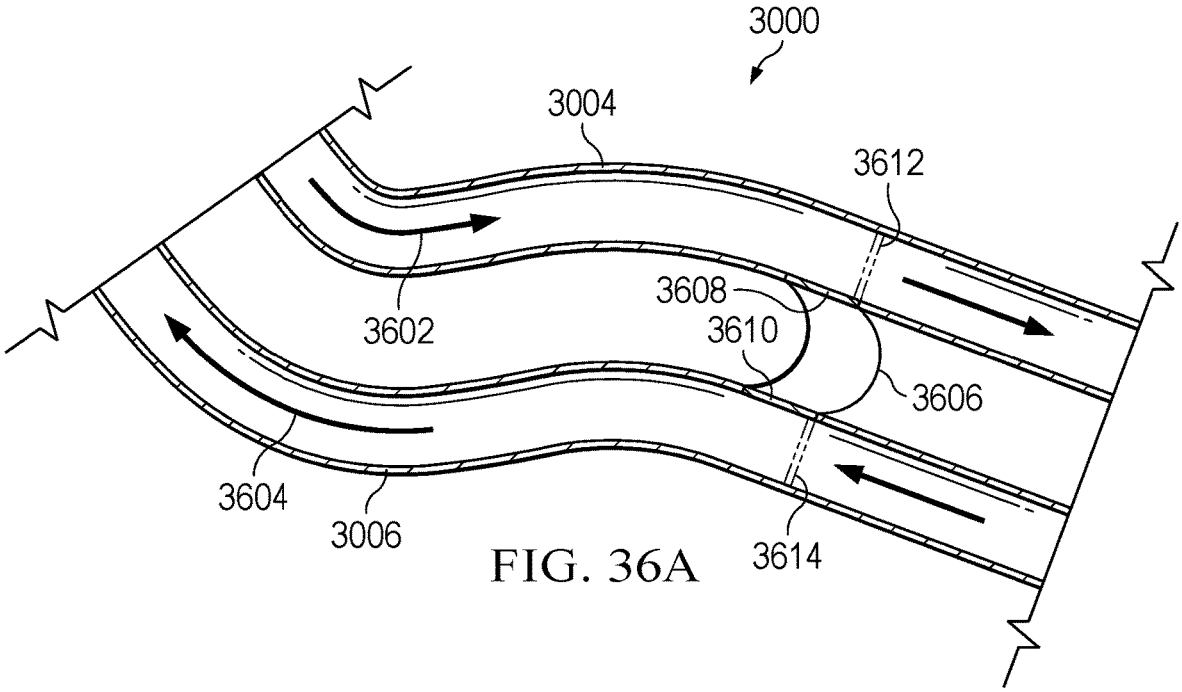
Figure 36B:
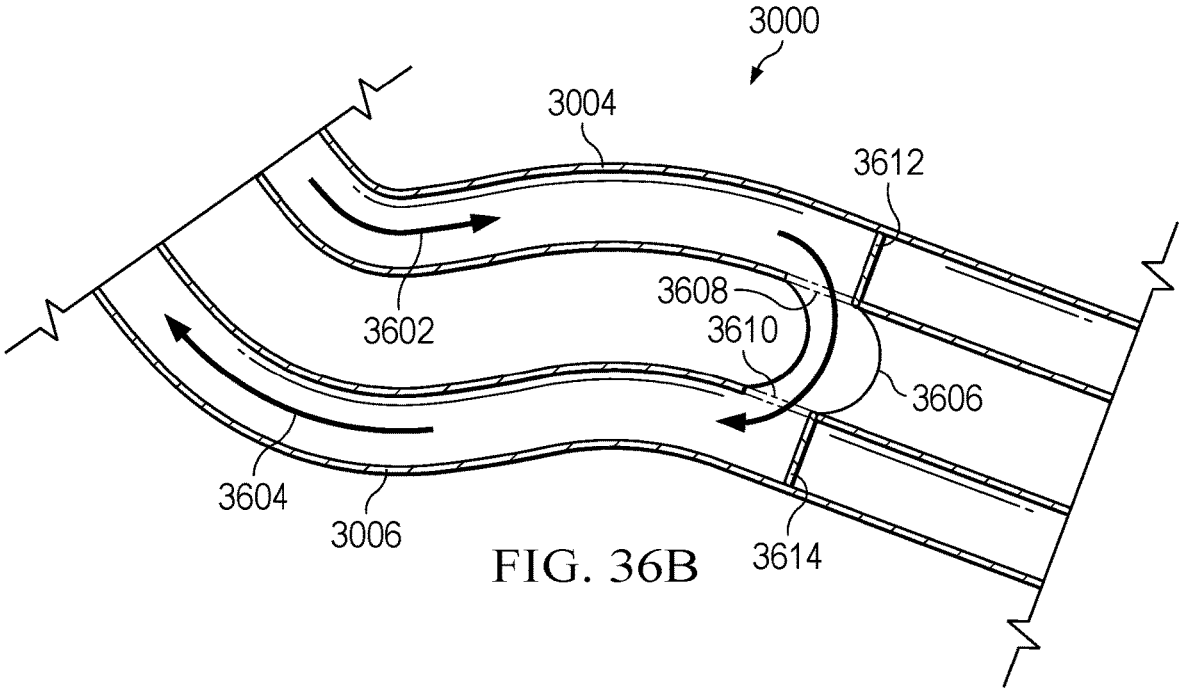

Referring to FIGS. 36A and 36B, one embodiment of an umbilical section 3000 is illustrated with only the fluid conduits 3004 and 3006. As described previously, recovery from a compromising event may be more complicated if part of a loop is compromised. In the present example, the fluid conduit 3004 carries fluid downstream as indicated by arrow 3602 and the fluid conduit 3006 carries fluid upstream as indicated by arrow 3604. A loop section (not shown) occurs further down the umbilical 3100 below the section 3000, meaning that the arrows 3602 and 3604 represent a single stream of fluid. The fluid conduits 3004 and 3006 are coupled by a channel 3606 that is above from the loop section.

Referring specifically to FIG. 36A, in the present example, the channel 3606 is blocked by a closed valve 3608 at the conduit 3004 and by a closed valve 3610 at the conduit 3006. Valves 3612 and 3614 may be positioned within the conduits 3004 and 3006, respectively, and located at or downstream of the channel 3606. The valves 3612 and 3614 are currently open to allow unimpeded flow of the fluid through their respective fluid conduits. This may be considered the normal operation of the conduits 3004 and 3006 when the umbilical section 3000 and the conduit sections downstream from the umbilical section are operating properly.

Referring specifically to FIG. 36B, if an event occurs that disrupts the loop further down the umbilical 3100 below the section 3000 or if there is a reason to shorten the loop (e.g., to shorten the thermal fluid flow as the combustion area moves towards the heel), the channel 3606 may be used. In such an event, the valves 3608 and 3610 may be opened and the valves 3612 and 3614 may be closed. This moves the loop area to the channel 3606 and bypasses the fluid conduit portions that are downstream of the channel 3606.

Figure 37A:
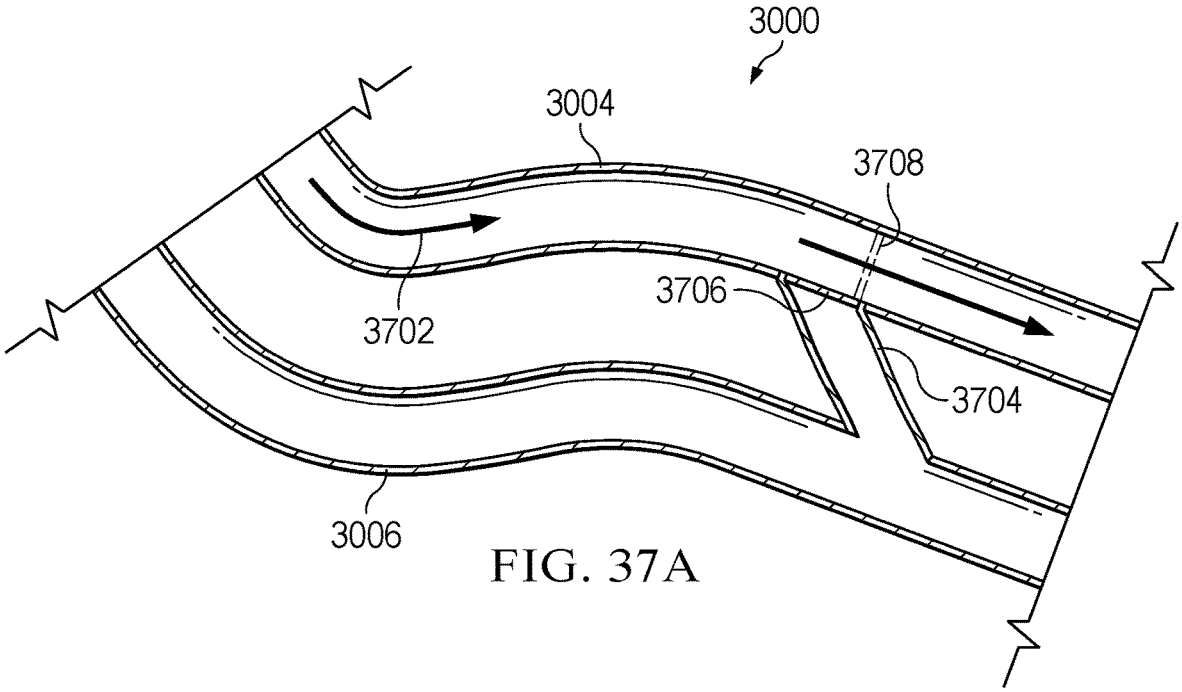
Figure 37B:
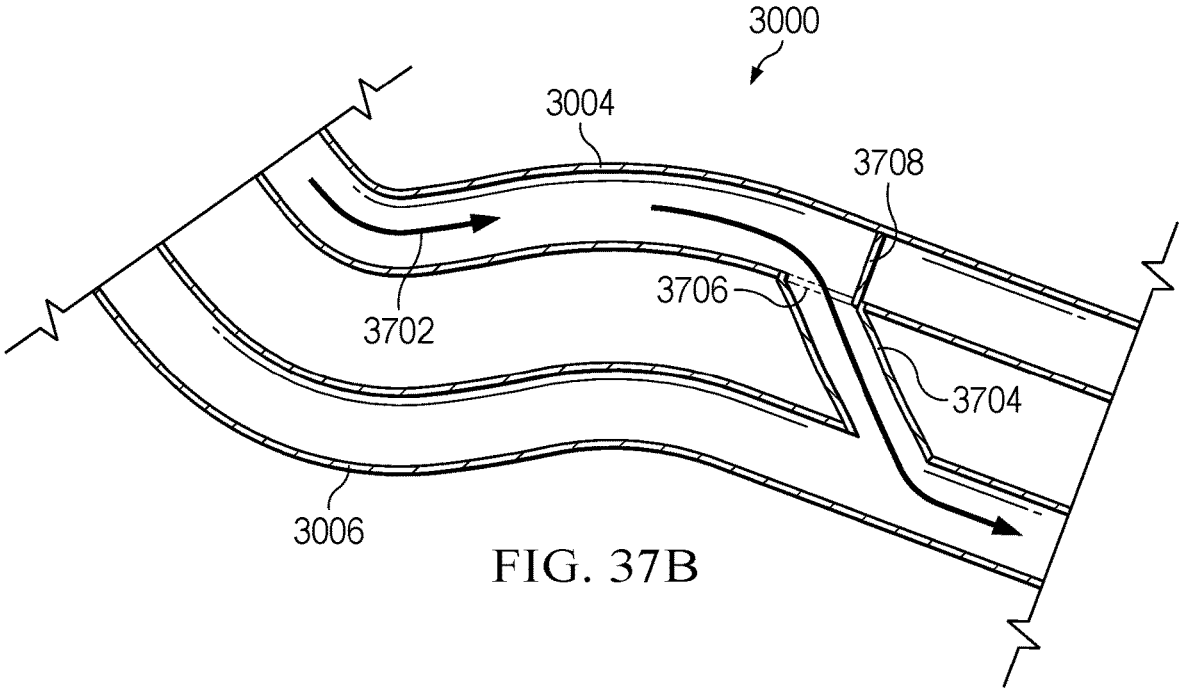

Referring to FIGS. 37A and 37B, one embodiment of an umbilical section 3000 is illustrated with only the fluid conduits 3004 and 3006. As described previously, recovery from a compromising event may be difficult if part of a fluid conduit is compromised. In the present example, the fluid conduits 3004 and 3006 are both configured to carry fluid downstream, with only the fluid conduit 3004 currently doing so as indicated by arrow 3702. In other embodiments, the fluid conduit 3006 may also be carrying fluid downstream. The fluid conduits 3004 and 3006 are coupled by a channel 3704.

Referring specifically to FIG. 37A, in the present example, the channel 3704 is blocked by a closed valve 3706 at the conduit 3004. A valve 3708 may be positioned within the conduit 3004 and located at or downstream from the channel 3706. The valve 3708 is currently open to allow unimpeded flow of the fluid through the conduit 3004. This may be considered the normal operation of the conduit 3004 when the umbilical section 3000 and the sections of the conduit 3004 that are downstream from the umbilical section are operating properly.

Referring specifically to FIG. 37B, if an event occurs that disrupts the fluid conduit 3004 further down the umbilical 3100 from the valve 3708, the channel 3704 may be used. In such an event, the valve 3706 may be opened and the valve 3708 may be closed. This uses the fluid conduit 3704 to bypass the damaged portion of the fluid conduit 3004 that is downstream of the channel 3704. In embodiments where both of the fluid conduits 3004 and 3006 are carrying fluid downstream, the flow rates may be controlled or modified to ensure that the fluid conduit 3006 can maintain a desired flow rate.

Referring generally to FIGS. 35-37B, it is understood that many different variations may be implemented. Conduit and channel dimensions and shapes may be used to control flow, valves may be located in various positions and may be of many different types, redundant conduits, channels, and valves may be provided, and many other modifications may be made to accomplish a particular purpose. Accordingly, FIGS. 35-37B are intended as examples only and the present disclosure is not limited to the conduit arrangements provided therein.

Accordingly, in some embodiments, one or more additional loops and/or alternate channels may be present for fluid conduits in the umbilical section 3000A, the umbilical section 3000B, and/or in a manifold or other component. Such additional loops and/or alternate channels may always be open or may remain closed and opened when needed. This enables redundant loops and/or alternate channels to be built into an umbilical section 3000, a manifold, and/or another component to enable continued operation of the geothermal energy extraction process even if a lower portion of an umbilical section 3000 or a portion of an entire umbilical 3100 fails.

With respect to affected conduits, the function of some conduits may have redundancy built into the umbilical 3100. For example, a series of conduits may be used to carry combustion fluid(s) downstream, and permanently sealing a single one of the conduits may not greatly impact the overall geothermal energy extraction process. However, if only one conduit is used for a needed function or if the combined capacity of multiple conduits is needed, then disabling a single conduit may severely impact the geothermal energy extraction process. For example, if only a single conduit carries heated fluid upstream and that conduit is compromised, the entire process may be compromised to the extent that further geothermal energy extraction is no longer feasible from that well or the umbilical 3100 may need to be replaced before continuing.

Accordingly, use of the remainder of the umbilical 3100 may be continued in some scenarios, the umbilical 3100 may be replaced, or the well may be abandoned. In cases where a decision is made to abandon the well due to failure of the umbilical 3100, the remaining umbilical may be withdrawn if possible or may be abandoned. If abandoned, the umbilical section 3100 may be cut at any point, including downstream of the valve(s) that closed in response to the compromising event. The outer tube 3002 and/or conduits above the closed valve(s) may be permanently sealed using mud, cement, and/or other materials.

Figure 38:
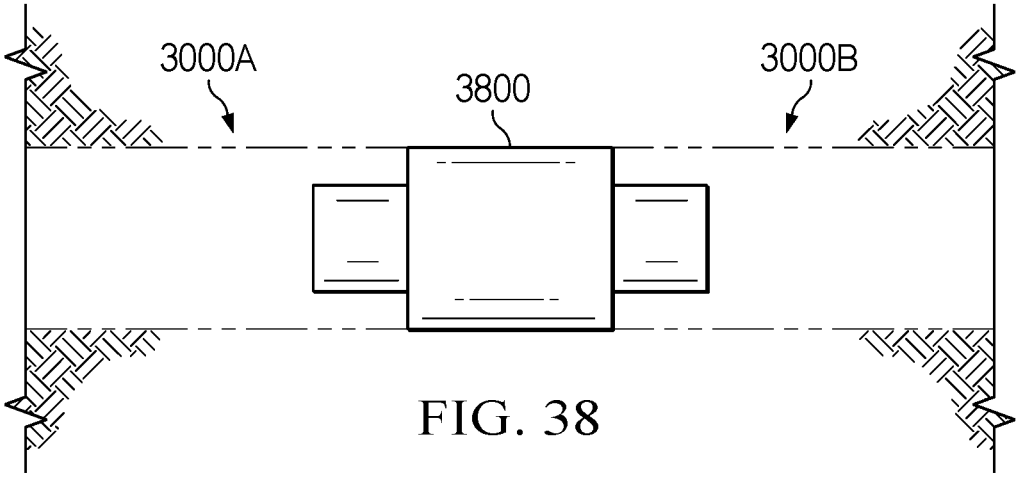
FIGS. 38-49B illustrate various embodiments of a manifold.
Figure 39:
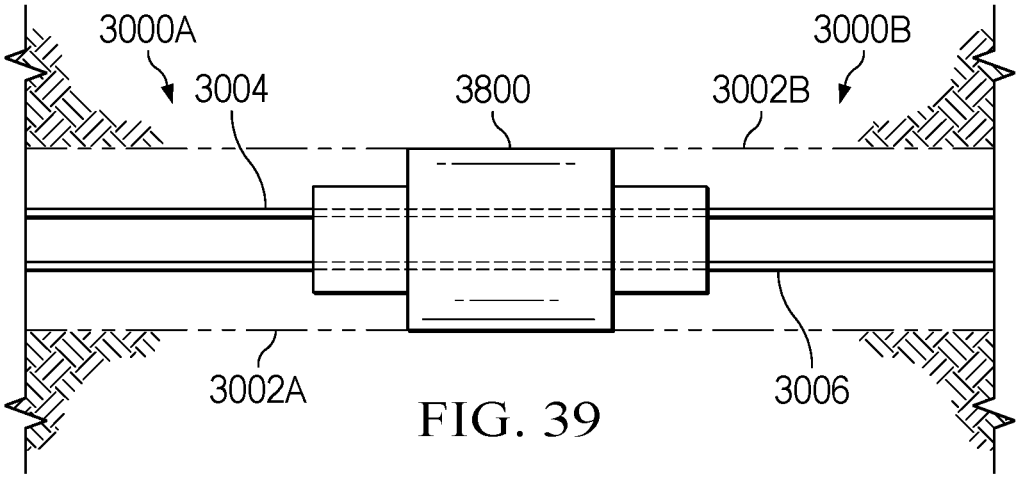

Referring to FIGS. 38 and 39, one embodiment of a manifold 3800 is illustrated. The manifold 3800 may be designed to connect umbilical sections, such as the umbilical sections 3000A and 3000B of FIG. 31. Channels in the manifold 3800 couple the fluid conduits 3004 and 3006 in the two connected umbilical sections. A channel may provide an intermediate passage through the manifold 3800 that connects to each of the fluid conduits or may provide a pass through passage that enables a fluid conduit to be pulled through the manifold to be coupled directly to the other fluid conduit. Electrical connections and/or other couplings may also be established via the manifold 3800, either using preinstalled connections and wires in the manifold 3800 or by providing channels through which wires and/or other components may be pulled or otherwise coupled.

Figure 40A:
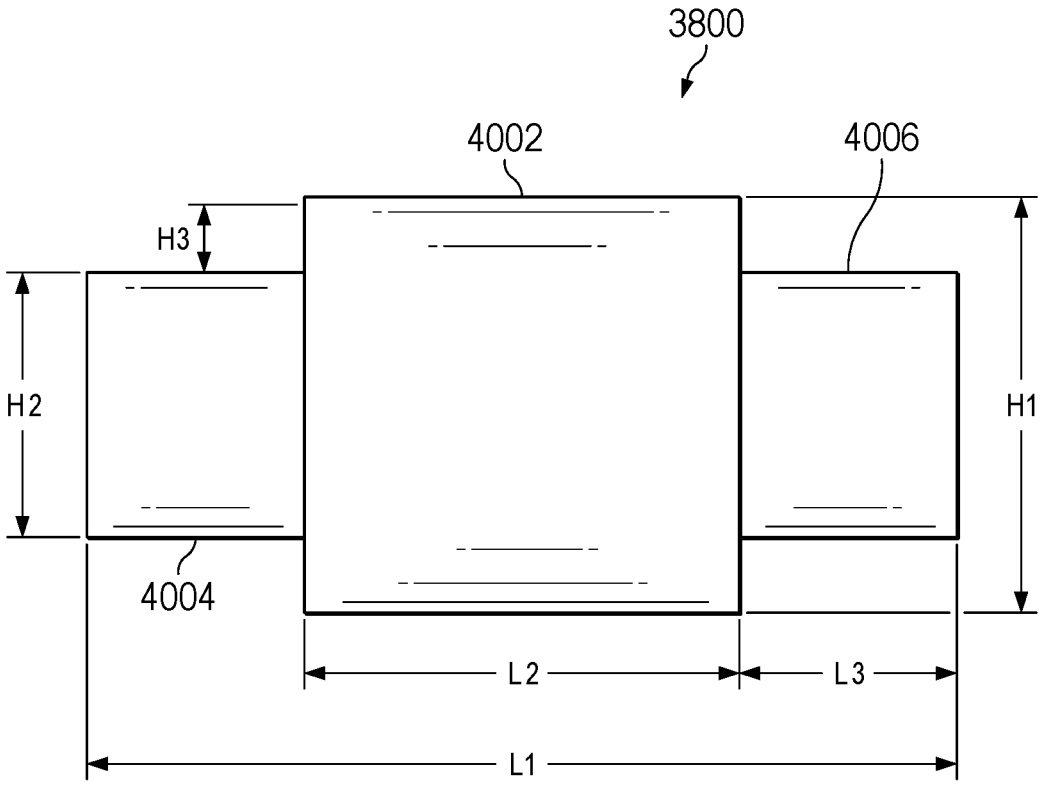
Figure 40B:
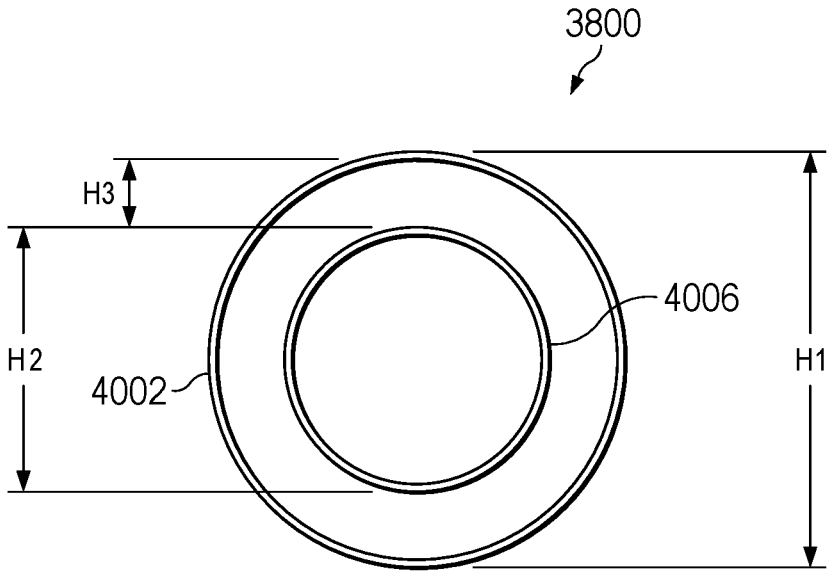

Referring to FIGS. 40A and 40B, one embodiment of the manifold 3800 is illustrated. In the present example, the manifold 3800 includes a central section 4002 that may be generally cylindrical in shape with a length L2 and a height H1. The central section 4002 is positioned between two end sections 4004 and 4006 that may be generally cylindrical in shape. The end sections each have a length L3 and a height H2. This arrangement leaves an open area of height H3 that is configured to receive the outer tube 3002 of an umbilical section 3000. The height H1 may be identical or similar to the outer diameter of the outer tube 3002 to provide a substantially uniform surface when the manifold 3800 is coupled to an umbilical section 3000. In other embodiments, the height H1 may be greater or smaller than the outer diameter of the outer tube 3002.

In the present embodiment, the two end sections 4004 and 4006 have equal dimensions, but in other embodiments they may have different heights and/or lengths. It is understood that some or all sections of the manifold 3800 need not be cylindrical, but may be designed in many different shapes. In general, it may be desirable to provide as much room as possible within the manifold 3800. For example, by minimizing the height H3 and maximizing the height H2, more space may be available for fluid conduits and other components in the end sections 4004 and 4006.

Accordingly, the dimensions of the manifold 3800 may vary based on factors such as the dimensions of the pipe 400 into which the manifold must fit, the dimensions of the outer tube 3002 that is to be coupled to the manifold, the space inside the manifold needed for fluid conduits and other components, and/or the amount of material needed in the walls of the manifold itself to provide a desired level of structural integrity.

Figure 41A:
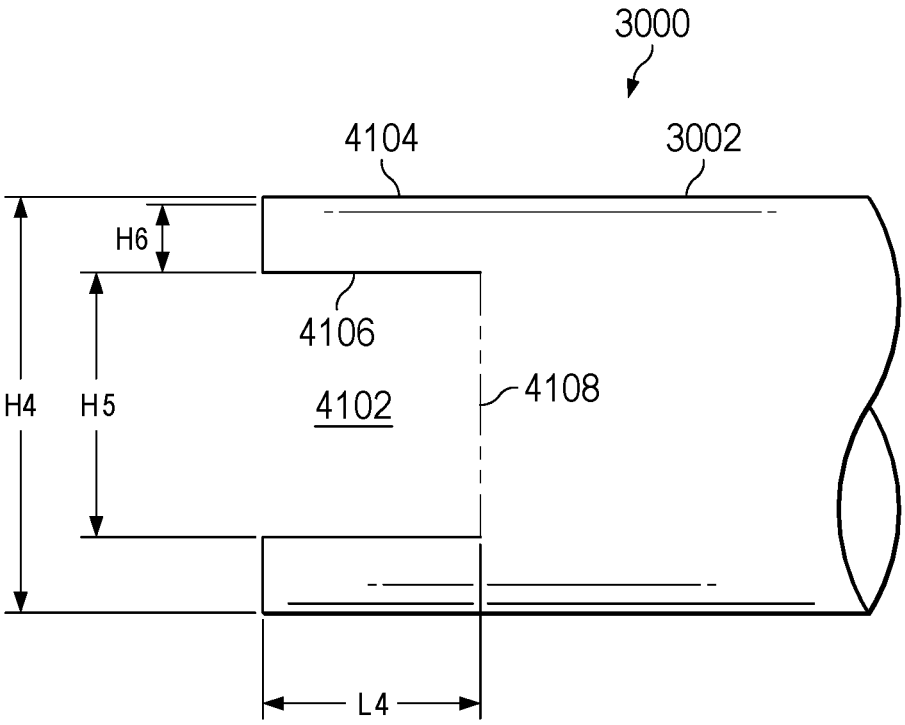
Figure 41B:
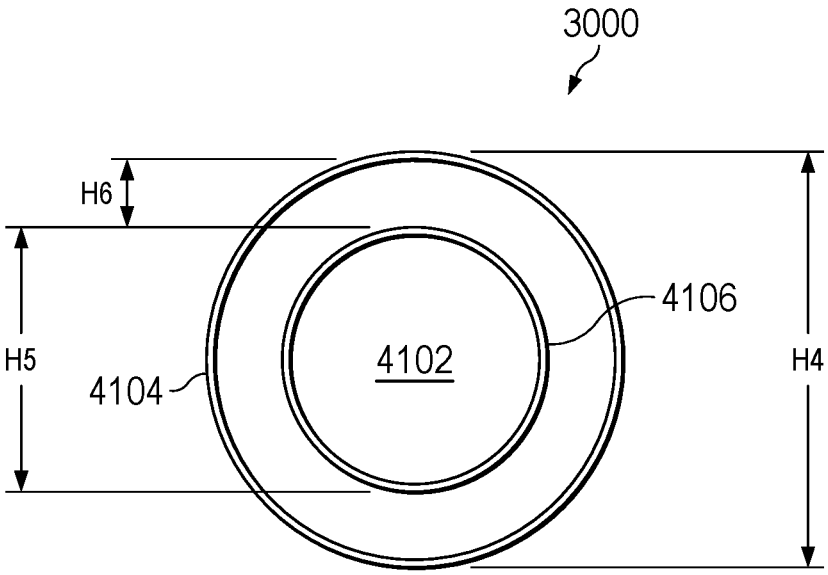

Referring to FIGS. 41A and 41B, one embodiment of the umbilical section 3000 is illustrated. In the present example, the umbilical section 3000 includes a cavity or other opening 4102 formed by the outer tube 3002. For example, the outer tube 3002 may be generally cylindrical in shape with a thickness H6 between an outer surface 4104 and an inner surface 4106. The inner cavity 4102, which provides space for fluid conduits and other components, may have a height of H5. The interior area of the cavity 4102 may be open or may present a surface 4108 that provides, for example, an interface used to couple conduits (not shown) within the umbilical section 3000 to the channels of the manifold 3800.

It is understood that some or all sections of the umbilical section 3000 need not be cylindrical, but may be designed in many different shapes. In general, it may be desirable to provide as much room as possible within the umbilical section 3000. For example, by minimizing the height H6 and maximizing the height H5, more space may be available for fluid conduits and other components. Accordingly, the dimensions of the umbilical section 3000 may vary based on factors such as the dimensions of the pipe 400 into which the umbilical section must fit, the dimensions of the manifold 3800 or other components that may be coupled to the umbilical section, the space inside the umbilical section needed for fluid conduits and other components, and/or the amount of material needed in the walls of the umbilical section itself to provide a desired level of structural integrity.

For purposes of example and with general reference to FIGS. 40A-41B, height H3 may be identical or substantially similar to height H6. This may provide a substantially continuous cylindrical surface when the manifold 3800 is used to couple two umbilical sections 3000. The height H5 may be slightly larger than the height H2 in order for the cavity 4102 to receive a manifold end section 4004/4006. If changes are made to the shape and/or dimensions of a particular section of the umbilical section 3000 or manifold 3800, corresponding changes may be made to the opposing manifold or umbilical section, respectively.

In some embodiments, the profiles of the umbilical section 3000 and manifold 3800 may be reversed, with FIGS. 40A and 40B representing the umbilical section 3000 and FIGS. 41A and 41B representing the manifold 3800. In still other embodiments, the umbilical section 3000 and/or the manifold 3800 may have different end sections. For example, the manifold 3800 may have one end section with the profile of the end section 4006 of FIG. 40A and another end section with the profile of FIG. 41A. Accordingly, it is understood that many different variations of manifolds and umbilical sections may be used.

Figure 42:
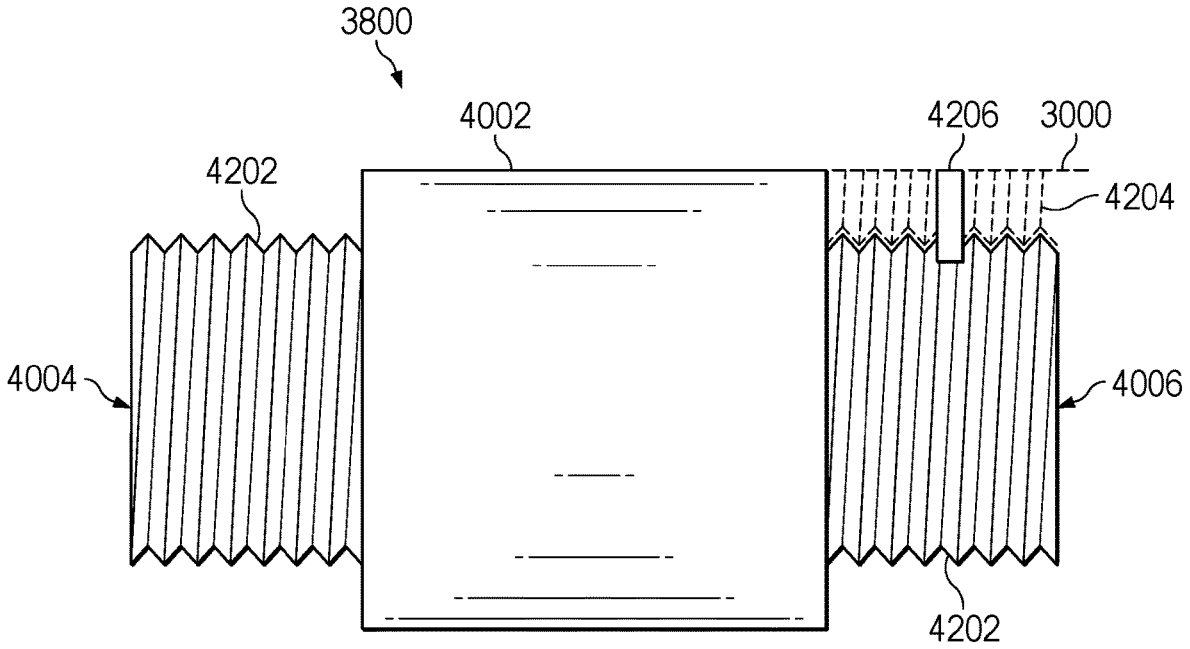

Referring to FIG. 42, one embodiment of the manifold 3800 is illustrated with threads 4202 on the external surfaces of the end sections 4004 and 4006. The threads 4202 may be configured to mate with threads 4204 on the internal surface 4106 (FIG. 41A) of the umbilical section 3000. Such threads enable the manifold 3800 to be rotatably coupled to the umbilical section 3000. Although shown as extending the length of the end sections 4004 and 4006, it is understood that the threads may only cover part of the surface. Additionally, or alternatively, one or more pins or other fasteners 4206 may be used to retain the manifold 3800 within the umbilical section 3000. For example, the manifold 3800 may be threadably engaged to the umbilical section 3000, and the pin 4206 may then be placed to prevent the coupled sections from unscrewing.

Figure 43:
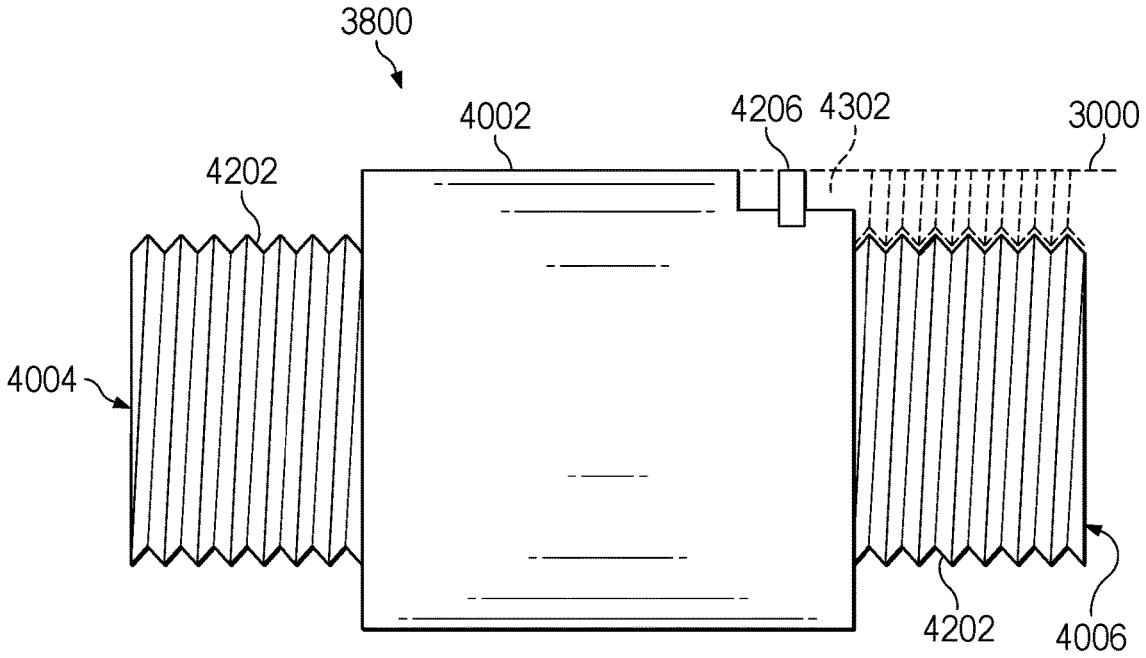

Referring to FIG. 43, another embodiment of the manifold 3800 is illustrated with a lip or protrusion 4302 of the umbilical section 3000 that extends past the threads 4204. In the present example, the lip 4302 slides over a groove on the exterior surface of the manifold 3800. The pin or other fastener 4206 may be inserted through the lip 4302 and into the manifold 3800 while avoiding the threads 4202 and 4204. In still other embodiments (not shown), only the pin and/or other fasteners may be used.

Figure 44:
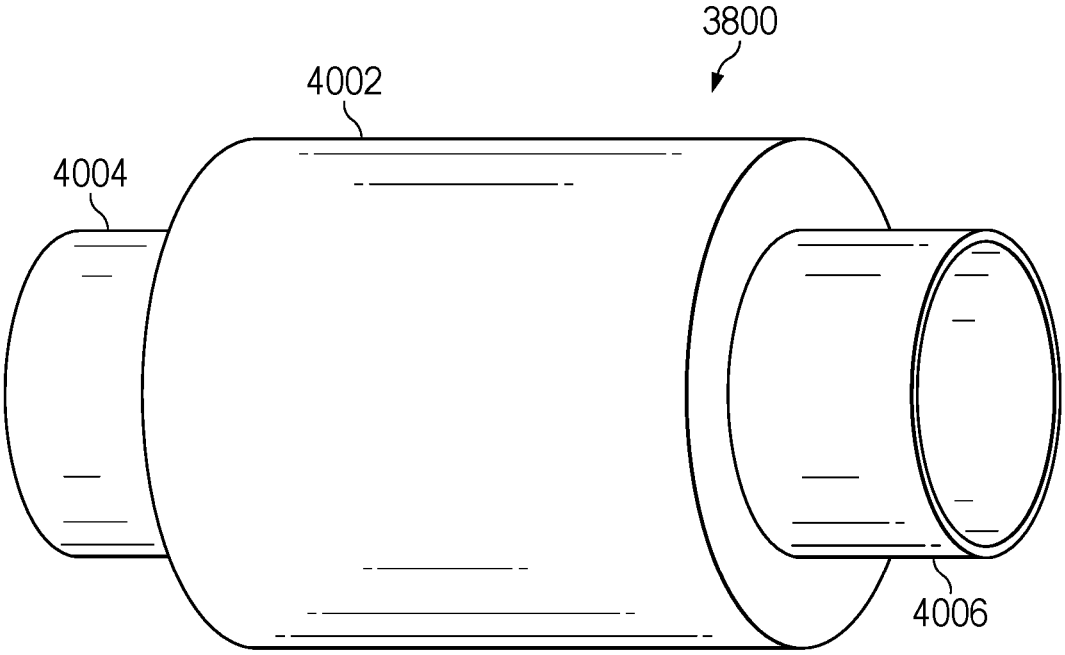
Figure 45:
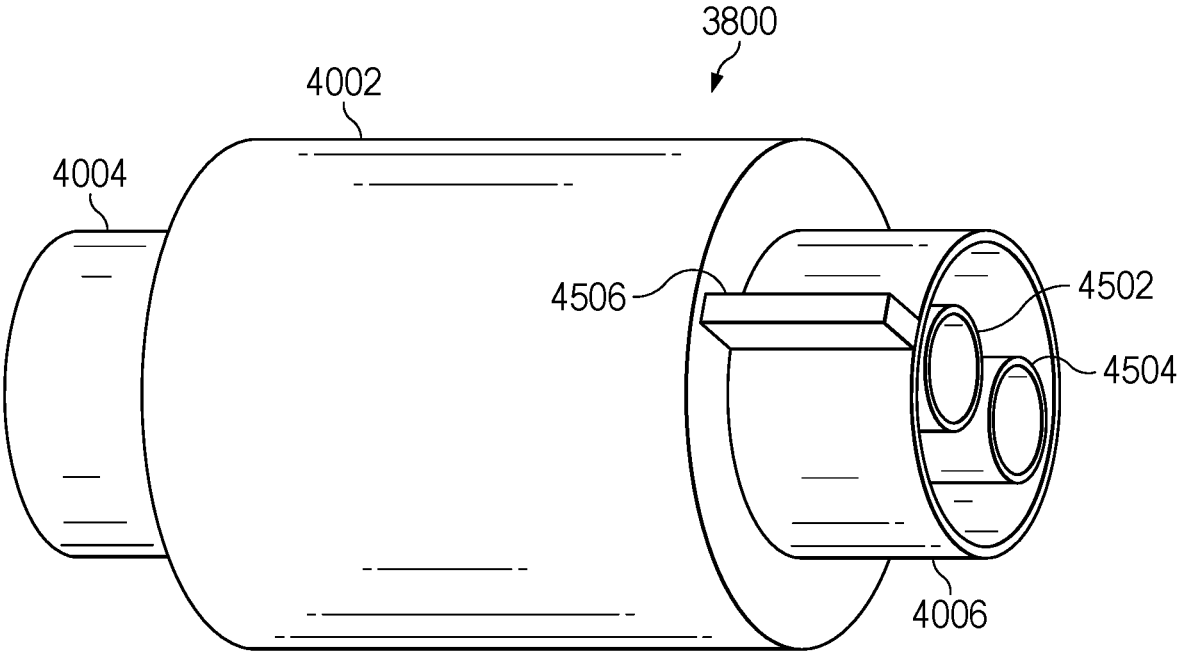
Figure 46:
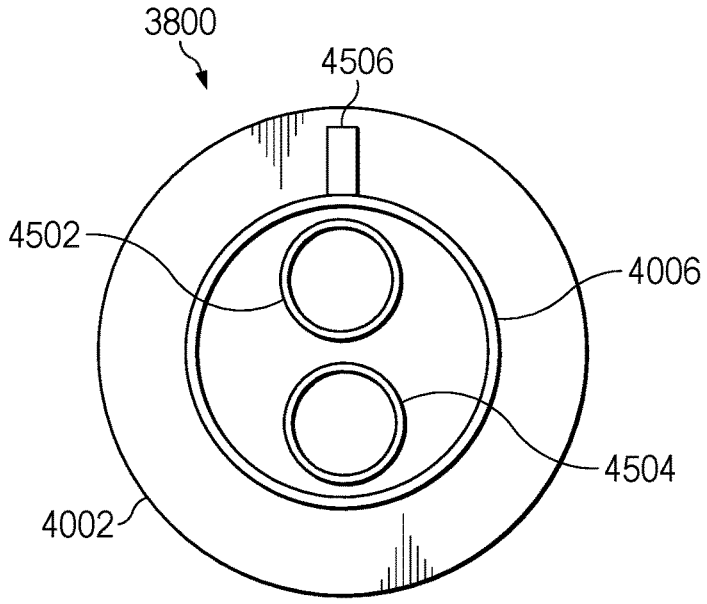

Referring to FIGS. 44-46, embodiments of the manifold 3800 are illustrated. In FIG. 44, the manifold 3800 is shown with relatively cylindrical end sections 4004 and 4006 coupled to the center section 4002. In FIGS. 45 and 46, the manifold 3800 of FIG. 44 is shown with channel openings 4502 and 4504 that may connect, for example, to fluid conduits 3004 and 3006 of an umbilical section 3000. A protrusion 4506 may serve as a key to align the manifold 3800 and its channel openings 4502 and 4504 with the fluid conduits 3004 and 3006 of the umbilical section 3000. In an alternative embodiment, FIG. 46 may represent the end of an umbilical section 3000, with the reference number 4506 representing a slot configured to receive the key, and reference numbers 4502 and 4504 representing the fluid channels 3004 and 3006.

Figure 47:
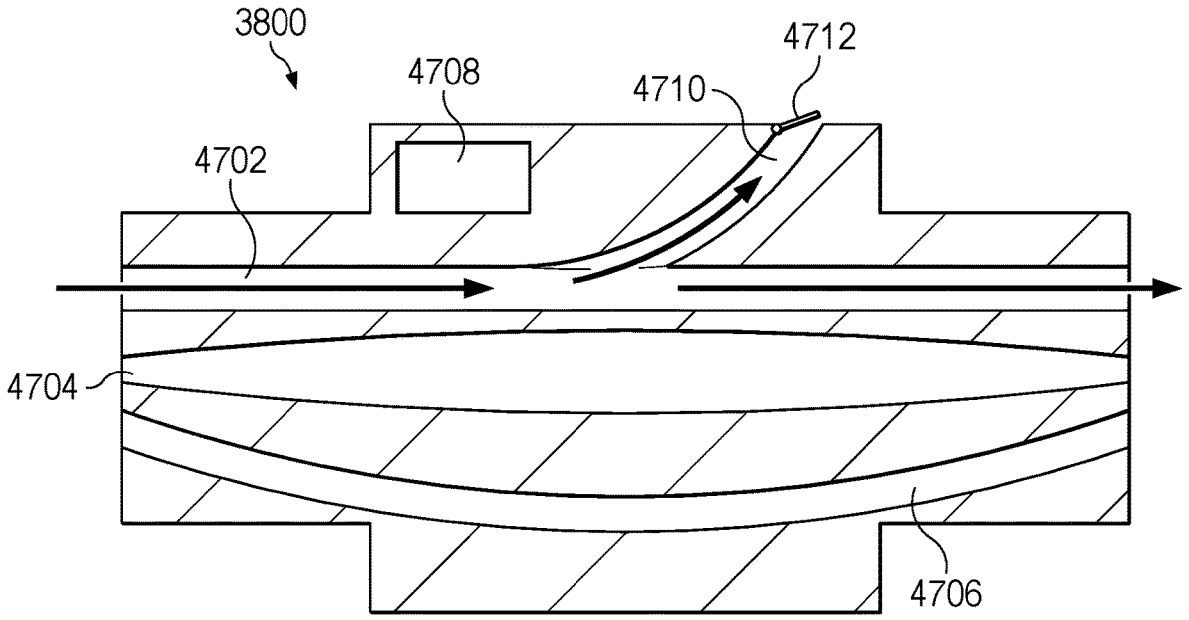

Referring to FIG. 47, one embodiment of the manifold 3800 is illustrated with internal channels 4702, 4704, and 4706. It is understood that more or fewer channels may be present in the manifold 3800 and the channels may have many different shapes and be arranged in many different ways. In addition, one or more chambers 4708 may be present in the manifold. Such chambers 4708 may contain sensors, actuators, valves, and/or other components and may be coupled to the surface and/or other downhole components via wires, pressurized channels, and/or other means.

Sensors may be used to measure the external environment as well as internal components. For example, sensors may be used to monitor differential pressures across channels to detect drag and other factors. These measurements may then be applied to regulate air flow in order to control the combustion area around the manifold. The manifold 3800 may include components such as a digital air flow controller that may be used in conjunction with valve control to prioritize areas that need more air. It is understood that the particular components in one manifold 3800 may be different from those of another manifold or two manifolds may be configured identically. Accordingly, a manifold may be designed for a particular purpose or for deployment at different locations along the umbilical, or may be designed for a more general purpose use.

In some embodiments, one or more of the channels, such as the channel 4702, may be coupled to the surface of the manifold 3800 via one or more side channels 4710. This enables fluid from the channel 4702 to be released from the exterior surface of the manifold via one or more valves 4712. For example, it may be desirable to release oxygen and/or other combustion fluids from the location of the manifold 3800 within the borehole. The side channel 4710 provides an external opening in the continuous umbilical 3100 without compromising the structural integrity of the umbilical sections 3000. In other embodiments, the channel 4710 may be open to the exterior without a valve or other mechanism to control the release of fluid from the channel.

Such openings may be positioned around the manifold 3800 to ensure that the fluid(s) make their way to the formation regardless of the orientation of the manifold 3800 within the pipe 400. For example, if the manifold 3800 is laying on the bottom of the pipe 400, a portion of the manifold 3800 may be blocked. By providing multiple openings, it is more likely that the fluid(s) will be able to reach the formation. In addition, multiple openings may provide a more even dispersal of the fluid(s).

In some embodiments, the manifold 3800 may be installed with the side channel 4710 sealed shut. For example, if the manifold 3800 is to be positioned at a location where no combustion fluid is desired, the valve 4712 may be disabled while in a closed position or the side channel 4710 may be otherwise plugged. In other embodiments, the valve 4712 may be controlled and may be closed while downhole. Due to factors such as the potentially significant pressure variations between the side channel 4710 and the formation, the valve 4712 may be designed to permanently lock in a closed position once closed. In some embodiments, the valve 4712 may be designed to close when the external pressure (e.g., the formation pressure) is greater than the pressure within the channel 4710, and open when the external pressure is less than the pressure within the channel.

Figure 48A:
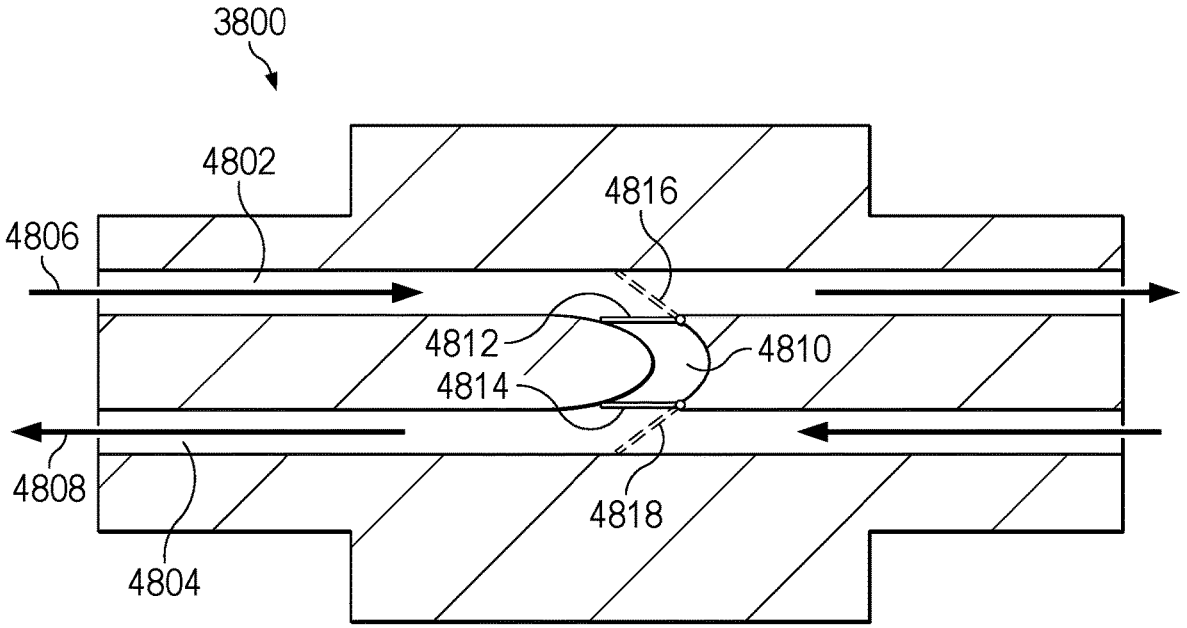
Figure 48B:
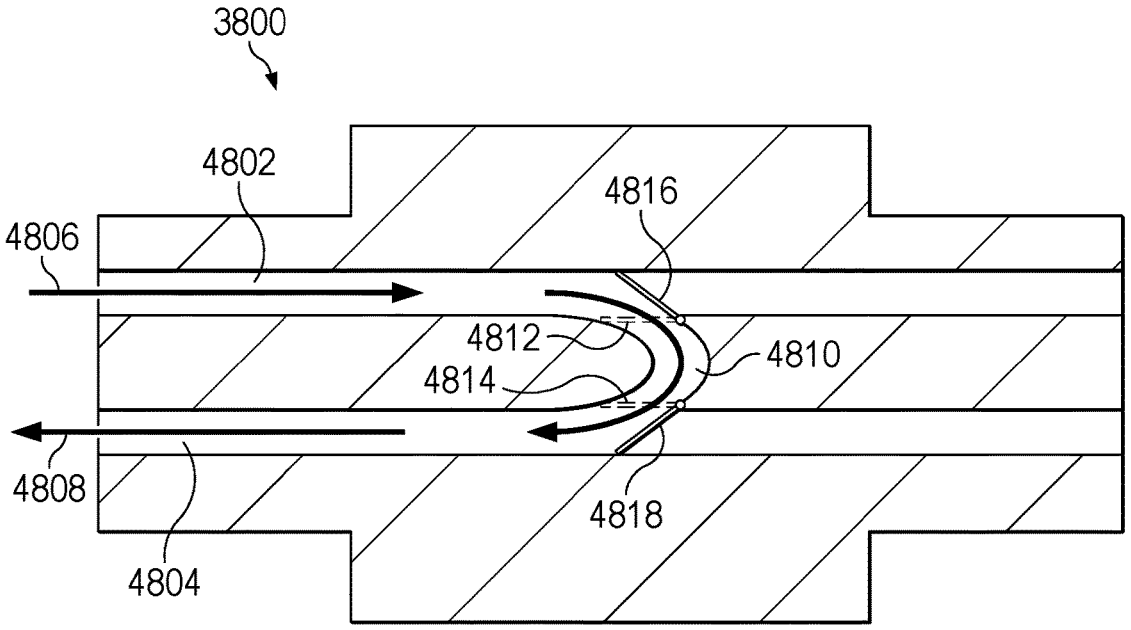

Referring to FIGS. 48A and 48B, one embodiment of the manifold 3800 is illustrated with fluid channels 4802 and 4804. As described previously with respect to FIGS. 35, 36A, and 36B, recovery from a compromising event may be difficult if part of a loop is compromised. In the present example, the fluid channel 4802 carries fluid downstream as indicated by arrow 4806 and the fluid channel 4804 carries fluid upstream as indicated by arrow 4808. A loop section (not shown) occurs further down the umbilical 3100 below the manifold 3800, meaning that the arrows 4806 and 4808 represent a single stream of fluid. The fluid channels 4802 and 4804 are coupled by a channel 4810.

Referring specifically to FIG. 48A, in the present example, the channel 4810 is blocked by a closed valve 4812 at the channel 4802 and by a closed valve 4814 at the channel 4804. Valves 4816 and 4818 may be positioned within the channels 4802 and 4804, respectively, and located at or downstream of the channel 4810. The valves 4816 and 4818 are currently open to allow unimpeded flow of the fluid through their respective fluid channels. This may be considered the normal operation of the channels 4802 and 4804 when the umbilical 3100 is operating properly downstream from the manifold 3800.

Referring specifically to FIG. 48B, if an event occurs that disrupts the loop further down the umbilical 3100 below the manifold 3800 or if there is a reason to shorten the loop (e.g., to shorten the thermal fluid flow as the combustion area moves towards the heel), the channel 4810 may be used. In such an event, the valves 4812 and 4814 may be opened and the valves 4816 and 4818 may be closed. This moves the loop area to the channel 4810 and bypasses the fluid conduits that are downstream of the channel 4810.

Figure 49A:
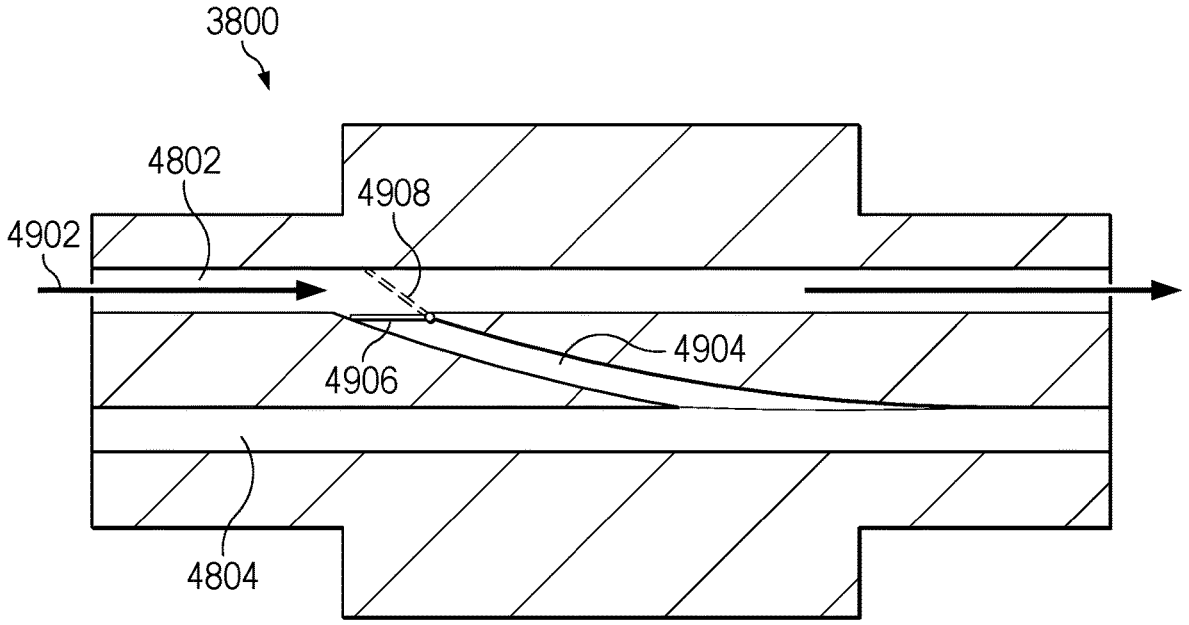
Figure 49B:
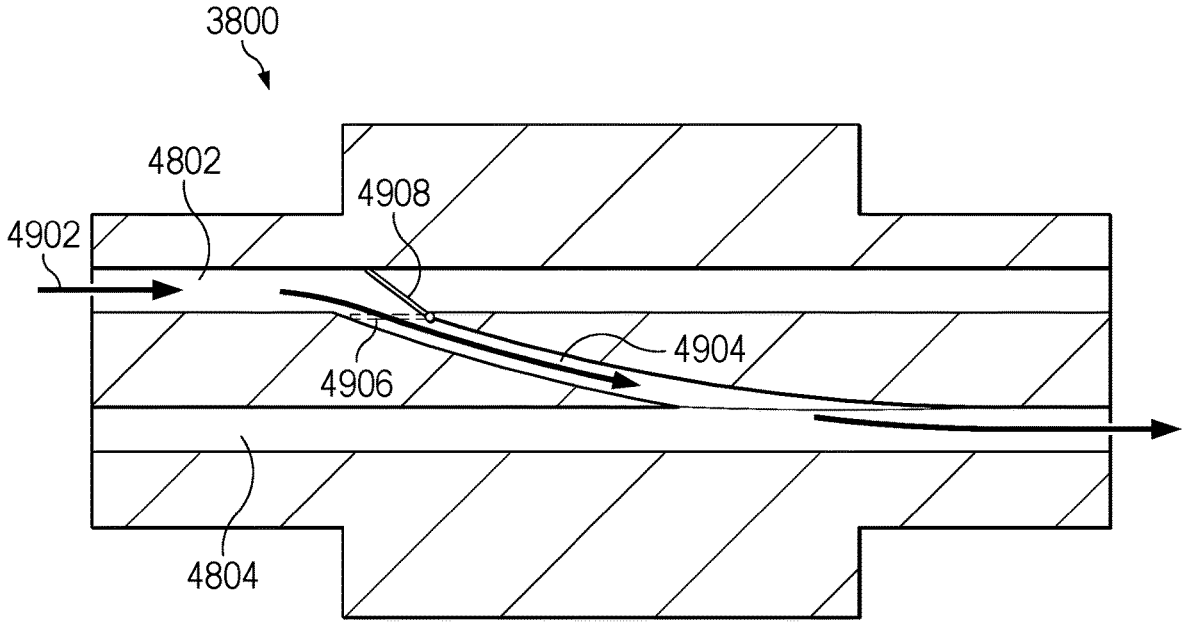

Referring to FIGS. 49A and 49B, one embodiment of the manifold 3800 is illustrated with fluid channels 4802 and 4804. As described previously, recovery from a compromising event may be difficult if part of a fluid conduit is compromised. In the present example, the channels 4802 and 4804 are both configured to carry fluid downstream, with only the fluid channel 4802 currently doing so as indicated by arrow 4902. In other embodiments, the fluid channel 4804 may also be carrying fluid downstream. The fluid channels 4802 and 4804 are coupled by a channel 4904.

Referring specifically to FIG. 49A, in the present example, the channel 4904 is blocked by a closed valve 4906 at the channel 4802. A valve 4908 may be positioned within the channel 4802 and located at or downstream of the channel 4804. The valve 4908 is currently open to allow unimpeded flow of the fluid through the channel. This may be considered the normal operation of the channels 4802 and 4804 when the umbilical 3100 is operating properly downstream from the manifold 3800.

Referring specifically to FIG. 49B, if an event occurs that disrupts the fluid conduit coupled to the channel 4802 further down the umbilical 3100 from the manifold 3800, the channel 4804 may be used. In such an event, the valve 4906 may be opened and the valve 4908 may be closed. This uses the channel 4804 to bypass the damaged portion of the fluid conduit that is downstream of the channel 4802. In embodiments where both of the fluid channels 4802 and 4804 are carrying fluid downstream, the flow rates may be controlled or modified to ensure that the fluid channel 4804 can maintain a desired flow rate.

Referring generally to FIGS. 47-49B, it is understood that many different variations may be implemented. Channel dimensions and shapes may be used to control flow, valves may be located in various positions and may be of many different types, redundant channels and valves may be provided, and many other modifications may be made to accomplish a particular purpose. Accordingly, FIGS. 47-49B are intended as examples only and the present disclosure is not limited to the manifold arrangements provided therein.

Referring generally to FIGS. 47-49B, it may be desirable to control various combustion parameters, such as the location and timing of releasing combustion fluids into the formation. Such control may be accomplished in various ways, including using multiple lengths of conduit within the umbilical 3100, using indexers along a fluid conduit, and/or using time delay/pressure. With respect to using multiple lengths of conduit or offset perforations in conduits (as illustrated previously in FIGS. 26-29), combustion fluid(s) may be selectively injected into the appropriate fluid conduits as needed to control the delivery of combustion fluids. However, such solutions may complicate the umbilical design due to the need for multiple fluid conduits in the potentially limited space inside the umbilical. If enough space is available, such solutions may be used.

With respect to indexers, the ability to open and close openings (e.g., the side channel 4710 of FIG. 47) may provide the desired level of control. Such indexers may respond to pressure to open and close in a defined manner, enabling the configuration of multiple sizes of opening or simply an open/close setting. In embodiments where such indexers are solely mechanical and respond to changes in fluid pressure and/or other environmental conditions, the need for additional control wiring may be omitted. Such indexers may be single or multi-stage indexers and may index in different ways, including linearly and/or radially. Indexers may control valves based on pressure variance, flow variance, electronic signals, and/or other indicators.

With respect to time delay/pressure, modification of the pressure within the fluid conduit may be used to open and/or close valves. For example, increasing the pressure inside the fluid conduit or pulsing the pressure may cause a valve to open due to a pressure differential between the conduit's internal pressure and the formation's external pressure. Pressure detection may be built into the valve itself or may be provided via one or more sensors.

Figure 50:
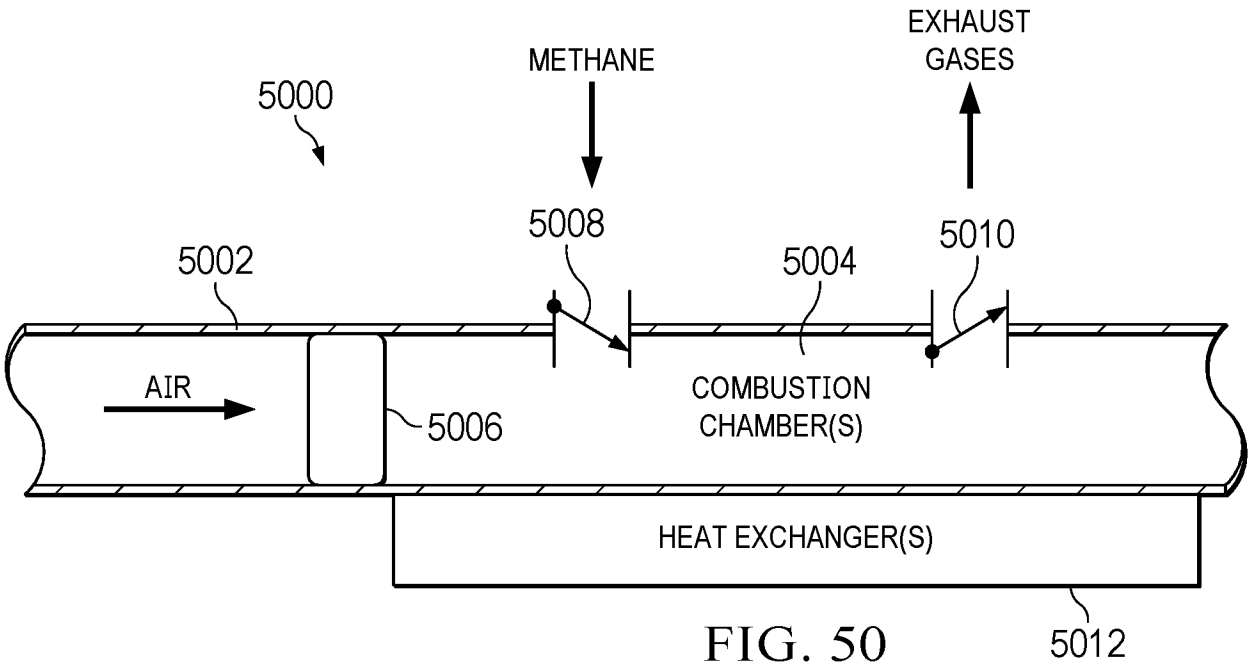
FIG. 50 illustrates one embodiment of a downhole engine.

Referring to FIG. 50, one embodiment of a downhole engine 5000 is illustrated. The engine 5000 in the present example is a three-cycle engine that may be provided in a pipe, tube, conduit, or other casing 5002. The pipe 5002 includes one or more combustion chambers 5004 that are fed via valve(s) 5006 for air injection and valve(s) 5008 (e.g., a check valve) that allows a fluid (e.g., a gas such as methane or any other flammable fluid(s)) into the combustion chamber from the formation. The air and flammable fluid(s) create a combustible fuel air mixture in the combustion chamber 5004. An ignition mechanism (not shown) may be used to ignite the fuel air mixture, although some embodiments may not use or include an ignition mechanism.

During and/or following combustion, one or more exhaust valve(s) 5010 (e.g., a check valve) vent carbon dioxide and/or other exhaust gases back into the formation. This pressurizes the formation, which in turn forces more flammable fluid(s) out of the formation and into the combustion chamber 5004. Heat may be removed from the combustion chamber 5004 by a heat exchanger 5012 and further removed via fluid conduits (not shown) as described in other embodiments herein. The engine 5000 enables the use of controlled pressures to create heat in the closed combustion chamber 5004 near the heat exchanger 5012. Lower injection pressures may be used for the air because the injection process may not need to overcome the pressure present in the formation. The combustion process may be regulated by controlling the amount of air injected into the combustion chamber 5004 and/or by controlling ignition.

Figure 52:
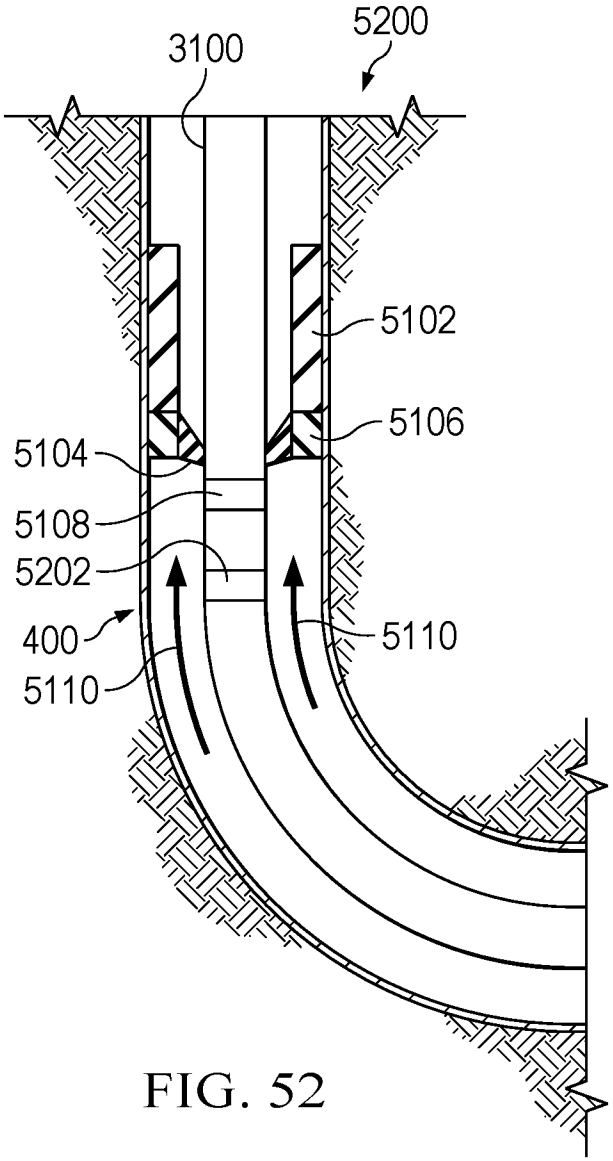
FIGS. 51 and 52 illustrate embodiments of a casing patch used to anchor an umbilical within a borehole.
Figure 51:
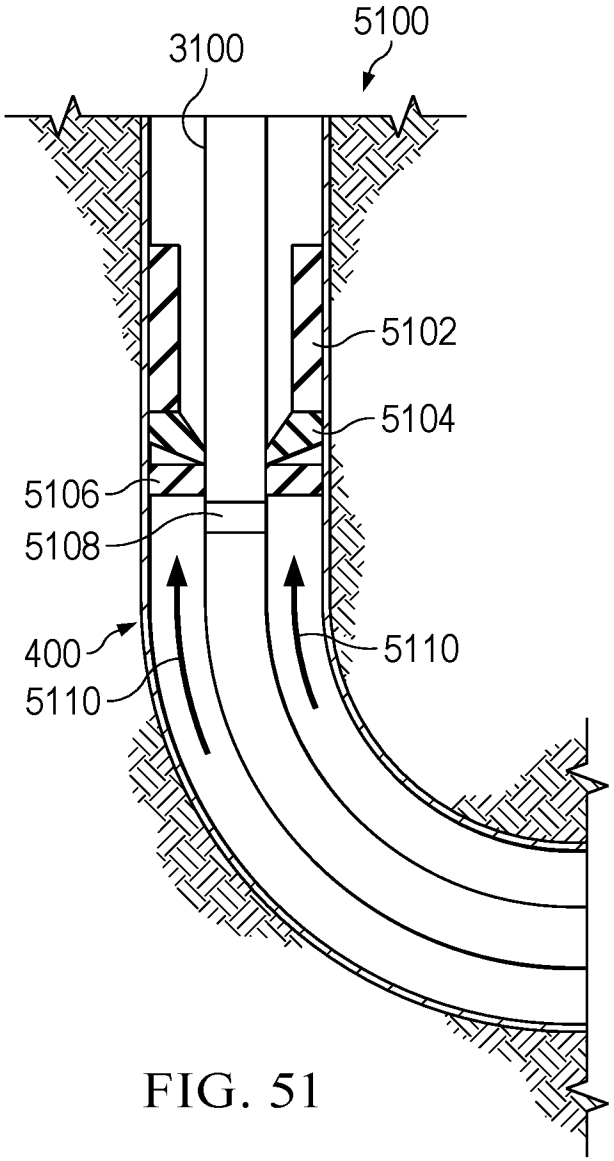

Referring to FIGS. 51 and 52, embodiments of environments 5100 and 5200, respectively, illustrate the umbilical 3100 (FIGS. 31 and 35) positioned downhole within a pipe 400. Because the pipe 400 may be older pipe and may have some or significant degradation, preparation may be performed prior to insertion of the umbilical 3100. For example, the pipe 400 may have scaling, buckling, degraded casing, and/or other issues that may interfere with the insertion of the umbilical 3100 and/or operation of the active geothermal energy extraction process (e.g., due to pressure concerns, compromise of the umbilical 3100 after insertion, and/or other issues). It is understood that, in some embodiments, preparation may be performed even if the pipe is relatively new.

Accordingly, in order to maintain operational and/or safety parameters, certain steps may be taken to prepare the wellbore for active geothermal energy extraction. Such preparation steps may include cleanout operations (e.g., flushing out kill fluid that was used to kill the well), descaling operations, and/or the reformation of collapsed or otherwise restricted sections of the pipe 400. The installation of casing patches may also be performed as needed to support the structural integrity of the pipe 400.

Generally, it may be desirable to prevent fluids from freely moving up the wellbore between the casing and the umbilical (as shown by arrows 5110) and exiting from the well. As the active geothermal energy extraction process may result in significant pressure downhole, the active geothermal system needs to be able to manage the resulting pressurized fluids, both those formed intentionally and those that may be by-products of the process, such as carbon dioxide. As described previously, plugs and other equipment, such as blow-out preventers, may be used to prevent fluids from moving up the pipe 400.

While using an umbilical 3100, it may be desirable to provide a seal for the borehole while enabling more of the umbilical 3100 to be run downhole. Accordingly, the seal may be designed to both prevent the escape of fluids from the wellbore and to allow additional lengths of the umbilical 3100 to be inserted. While cementing or otherwise permanently locking the umbilical 3100 in place may not be desirable in some embodiments, particularly in the early stages of the geothermal process, such permanent seals may be used in certain installations.

Sealing the borehole may be accomplished in a number of ways. For example, elastomers (e.g., thermoplastic), metal alloys (e.g., liquid metals), packers (e.g., mechanically activated and/or pressure activated), casing patches, and/or other devices and materials may be used singly or in combination. The seal may have parameters that vary based on the particular borehole profile (e.g., vertical well depth, width, and/or casing integrity) and burn process (e.g., estimated distance of the seal from the burn front and resulting temperatures, formation type, estimated maximum pressures, and so on). The parameters may then be used to select a seal that will provide the structural integrity and longevity needed. Cool water may be circulated across and/or through such components to reduce thermal stress.

In the present examples of FIGS. 51 and 52, a patch or packer 5102 (e.g., a casing patch), such as an expandable metal-on-metal patch or packer, may be installed. The patch 5102 may be used to structurally reinforce the pipe 400 and to provide an anchor point for securing the umbilical 3100 within the wellbore. For example, a clamp or seal 5104 may be used to hold the umbilical 3100 in place when no downward force is being exerted on the umbilical, while still allowing the umbilical to be inserted deeper into the wellbore. The patch 5102 may also serve as, or serve as a seat for, a seal to prevent fluids from exiting the wellbore.

Compared to other options, a metal patch that provides a metal-on-metal seal may be relatively temperature resistant and may also maximize the cross-sectional area available for insertion of the umbilical 3100 and/or other tools and components. It is understood that, in some embodiments, other options (e.g., elastomers or metal alloys) may have benefits over a metal patch.

Installation of the patch 5102 may be accomplished in the vertical section of the wellbore, as that may provide additional cross-sectional area assuming the vertical section is wider than the horizontal section. In some embodiments, one or more additional patches may be installed in the vertical section as a backup seal to the patch 5102. One or more patches may also be installed in the horizontal section for redundancy in the production zone and/or for potential abandonment of the well. In some embodiments, the patch may be installed in two stages, with the first stage as shown in FIGS. 51 and 52, and a second stage that can be used to permanently plug the wellbore if needed.

One or more seals 5106, such as an annular seal or a plug, may be used to seal the wellbore in order to prevent fluids from exiting the wellbore due to upward pressure that may be present between the umbilical 3100 and the pipe 400. The annular seal(s) 5106 may be part of the patch 5102 or may be separate. Other safety devices and equipment may also be used, such as the engagement of blowout preventers. One or more additional seals (e.g., plugs) 5108/5202 may be used in the umbilical 3100 to prevent the escape of fluids from the wellbore. In some embodiments, such seals 5108/5202 may be provided as part of a manifold or other component (not shown).

Figure 53:
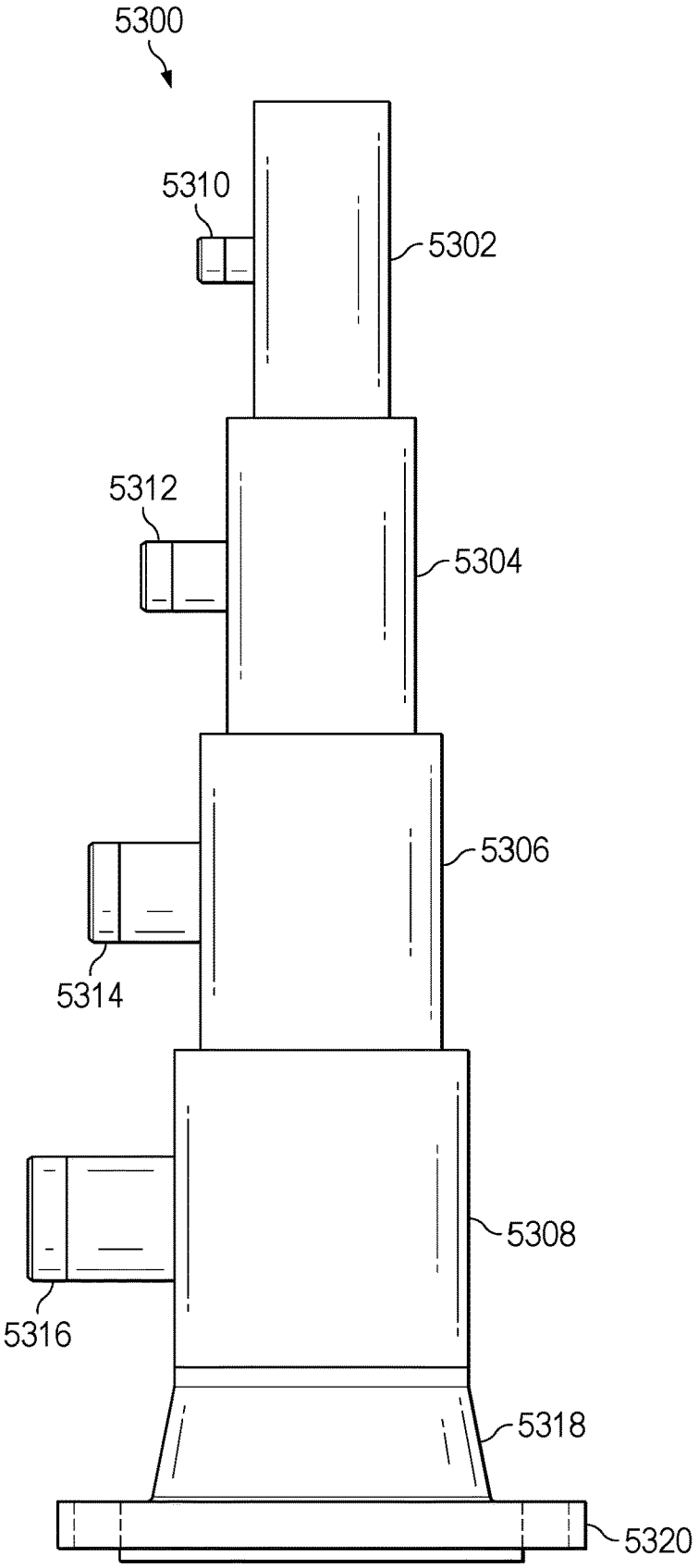
FIGS. 53 and 54 illustrate one embodiment of a surface manifold.
Figure 54:
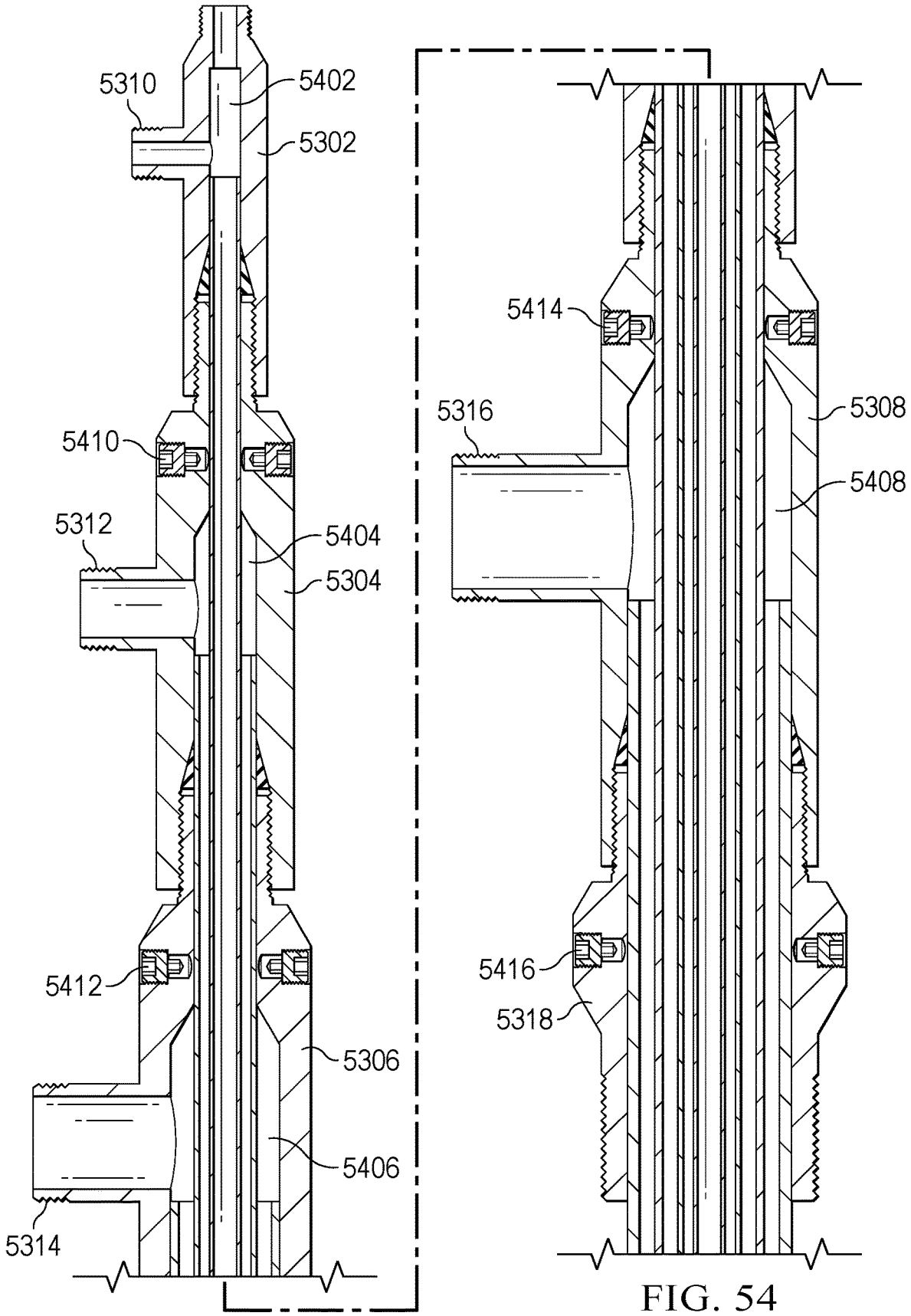

Referring to FIGS. 53 and 54, one embodiment of a surface manifold 5300 is illustrated. The surface manifold 5300 may be installed on the surface after the umbilical 3100 and other components of the geothermal system are installed within the borehole, such as those illustrated with respect to FIGS. 51 and 52. The surface manifold 5300 may be configured to provide surface access to fluid conduits in the umbilical (not shown) for purposes such as the injection and extraction of fluids (e.g., combustion fluids, thermal fluids for heat transfer, and/or other fluids).

The surface manifold 5300 includes four sections 5302, 5304, 5306, and 5308, each of which is coupled to an access port 5310, 5312, 5314, and 5316, respectively. Each access port 5310, 5312, 5314, and 5316 corresponds to, and provides external access to, an internal channel 5402, 5404, 5406, and 5408, respectively, of each of the sections. In the present example, the sections and corresponding channels are arranged as concentric circles, similar to the arrangement described previously with respect to FIG. 15. For purposes of example, the access port 5410 may be used for combustion fluid(s) (e.g., air, oxygen, and/or other fluids), the access port 5412 may be used for accelerant fluid(s) (e.g., fluids designed to initiate combustion that may be similar or identical to combustion fluids) and/or for suppressant fluid(s) (e.g., fluids designed to partially or totally suppress combustion), the access port 5414 may be used for hot thermal fluid(s) (e.g., thermal fluid received from the borehole), and the access port 5416 may be used for cold thermal fluid(s) (e.g., thermal fluid injected into the borehole). It is understood that any of the access ports may be used for any fluid.

Each section may fit into, or be otherwise coupled to, an adjacent section. For example, an upper portion of the section 5304 may be narrower than the lower portion, and the upper portion may fit into a cavity at the bottom of the section 5302. Similarly, an upper portion of the section 5306 may be narrower than the lower portion, and the upper portion may fit into a cavity at the bottom of the section 5304. In this manner, sections may be stacked to assemble the surface manifold 5300, with the assembly occurring onsite or prior to arrival at the wellsite. One or more locking mechanisms and/or seals 5410, 5412, 5414, and 5416 may be used to secure the sections together and/or prevent leakage from one section to another or to the external environment.

A lower section 5318 may be coupled to, or inserted at least partially within, a borehole. A mount 5320 may be used to couple the surface manifold 5300 to the ground, a platform, or another surface.

It is understood that a surface manifold may include more or fewer sections, channels, and/or access ports than those shown with respect to the surface manifold 5300. In some embodiments, multiple access ports may be coupled to a single section/channel, while in other embodiments a single access port may be coupled to multiple sections/channels. For example, one or more fluids may be injected into, or extracted from, a single channel via multiple access ports, or may be injected into, or extracted from, multiple channels via a single access port. In other embodiments, a single section may include multiple access ports and/or channels.

Figure 55:
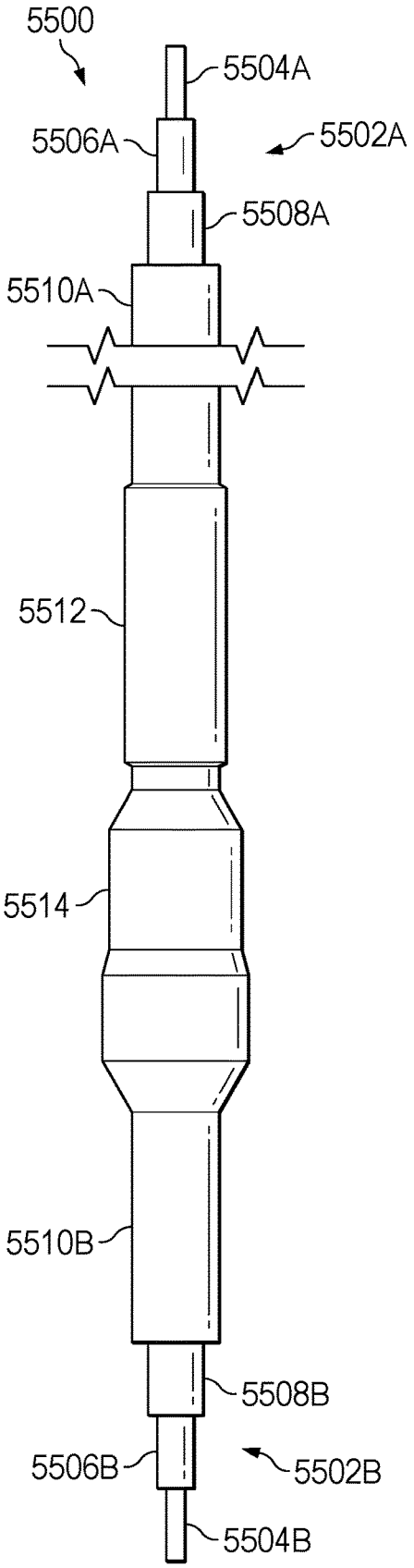
FIG. 55 illustrates one embodiment of a portion of an umbilical with a coupling cluster and a packer.

Referring to FIG. 55, one embodiment of a portion of an umbilical 5500 is illustrated. The umbilical 5500 includes umbilical sections 5502*a* and 5502*b*. The umbilical section 5502*a* includes fluid conduits 5504*a*, 5506*a*, 5508*a*, and 5510*a* that are in fluid communication with the channels 5402, 5404, 5406, and 5408, respectively, of the surface manifold 5300 (FIGS. 53 and 54). The umbilical section 5502*b* includes fluid conduits 5504*b*, 5506*b*, 5508*b*, and 5510*b* that are in fluid communication with the fluid conduits 5504*a*, 5506*a*, 5508*a*, and 5510*a*. In the present example, the outer walls of the fluid conduits 5510*a* and 5510*b* may form the outer wall of the umbilical sections 5502*a* and 5502*b*, respectively, similar to the arrangement illustrated previously with respect to FIG. 15.

The umbilical section 5502*a* may be coupled to a coupling cluster 5510. The coupling cluster 5510 may be designed to connect to an umbilical section with other components and provide a controlled connection to any downhole components that may be included in the umbilical (e.g., flow crossovers, manifolds, packers, and/or other components). The coupling cluster 5510 may be designed for offsite manufacture, and may enable the umbilical sections to be more easily and consistently attached to the downhole components. It is understood that coupling clusters may not be used in all deployments or implementations of the umbilical. The coupling cluster 5510 may be coupled to a component such as a packer 5514 (e.g., a metal packer). For example, the packer 5514 may be the patch/packer 5102 of FIGS. 51 and 52, or may be used elsewhere for purposes such as strengthening or otherwise supporting a section of casing.

Figure 56A:
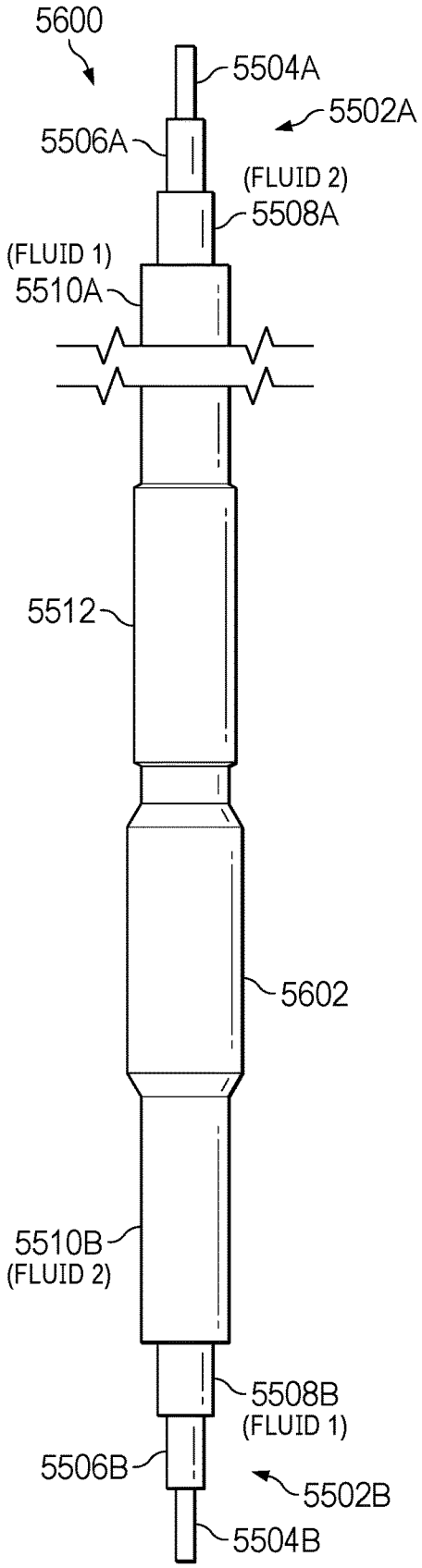
FIG. 56A illustrates one embodiment of a portion of an umbilical with a coupling cluster and a crossover flow.

Referring to FIG. 56A, one embodiment of a portion of an umbilical 5600 is illustrated. The umbilical 5600 is similar or identical to the umbilical 5500 of FIG. 55, except that the packer 5514 has been replaced by a flow crossover 5602. The flow crossover 5602 enables fluid from one conduit to be moved to another conduit within the umbilical. For example, fluid in the fluid conduit 5510*a* of the umbilical section 5502*a* may be switched to the fluid conduit 5508*b* of the umbilical section 5502*b*, and fluid in the fluid conduit 5508*a* of the umbilical section 5502*a* may be switched to the fluid conduit 5510*b* of the umbilical section 5502*b*. This may be used, for example, if it is desired to have cold thermal fluid near the exterior wall of the umbilical in one section of the borehole, and to have hot thermal fluid near the exterior wall in another section of the borehole.

Figure 56B:
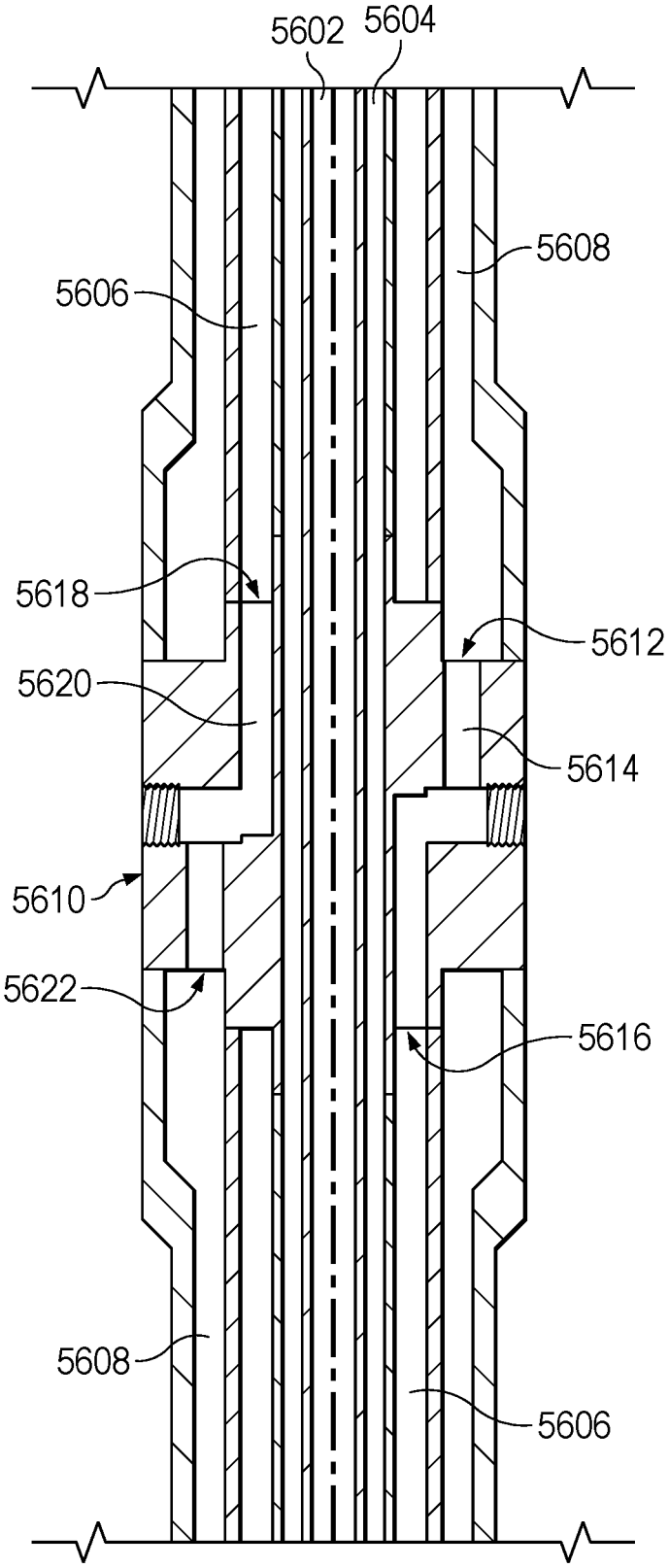
FIGS. 56B and 56C illustrate one embodiment of the crossover flow of FIG. 56A from a side cross-sectional view (FIG. 56B) and a top view (FIG. 56C)
Figure 56C:
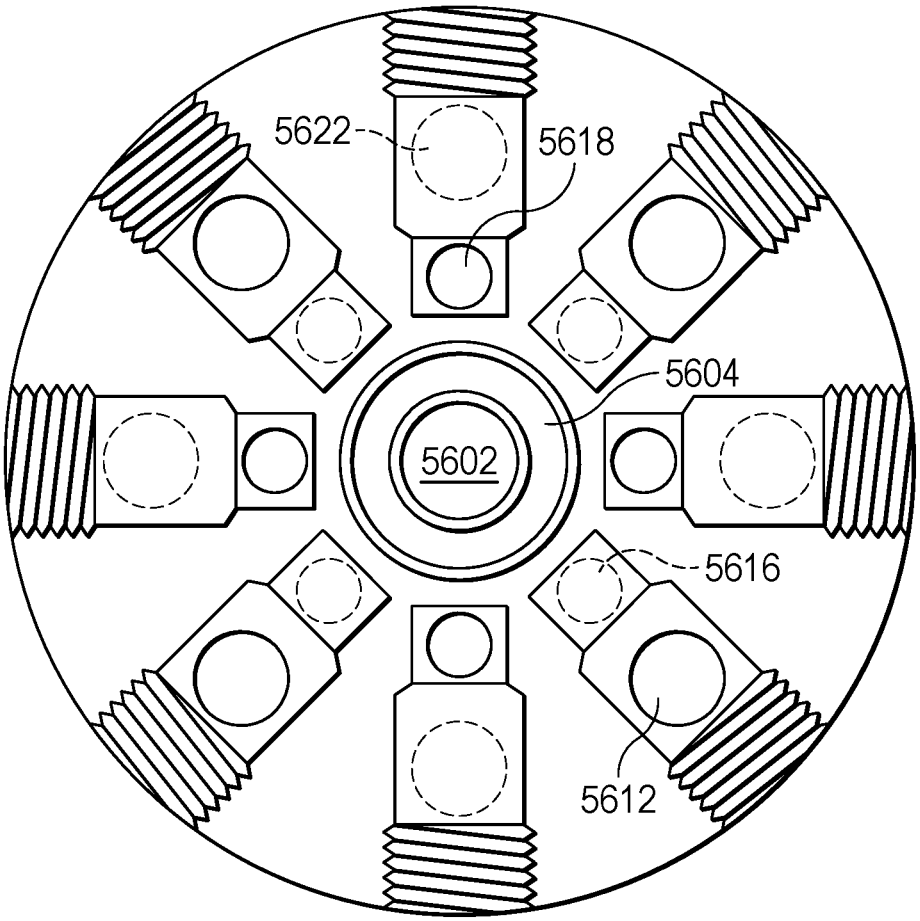

Referring to FIGS. 56B and 56C, one embodiment of the flow crossover 5602 of FIG. 56A is illustrated. Fluid channels 5602, 5604, 5606, and 5608 correspond to fluid conduits 5504*a*/5504*b*, 5506*a*/5506*b*, 5508*a*/5508*b*, and 5510*a*/5510*b* (FIG. 56A), respectively. Continuing the example of FIG. 56A, fluid from fluid channel 5608 enters an opening 5612 that redirects the fluid into a crossover channel 5614 in a crossover section 5610. The fluid exits the crossover channel 5614 via opening 5616, which couples the crossover channel to the fluid channel 5606. Fluid from fluid channel 5606 enters an opening 5618 that redirects the fluid into a crossover channel 5620. The fluid exits the crossover channel 5620 via opening 5622, which couples the crossover channel to the fluid channel 5608. Accordingly, the fluid from fluid channel 5606 is directed to fluid channel 5608 and the fluid from the fluid channel 5608 is directed to the fluid channel 5606.

Figure 56D:
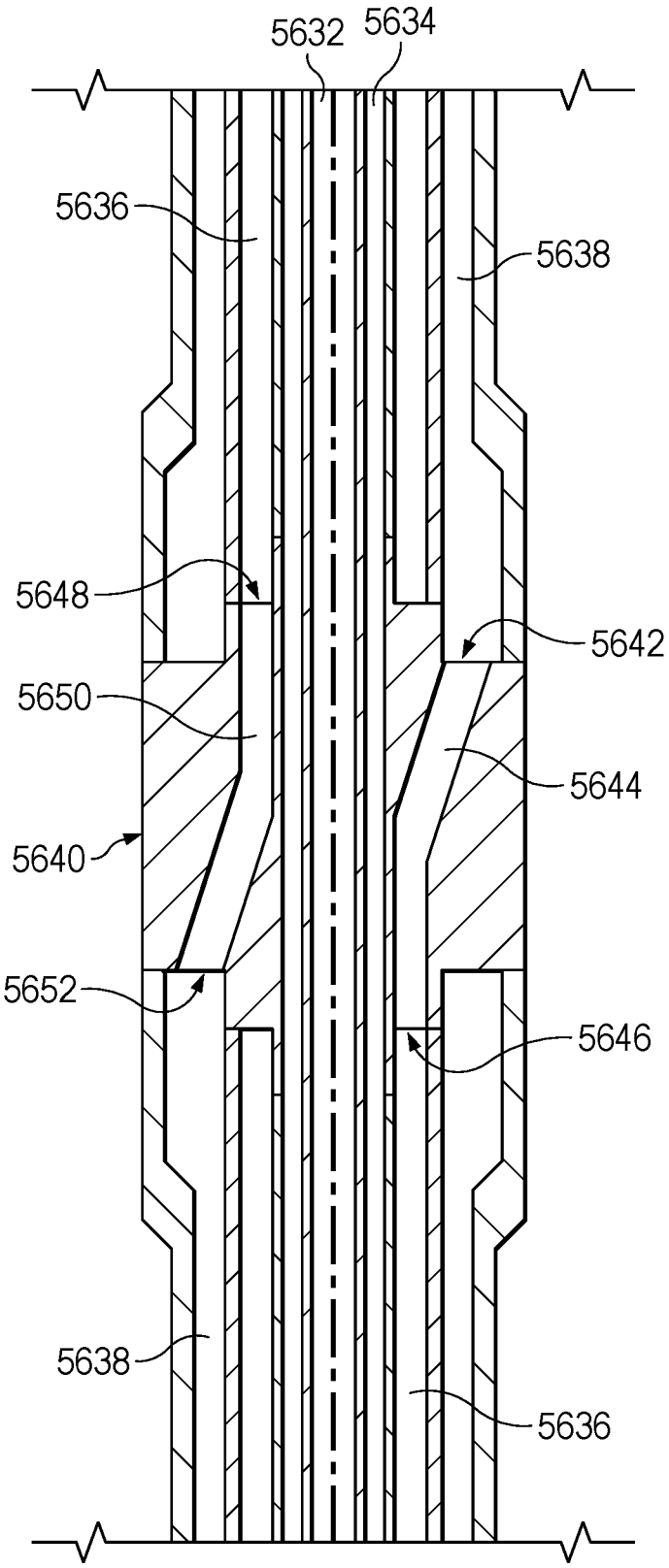
FIGS. 56D and 56E illustrate another embodiment of the crossover flow of FIG. 56A from a side cross-sectional view (FIG. 56D) and a top view (FIG. 56E)
Figure 56E:
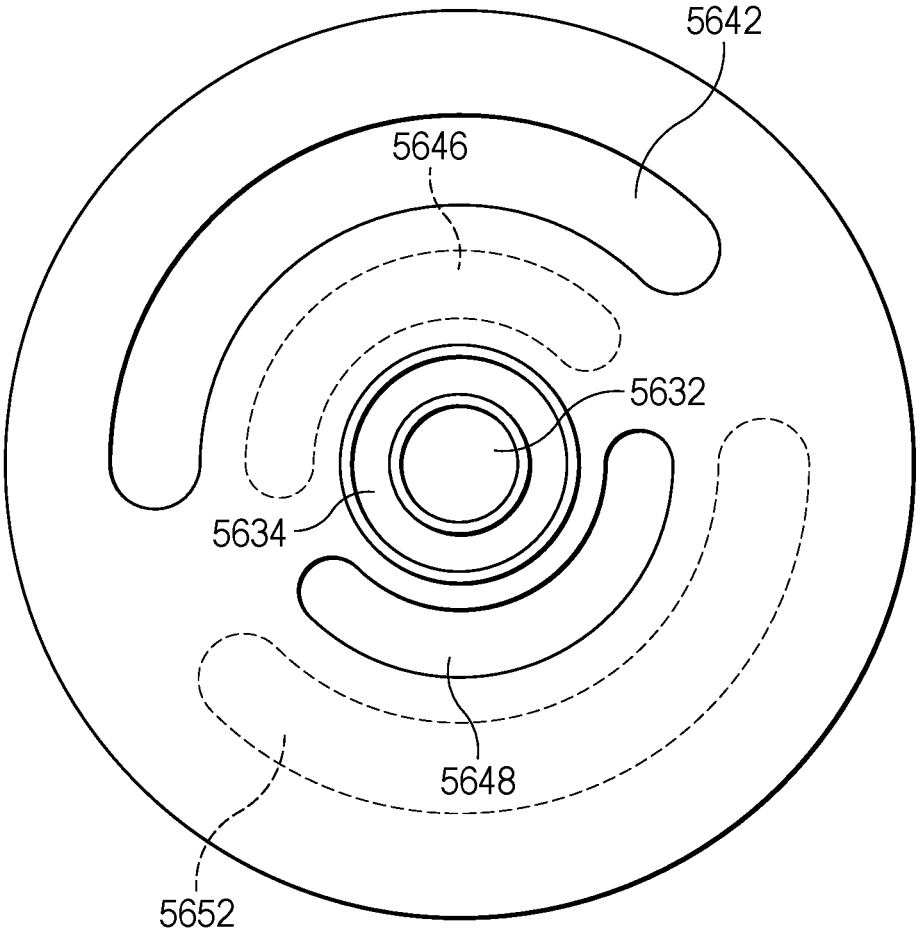

Referring to FIGS. 56D and 56E, another embodiment of the flow crossover 5602 of FIG. 56A is illustrated. Fluid channels 5632, 5634, 5636, and 5638 correspond to fluid conduits 5504*a*/5504*b*, 5506*a*/5506*b*, 5508*a*/5508*b*, and 5510*a*/5510*b* (FIG. 56A), respectively. Continuing the example of FIG. 56A, fluid from fluid channel 5638 enters an opening 5642 that redirects the fluid into a crossover channel 5644 in a crossover section 5640. The fluid exits the crossover channel 5644 via opening 5646, which couples the crossover channel to the fluid channel 5636. Fluid from fluid channel 5636 enters an opening 5648 that redirects the fluid into a crossover channel 5650. The fluid exits the crossover channel 5650 via opening 5652, which couples the crossover channel to the fluid channel 5638. Accordingly, the fluid from fluid channel 5636 is directed to fluid channel 5638 and the fluid from the fluid channel 5638 is directed to the fluid channel 5636.

Figure 56F:
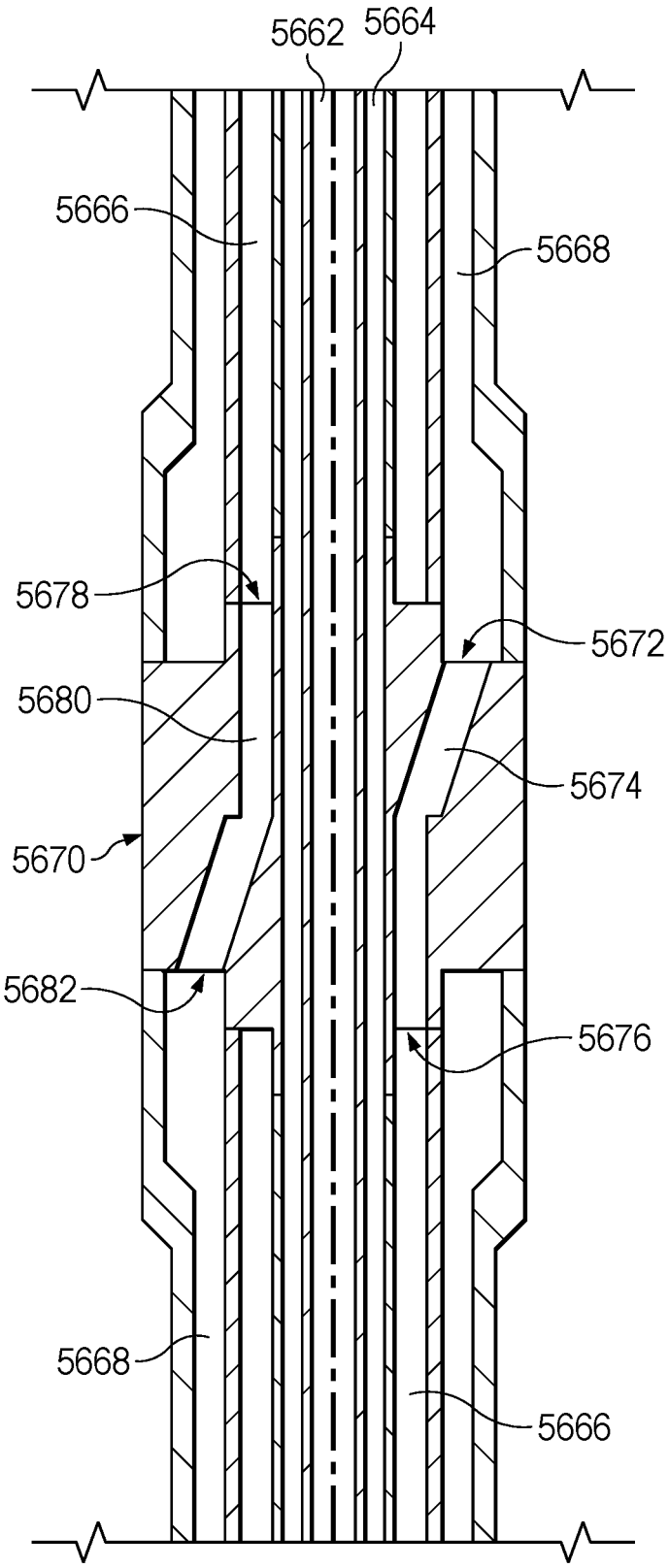
FIGS. 56F and 56G illustrate yet another embodiment of the crossover flow of FIG. 56A from a side cross-sectional view (FIG. 56F) and a top view (FIG. 56G)
Figure 56G:
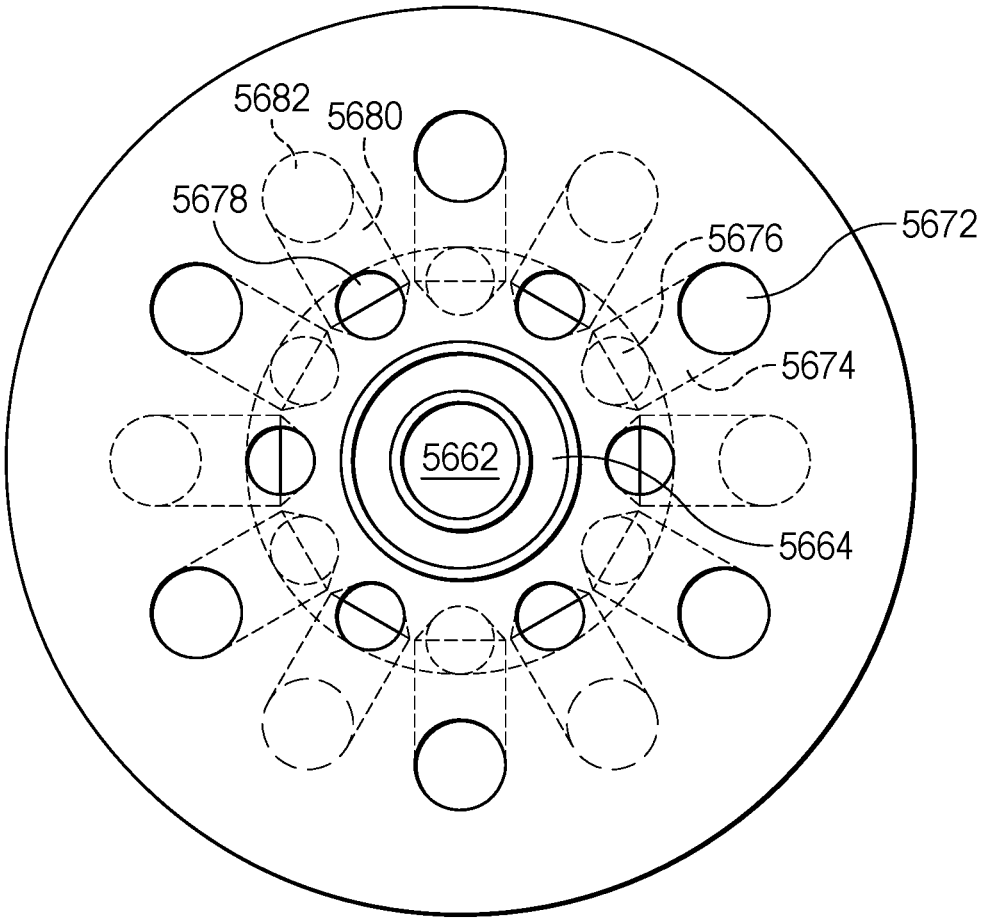

Referring to FIGS. 56F and 56G, another embodiment of the flow crossover 5602 of FIG. 56A is illustrated. Fluid channels 5662, 5664, 5666, and 5668 correspond to fluid conduits 5504*a*/5504*b*, 5506*a*/5506*b*, 5508*a*/5508*b*, and 5510*a*/5510*b* (FIG. 56A), respectively. Continuing the example of FIG. 56A, fluid from fluid channel 5668 enters an opening 5672 that redirects the fluid into a crossover channel 5674 in a crossover section 5670. The fluid exits the crossover channel 5674 via opening 5676, which couples the crossover channel to the fluid channel 5666. Fluid from fluid channel 5666 enters an opening 5678 that redirects the fluid into a crossover channel 5680. The fluid exits the crossover channel 5680 via opening 5682, which couples the crossover channel to the fluid channel 5668. Accordingly, the fluid from fluid channel 5666 is directed to fluid channel 5668 and the fluid from the fluid channel 5668 is directed to the fluid channel 5666.

Figure 57:
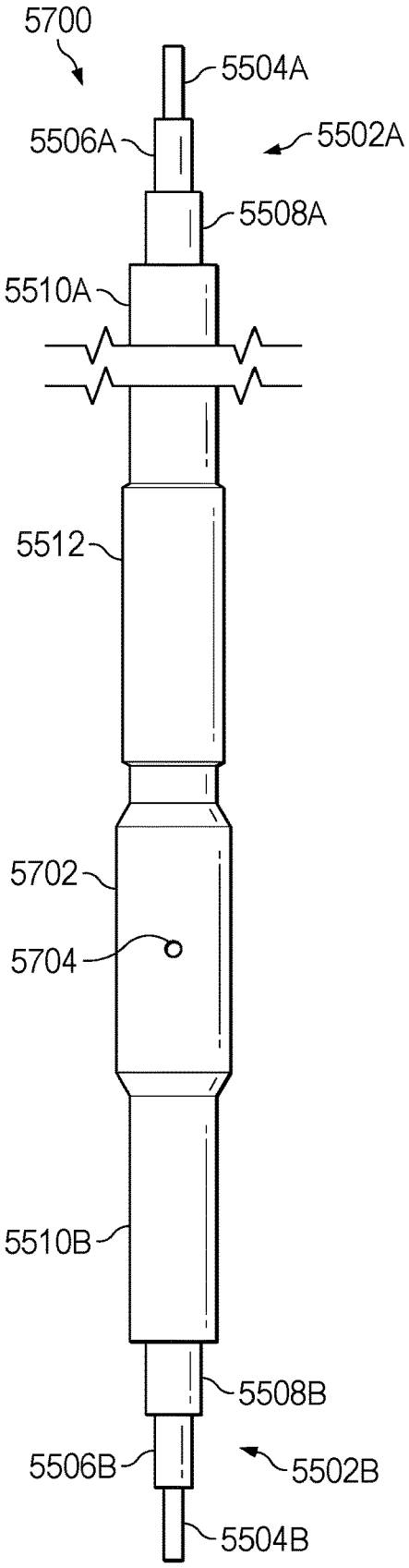
FIG. 57 illustrates one embodiment of a portion of an umbilical with a coupling cluster and a manifold.

Referring to FIG. 57, one embodiment of a portion of an umbilical 5700 is illustrated. The umbilical 5700 is similar or identical to the umbilical 5500 of FIG. 55, except that the packer 5514 has been replaced by a manifold 5702. As described previously, the manifold 5702 may be used for various functions, including the injection of fluid into the formation via an external opening 5704. In the present example, the manifold 5702 may be designed for use along the umbilical, but not at the end of the umbilical. As such, the lower end of the manifold 5702 may not be sealed in order to provide access to the umbilical section 5502B.

Figure 58:
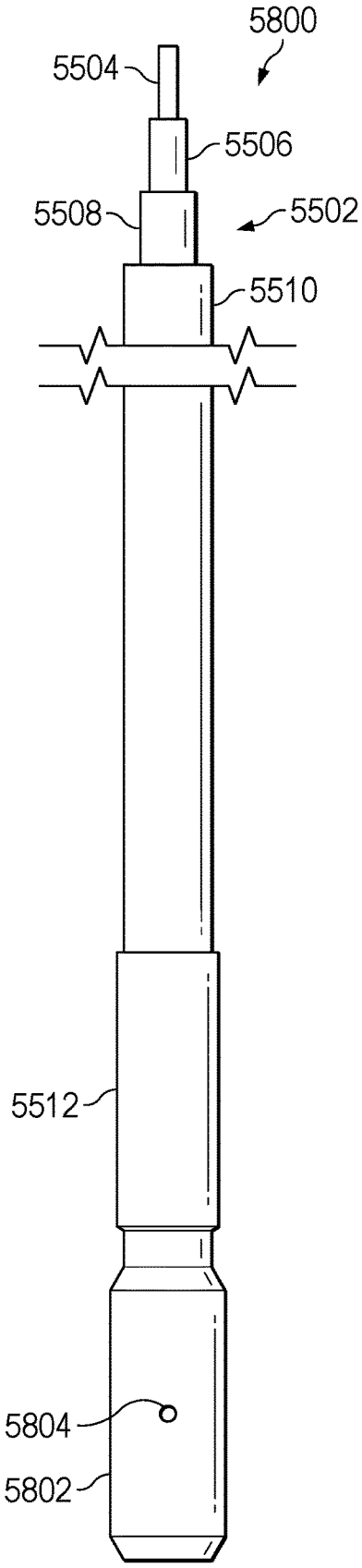
FIG. 58 illustrates one embodiment of a portion of an umbilical with a coupling cluster and another manifold.

Referring to FIG. 58, one embodiment of a portion of an umbilical 5800 is illustrated. The umbilical 5800 is similar or identical to the umbilical 5700 of FIG. 57, except that the manifold 5702 has been replaced by a manifold 5802 having an external opening 5804. In the present example, the manifold 5802 may be designed for use at the end of the umbilical. As such, the lower end of the manifold 5802 may be sealed to prevent fluids from entering or exiting the end of the umbilical. In some embodiments, the lower portion of the manifold 5802 may be completely sealed, while in other embodiments the lower portion may include valves and/or other mechanisms that may be used to control external access.

Figure 59:
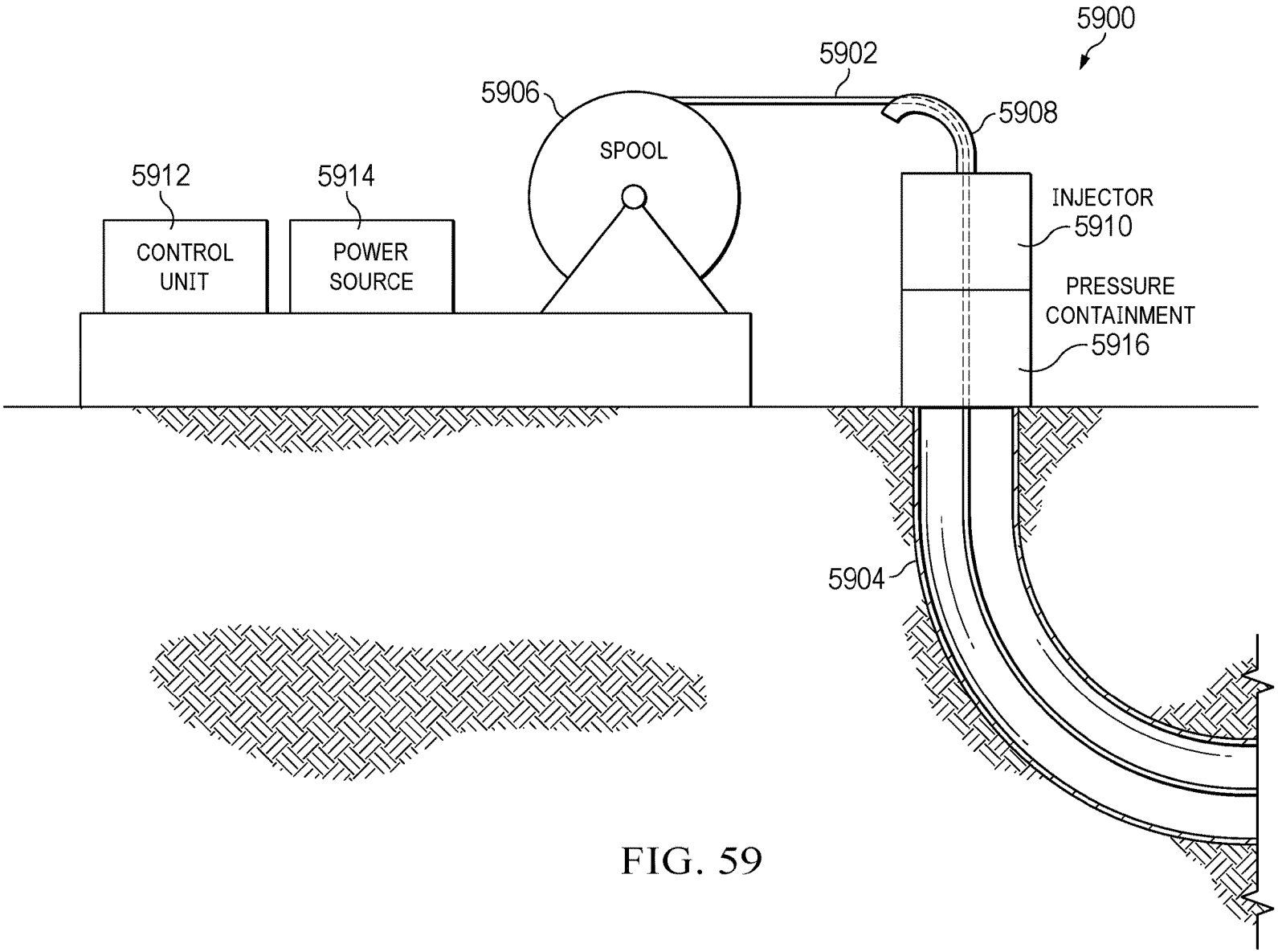
FIG. 59 illustrates one embodiment of equipment that may be used to insert an umbilical downhole.

Referring to FIG. 59, one embodiment of an environment 5900 illustrates equipment that may be used to install an umbilical 5902, which may be similar or identical to the umbilical 3100 of FIGS. 31 and 35, within a borehole 5904. The umbilical 5902 may be transported to the wellsite on a spool 5906. The spool 5906 is oriented so that the umbilical 5902 can be fed from the spool across a guide 5908 into an injector 5910. A control unit 5912, along with a power source 5914 that powers the equipment, manages the process by using the injector 5910 to push the umbilical 5902 into the pipe. In some embodiments, pressure containment equipment 5916 may be used to prevent blowouts and otherwise manage downhole pressure. Once the umbilical is installed, a surface manifold (e.g., FIG. 53) may be positioned above the borehole 5904 to provide access to the fluid conduits within the umbilical 5902.

An agitator, tractor, and/or other device (not shown) may be used with the umbilical 5902 to aid in moving the umbilical downhole. Such a device may be used sacrificially with no concern for recovering the device once used and disconnected once the umbilical is in place. If a kill line is present for nitrogen and/or other combustion suppression fluids, the kill line may be used to power the device. Such a kill line may extend the entire length of the umbilical. In other embodiments, other conduits may be used to power and/or control the device.

In some embodiments, the umbilical 5902 may be floated into position. For example, the inside of the umbilical 5902 may be left full of air and the process may use fluids, such as fluids that were left in the wellbore prior to rigging up to run the umbilical (e.g., during a workover operation) to float the umbilical. The fluid may be circulated to aid in moving the umbilical 5902. In other embodiments, a bypass may be used to allow fluid to flow through the end of the umbilical 5902 into the borehole 5904 to circulate fluid. Once the umbilical 5902 is in place, the bypass may be manipulated to shut off or otherwise control the opening.

Referring to FIGS. 60A-60D, one embodiment of an environment 6000 illustrates a subsurface view of multiple boreholes 6002, 6004, 6006, and 6008, each of which branches into multiple horizontal branches for fracking. For example, the borehole 6002 includes horizontal branches 6010*a*, 6010*b*, 6010*c*, 6010*d*, 6010*e*, and 6010*f*. The borehole 6004 includes horizontal branches 6012*a*, 6012*b*, 6012*c*, 6012*d*, 6012*e*, and 6012*f*. The borehole 6006 includes horizontal branches 6014*a*, 6014*b*, 6014*c*, 6014*d*, 6014*e*, and 6014*f*. The borehole 6008 includes horizontal branches 6016*a*, 6016*b*, 6016*c*, and 6016*d*.

It is understood that the number of boreholes and branches are for purposes of example only. Accordingly, other embodiments may be directed to a single well, wellhead, branch, and/or borehole, and combustion may be applied toe to heel, simultaneously along a relatively large length of the branch or borehole, and/or in any other manner for geothermal, EOR, and/or other purposes. Generally, any embodiment directed to a single well, wellhead, branch, and/or borehole in the present disclosure may be applied to multiple wells, wellheads, branches, and/or boreholes, and any embodiment directed to multiple wells, wellheads, branches, and/or boreholes may be applied to a single well, wellhead, branch, and/or borehole.

Multiple boreholes are often drilled in a geographic area in order to remove the oil in an efficient manner and those boreholes may branch out horizontally under the surface. While the distance between subsurface wells may have a variety of ranges (e.g., one hundred and fifty feet to three hundred feet), it is understood that lesser or greater separations may exist. Accordingly, if a particular subsurface region is ignited as described herein, care may be taken to ensure the combustion does not spread to other regions that are not intended to be ignited or are intended for later ignition.

It is understood that while the well branches of FIGS. 60A-60D are illustrated with a substantially planar horizontal arrangement, the process of the present disclosure may be used with any type of two or three dimensional well geometry. For example, wells/branches may be stacked vertically, may run at perpendicular angles, may run at any angle relative to the surface (e.g., slanted), and/or may have many different orientations within three-dimensional space. It is also understood that combustion zones may be three dimensional even along a single borehole and, as combustion zones may move in three-dimensional space along the branch or borehole (if not branched), the breakthrough potential and other aspects of each combustion zone may need to be viewed from a three-dimensional perspective.

Figure 60A:
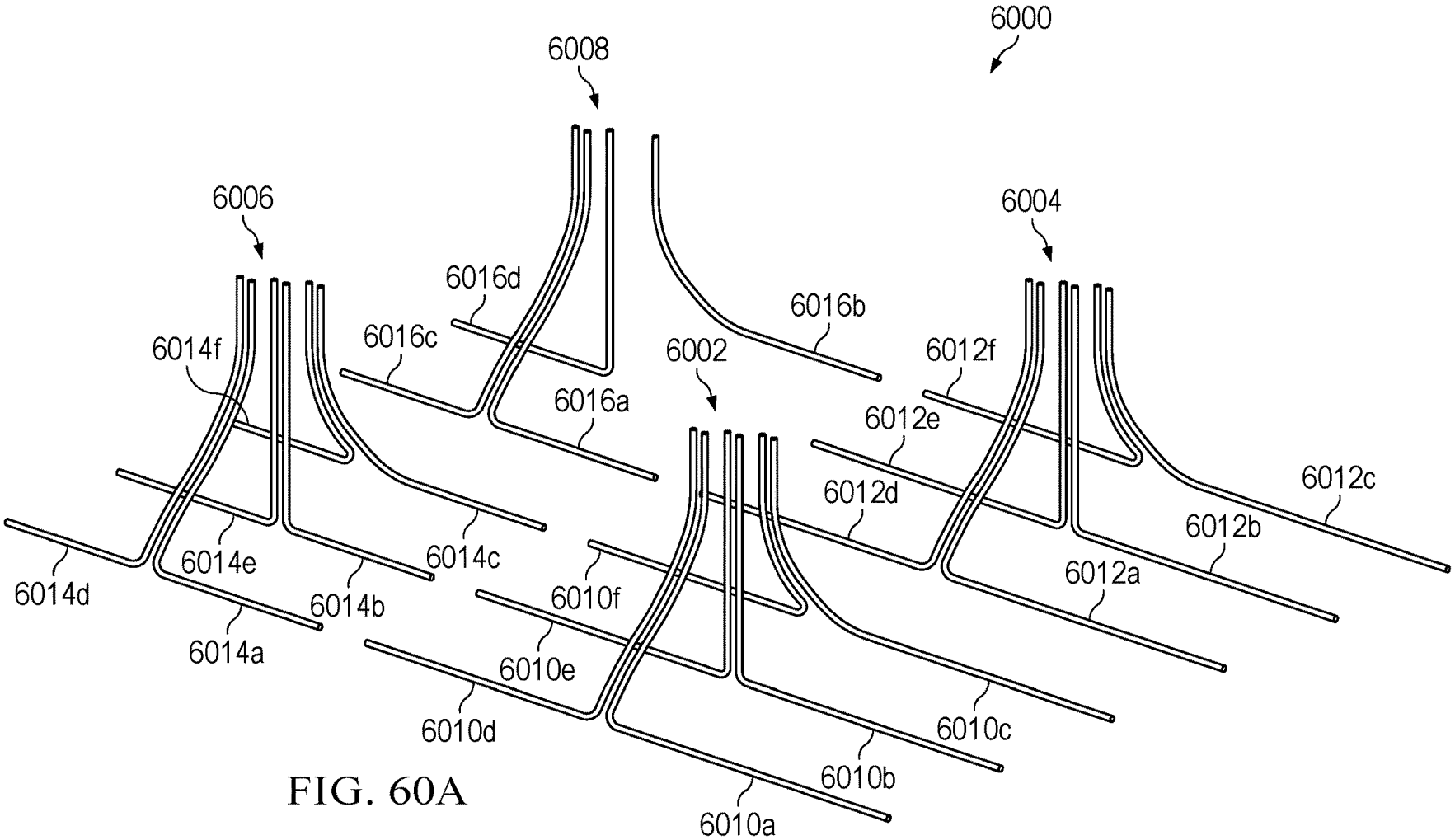
FIG. 60A illustrates one embodiment of a multiple well system.
Figure 60B:
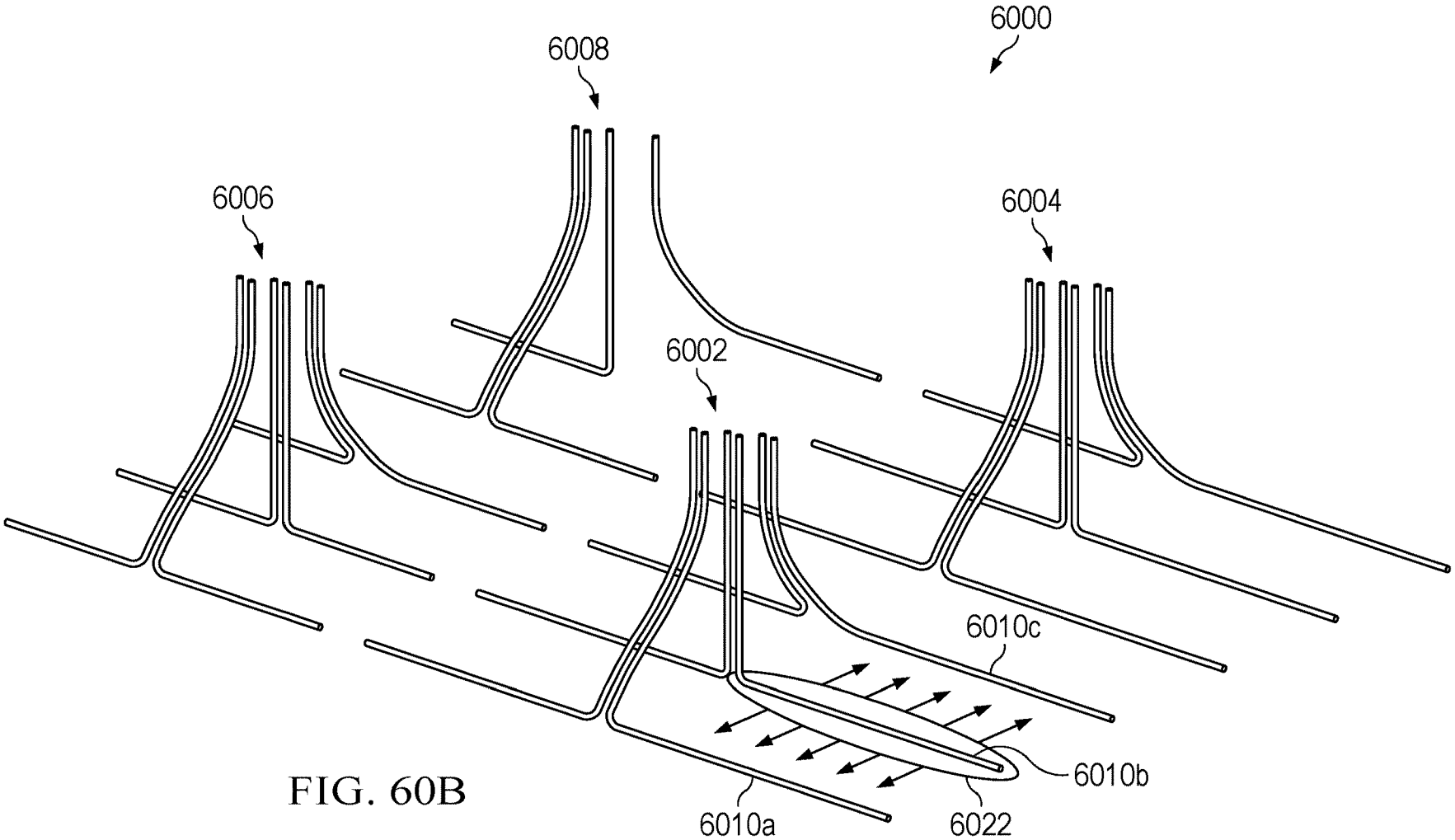
FIG. 60B illustrates one embodiment of the multiple well system of FIG. 60A with a combustion zone ignited around a single branch.

As illustrated in FIG. 60B, the branch 6010*b* has been ignited, forming a combustion area 6022 around the branch. In addition to the thermal energy produced by combustion, the process may perform an EOR function by producing pressure that induces oil or gas towards the heel of the branch 6010*b* if the branch is sequentially ignited as described previously, towards adjacent branches 6010*a* and 6010*c*, or to the branches of other wellheads. Additionally, or alternatively, the thermal energy may also provide an EOR function by reducing the viscosity of the hydrocarbon mixture, making it more permeable and therefore enabling it to flow more easily within the formation. These EOR functions of pressure induced flooding and/or viscosity reduction may be controlled at least somewhat by altering the thermal energy used to drive the EOR functions. Accordingly, the process described herein may increase the production not only in the well where the combustion is occurring, but also or alternatively in neighboring wells that are still operational.

In addition to the EOR functions described above, added pressure induced by thermal waves and flow rates may open up or expand existing fractures in the formation. This expansion process may be controlled and enhanced by tuning the thermal concentration in a particular area of the formation. This process may occur while monitoring the fracking operation from downhole and/or the surface, thereby increasing the effectiveness of the fracking by driving additional pressure increases in some or all of the target formation.

In some embodiments, pressure cycling may occur. For example, a multiple stage venturi system or variable air injection thermal cycling may be used to pulse pressure in and out of different sections of the casing. The use of pulsing pressure may aid fluid circulation around the wellbore for better heat transfer and/or may provide protection and/or cooling of the casing. Additionally, or alternatively, such pulsing pressures may be used to generate a vacuum to pull reservoir fluid back into the casing. With a particular cycling interval, this may be used to establish a set burn front.

In other embodiments, air injection may be used to free trapped hydrocarbons, whether in a geothermal system or in a regular well. More specifically, high pressure air may be injected and ignited to free trapped hydrocarbons. The air may then be cut off and/or removed, allowing the hydrocarbons to flow towards the well. For example, freeing natural gas trapped in pockets using this process may enable additional gas to be made available for recovery or to fuel the combustion zone in a geothermal system.

In still other embodiments, preheating of the formation may be performed prior to ignition and/or in conjunction with the injection of oxygen, compressed air, and/or other combustion fluids. Such preheating may increase the efficiency of later combustion and, in some scenarios, may lessen the stress (e.g., thermal stress resulting in metal fatigue) on the downhole equipment that may otherwise occur if combustion causes a rapid change in temperature. Preheating may also be used to affect various processes within the formation. For example, properties of coke may undergo changes when burning that vary based on the temperature provided prior to ignition/oxygen for combustion.

Preheating may be accomplished using one or more different processes, including the use of electricity, the combustion/injection of other fuels, chemical reactions, and/or other processes. For example, fuels and/or chemical reactions may be used that do not produce enough heat to start the combustion process of the formation itself. Such processes may use mechanical, electrical, chemical, and/or other mechanisms, either singly or in combination, and may be dynamically controllable or may be designed to provide a desired amount of energy before naturally stopping. In some embodiments, such processes may continue after combustion until stopped or otherwise depleted of energy.

Figure 60C:
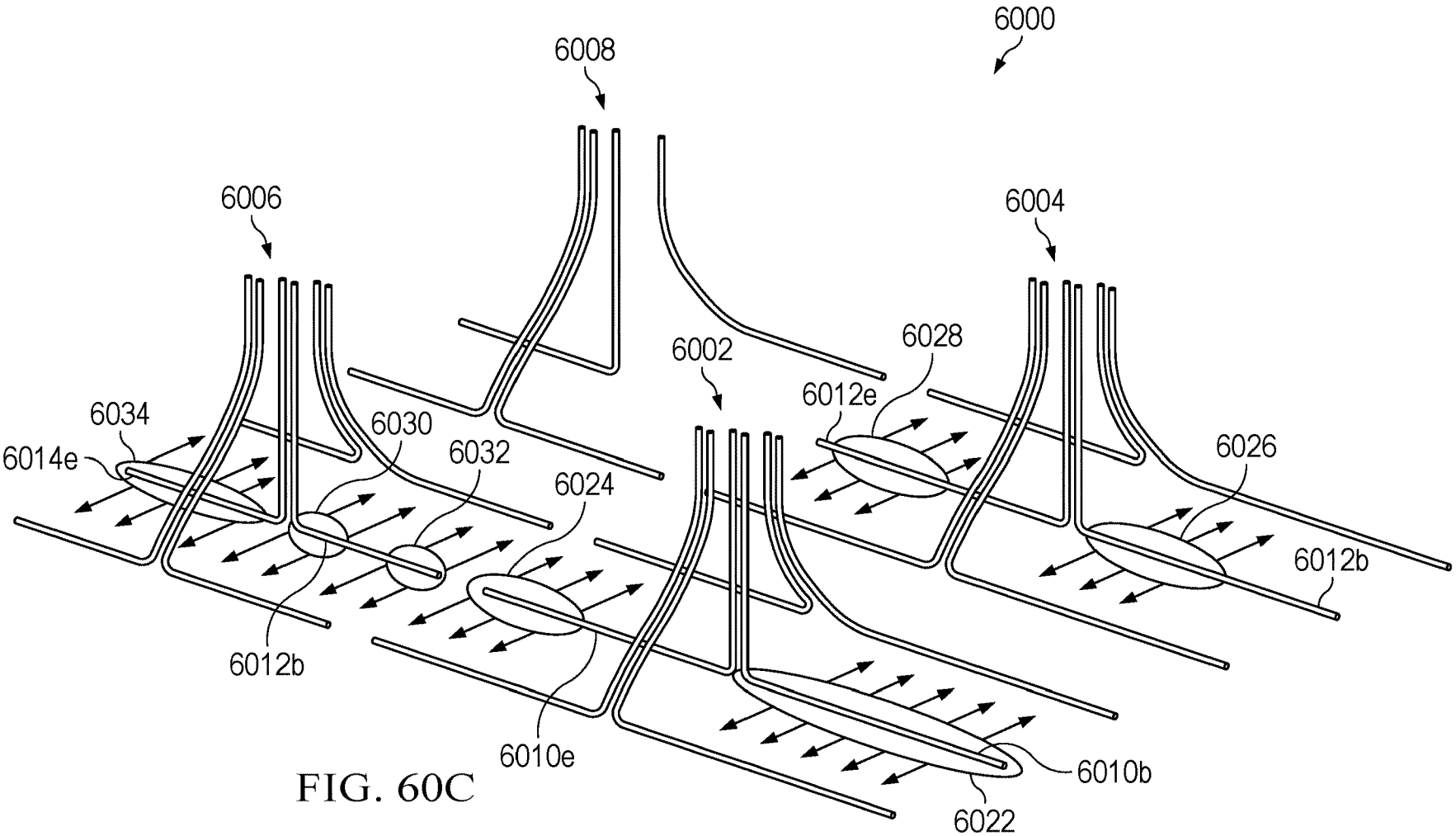
FIGS. 60C and 60D illustrate embodiments of the multiple well system of FIG. 60A with combustion zones ignited around multiple branches.
Figure 60D:
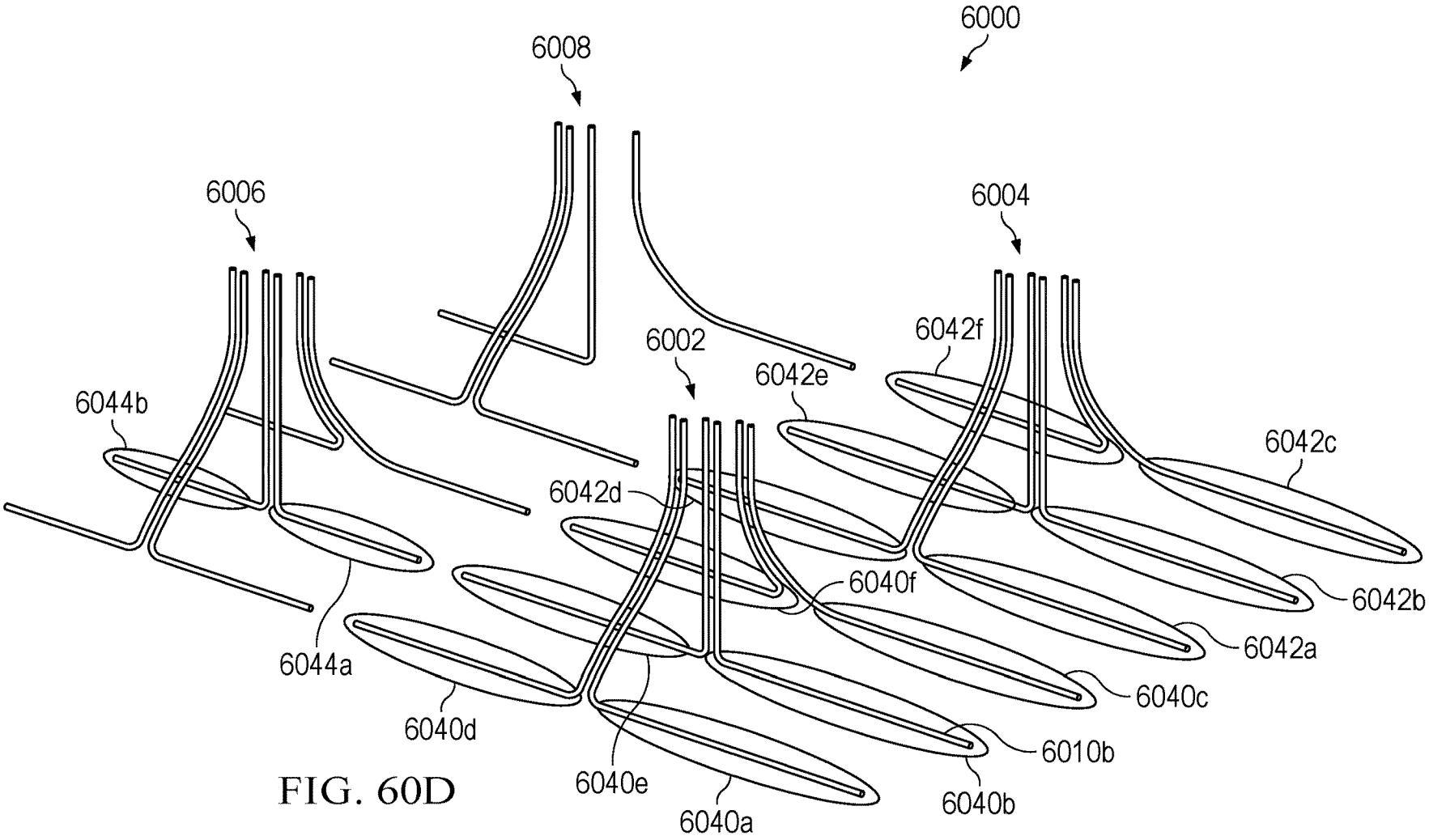

As illustrated in FIGS. 60C and 60D, additional selected branches of the wells 6002, 6004, and 6006 may be ignited. Although not ignited, it is understood that the branches corresponding to well 6008 may also be ignited in part or in whole.

Referring specifically to FIG. 60C, branches 6010*b* and 6014*e* have been ignited in their entirety as illustrated by combustion areas 6022 and 6034, respectively. The toe area of branch 6010*e* has been ignited as illustrated by combustion area 6024. The heel area of branch 6012*b* has been ignited as illustrated by combustion area 6026, and the middle area of branch 6012*e* has been ignited as illustrated by combustion area 6028. Two separate areas of branch 6012*b* have been ignited as illustrated by combustion areas 6030 and 6032.

Referring specifically to FIG. 60D, all branches of the wells 6002 and 6004 have been ignited in their entirety as illustrated by combustion areas 6040*a*-6040*f* and 6042*a*-6042*f*, respectively. Branches 6014*b* and 6014*e* of the well 606 have also been ignited in their entirety as illustrated by combustion areas 6044*a* and 6044*b*, respectively.

Referring generally to FIGS. 60B-60D, it is understood that the shape and size of combustion zones may not be uniform, but may vary depending on amount of fuel in a particular area, access to oxygen, the presence of suppressants, and/or other factors. A combustion area, such as the combustion area around branch 6010*b* (and other branches), may continue to expand outwards, towards the adjacent branches 6010*a* and 6010*c*. While allowing the combustion area to spread to encompass one or both branches 6010*a* and 6010*c* may be desirable, such desirability may be situational.

For example, in one scenario, assume that branches 6010*a* and 6010*c* are not equipped with the fluid conduits and other components described above. In this case, a determination may be made as to whether the heat increase in branch 6010*b* due to the combustion around branches 6010*a* and 6010*c* justifies the loss of fuel in those adjacent branches, or if it is more efficient to ignite those branches separately after fluid conduits have been installed therein. The combustion may be allowed to continue in the former case, while it may be desirable to suppress the combustion in the latter case.

An ignition strategy may be implemented for a single borehole or across multiple wells. Such a strategy may, for example, time ignition based on factors such as oxygen percentage in the fluid, fluid flow rate, burn rate of the particular combustible fuel in the formation, density of combustible material, estimated surface area of combustible material, amount of water present in the formation, and/or similar factors. By planning based on such factors and monitoring to identify unexpectedly high oxygen concentrations and/or combustion parameters, large and rapid pressure increases from the ignition of concentrated oxygen pockets (e.g., bulk combustion events) and other potentially undesirable ignition side effects may be minimized or eliminated. As such side effects may result in blowouts and/or equipment damage, ignition strategies may impact both safety and productivity.

An ignition strategy may also be used to plan an overall burn rate along the pipe while leaving a section for reignition. For example, by leaving one combustion zone less burned (e.g., near the toe) and more thoroughly consuming fuel available in the remaining areas (e.g., at the heel), the relatively unburned area may be used as a wick for reignition if needed. Otherwise, if all combustible material near the pipe is burned away, a reignition attempt may need to extend out further from the pipe, thereby potentially introducing complications.

If breakthrough occurs and is not desired, some or all of the burning fuel may be suppressed to partially or completely quench the fire. For example, the oxygen/air flow in branch 6010*b* may be reduced or stopped to lessen or starve the fire. Carbon dioxide, nitrogen, water, and/or other fire suppressants may be pumped into the formation to actively suppress the fire. In some embodiments, a series of escalating measures may be taken depending on the severity of the problem and the time frame in which the problem needs to be addressed. It is understood that such suppression may not occur over the entire length of the pipe, but may be partial in nature. For example, if a breakthrough occurs, fire suppressant may be flooded into the toe, leaving the area closer to the heel burning or prepared to burn. Other safety devices and equipment may also be used, such as the engagement of blowout preventers.

As described with respect to FIG. 2, the monitoring system 212 may be used to monitor the activity of one or more boreholes and their branches. By using surface and/or subsurface sensor information, the monitoring system 212 may determine the general extent of a combustion area. For multi-well regions such as that of FIGS. 60A-60D, the monitoring system 212 may be responsible for multiple wells or may communicate with monitoring systems of other wells, effectively forming a regional monitoring system. This enables the monitoring system 212 to monitor thermal changes in other branches and wells in order to detect possible breakthroughs before they occur, as well as monitor thermal changes to determine if they are sufficient to cause desired EOR. For example, if pressure is building due to the thermal output of a combustion zone, the monitoring system 212 may detect the pressure increase. In such situations, the safety system 214 may take steps to alleviate the pressure if it exceeds a defined threshold, such as by reducing oxygen to lower the temperatures or attempting to extinguish the combustion zone partially or entirely.

Figure 61:
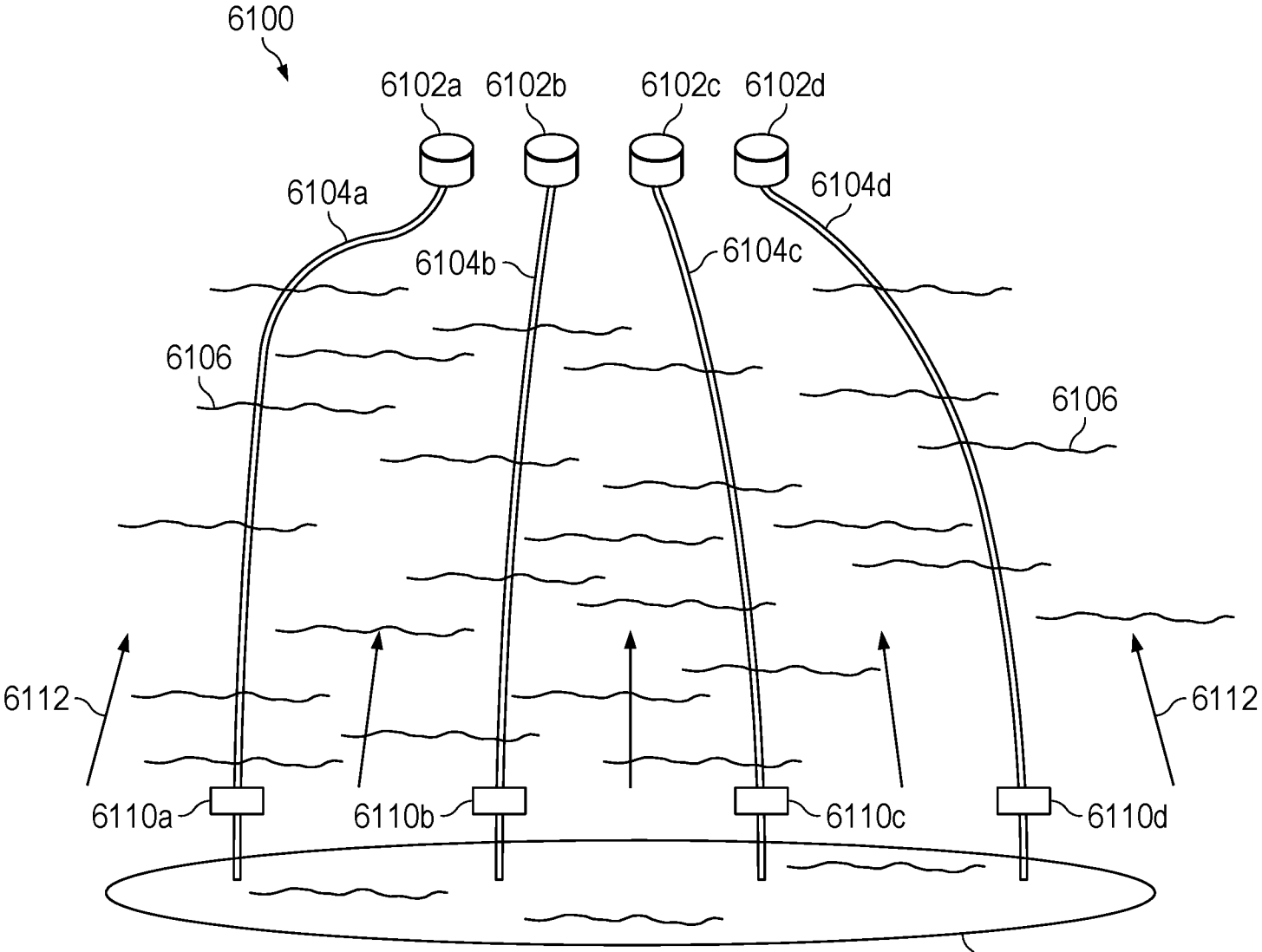
FIG. 61 illustrates one embodiment of an environment that may leverage fractures extending through the formation.

Referring to FIG. 61, one embodiment of an environment 6100 illustrates wellheads 6102*a*-6102*d* that lead to boreholes 6104*a*-6104*d*, respectively. In the present example, fractures 6106 may be used to aid in fluid movement and combustion across multiple wells. For example, simultaneous burns may be initiated at the toes of adjacent wells to form a combustion zone 6108 to take advantage of fractures 6106 that extend towards the other wells and, in some cases, may even connect the wells. Plugs 6110*a*-6110*d* may be positioned in the pipes/umbilicals along boreholes 6104*a*-6104*d*, respectively, in order to control combustion and/or for other purposes.

As fluid circulates through the combustion zones in the toes and between the combustion zones via the fractures 6106, the fluids may be pushed towards the heels of the wells in a more uniform manner, which may result in heated oil production upstream of the plugs 6110*a*-6110*d* as illustrated by arrows 6112. This heating of hydrocarbons may also add thermal energy to the thermal transfer fluid in the heels and higher up the verticals. In some embodiments, heat may also be pulled off the oil itself. The impact of this simultaneous combustion process and cross-circulation may depend on the relative orientation of the adjacent wells, the distance separating them, and the presence of fractures, with any potential benefits varying based on such factors.

The plugs 6110*a*-6110*d* may be moved upstream as the combustion zone 6108 depletes the fuel near the toes and moves towards the heels of the boreholes 6104*a*-6104*d*. Such plug movement may need to take built up pressure into account in order to prevent blowouts and similar events when the plug is released for movement. In some embodiments, rather than moving plugs, multiple plugs may be used along a single borehole. Valves and/or other control mechanisms in the plugs may then be used to control air flow and/or other combustion parameters, enabling the surrounding combustion zone to be regulated without needing to move the plugs.

In other embodiments, a ball drop or other process may be used to trigger a mechanical gate when it hits a certain stage. Such mechanisms may be multi-tiered to shut off different areas of the conduit. For example, a ball of a particular diameter may be dropped that falls past one or more gate mechanisms that are higher in the pipe until it reaches the gate mechanism that is small enough to catch it and therefore be actuated by the ball. In this manner, a particular ball may be used to close a particular gate mechanism at a desired point based on diameter and/or weight, or a series of balls may be used to sequentially shut off a series of gate mechanisms. It is understood that balls need not be used and many different approaches may be applied to selectively shut off fluid flow within a borehole.

Figure 62:
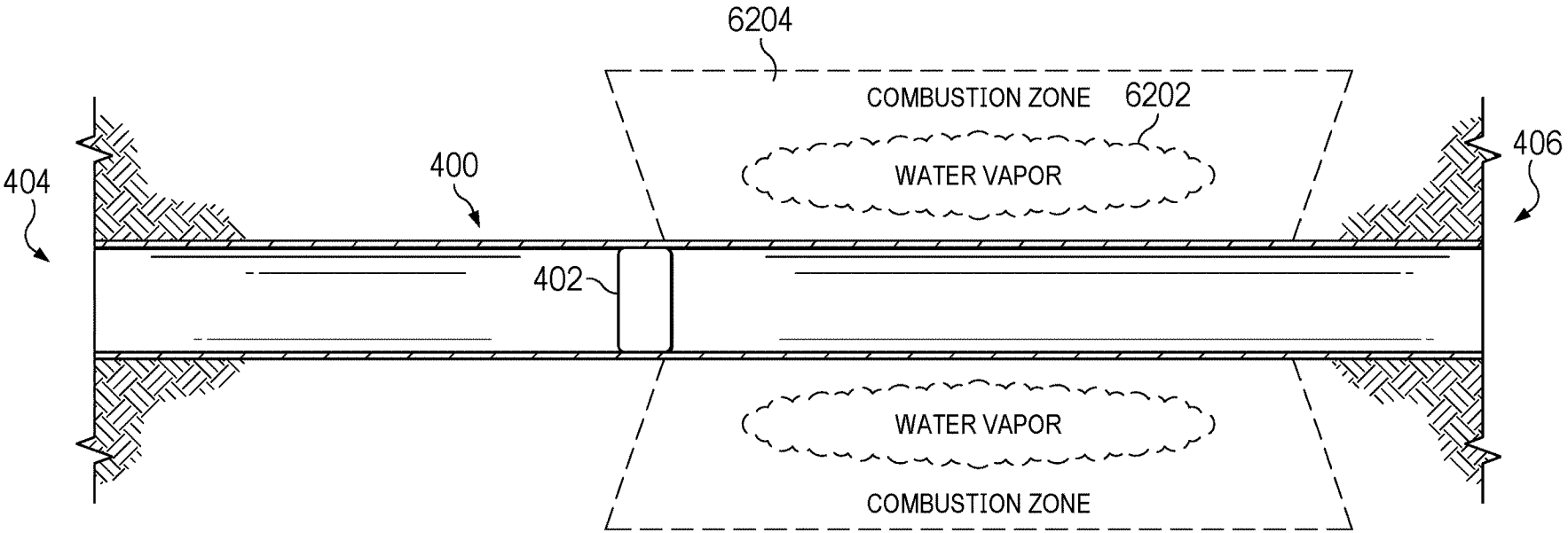
FIGS. 62-63B illustrate embodiments of a pipe proximate to a combustion zone with water used in conjunction with the combustion zone.

Referring to FIG. 62, in some embodiments, injected water and/or water already present in the formation may be used to facilitate heat transfer and/or to manage the burn front with respect to fractures in the formation. It is understood that while water is used for purposes of example, one or more other fluids may be used in addition to, or as an alternative to, water. For example, various chemicals or chemical mixtures, including engineered water with additives, may be used. The amount of fluid used may depend on many different factors, such as the size of the combustion zone, the intensity of the fire, characteristics of the formation (e.g., the amount of fuel present and/or the number and dimensions of fractures), and/or the chemical composition of fluid(s) that are already present or are to be injected. In addition to, or as an alternative to, using steam as a thermal transfer mechanism, steam may be pumped directly to the surface in some embodiments for use as a power source or for energy extraction.

With respect to heat transfer, the water may be converted to steam 6202 downhole by the thermal energy of the combustion zone 6204. As the water vaporizes, the steam may fill or partially fill the cavities between the combustion area and the pipe. As water vapor may be more thermally conductive than air, the steam thereby becomes a thermal transfer mechanism that facilitates the transfer of heat from the higher temperature areas at the burn front to the pipe.

If water is already present in the well, additional energy may be applied to vaporize the water or the thermal energy from the combustion process may be relied upon for vaporization. Depending on the amount of water present, energy needed for converting the water to steam may be taken into account in calculations for planning and maintaining combustion.

The thermal transfer may occur in different ways. For example, if water surrounds the pipe 400, the heat and pressure from the combustion zone 6204 may both heat the water and push the water back to the pipe, causing the heated water to circulate around the pipe and fluid conduits. As the heated water circulates around the heat transfer fluid conduit(s), heat exchange may take place. Additionally, or alternatively, heated water may be pumped directly to the surface.

When a fluid with suppressant properties (e.g., water) is injected into the well, there may be detrimental effects on combustion. For example, if the water is injected before ignition, there may be the possibility of suppressing later ignition attempts or, if ignition occurs, of reducing the burn rate and/or intensity due to the presence of the water. If the water is injected after ignition, there may be the possibility of extinguishing the burning in the combustion zone or, if not extinguished, of reducing the burn rate and/or intensity due to the presence of the water. Accordingly, care may be needed when selecting the fluid's chemical properties, volume, pressure, and/or injection timing.

While care may be needed with respect to combustion, the suppressant properties of water and/or other fluids may be advantageous in preventing or minimizing the possibility of the burn front spreading through fractures in the formation. Generally, it may be desirable to control the leading edge of the combustion process and prevent the combustion zone from expanding in unwanted directions and/or more rapidly than planned. However, a formation may have fractures of various sizes and, when the combustion fluids enter those fractures, combustion may move rapidly along the fractures rather than remaining in the desired area. This may create inefficiencies in the heat transfer process as heat from the fractures may be more difficult to capture and may result in less consistent burn plans. In addition, there may also be an increase in the likelihood of safety issues and/or the creation of unwanted combustion zones if the fractures lead in the direction of other wells.

In some embodiments, water and/or other fire suppressing fluids may be injected as a safety measure, either proactively or reactively. For example, water injection may be used to support fire control systems instead of, or in conjunction with, the use of nitrogen and/or other fire suppressant systems and responses.

Figure 63A:
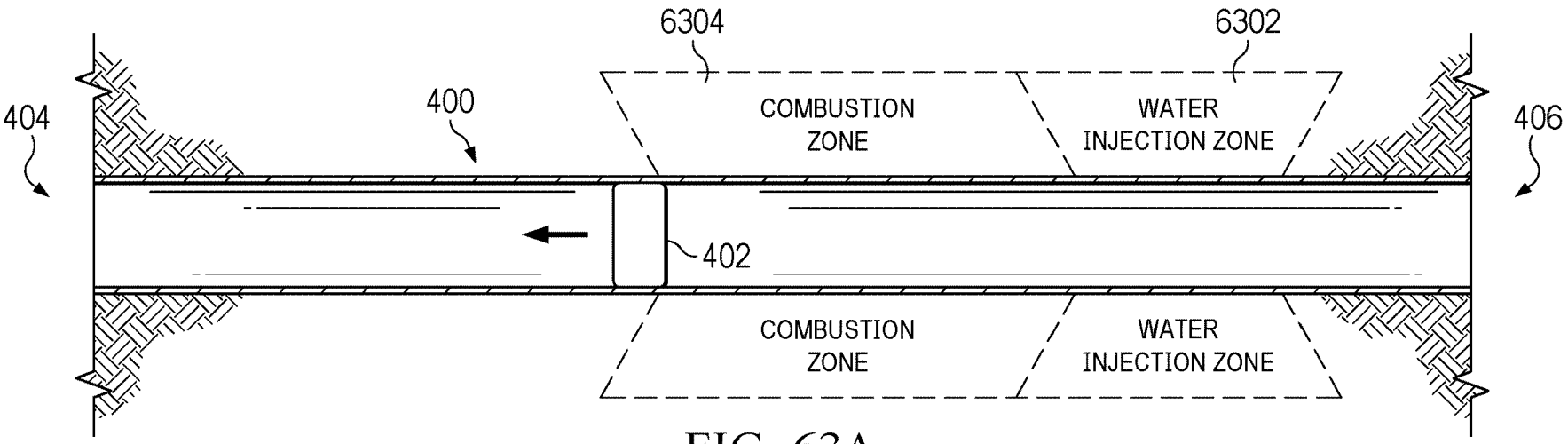
Figure 63B:
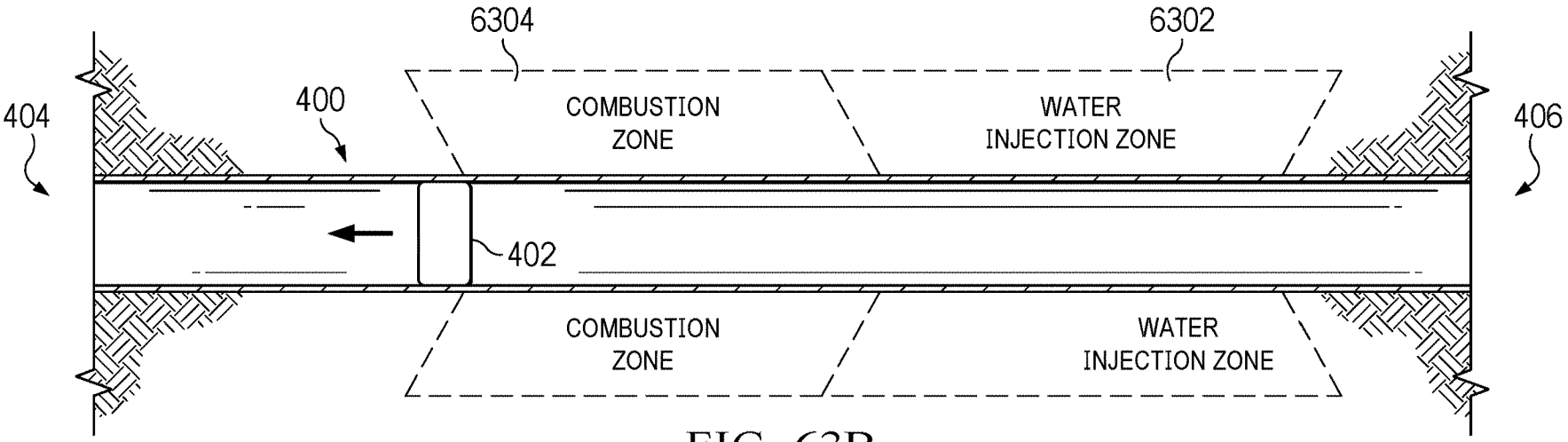

Referring to FIGS. 63A and 63B, in some embodiments, to address the complications of large amounts of water 6302 in the combustion area 6304 and/or to provide additional control over the combustion and thermal transfer processes, the water or other fluid(s) may be injected at a different location along the pipe than the combustion fluids. For example, the water may be injected at one end of the well, such as the toe, and the combustion fluids may be injected at, or closer to, the heel. This allows for additional control and provides for both the use of steam to enhance thermal transfer and the use of water to fill fractures in the formation to minimize the chance that the burn front will spread through the fractures. In this example, fractures near the toe may be filled with water, while the water nearer the combustion zone may be converted to steam.

The particular location(s) for the injection of combustion fluid(s) and water may be based on a number of factors. For example, the distribution of fuel within the formation, the location, dimension, and direction of fractures, the distance to other wells, and similar factors may be used to identify injection points for various fluids. It is understood that the injection points may be different points along the same pipe and need not be separate pipes and/or wells. In such embodiments, the fluid conduits described herein may be used to deliver a particular fluid to a particular area along the pipe.

In other embodiments, the injection process may use one or more additional wells (e.g., an offset well) to inject the fluids in a particular location, such as the water at the toe. An offset well may provide benefits in terms of using a continuous flow of water while lessening the possibility of quenching the fire in the combustion zone, although the fluid conduit system may also be used to provide a continuous flow with proper fluid control.

Referring specifically to FIG. 63B, in some embodiments, the water may be used to "follow" the combustion zone. For example, as the combustion zone of FIG. 63A moves towards the heel 404, the water injection zone may move with it as shown in FIG. 63B. This may result in the water injection zone expanding in size as shown. This may ensure that the water is being injected close enough to the combustion zone for the steam to have the density needed to maintain its role in thermal transfer. It is understood that a balance may be desirable between the pressure resulting from the buildup of steam and the density of the steam to serve as an effective thermal transfer medium. For example, too much steam may cause equipment problems, while too little steam may result in sub-optimal thermal transfer.

In some embodiments, the combustion and water zones may be alternated, with a single zone being switched between combustion fluids and water over time. This switching may be based on time, changes in the amount of heat (e.g., due to the depletion of fuel in an area), and/or for other reasons. Such switching may aid in forcing the movement of fuel through the formation by switching the direction of pressure. In some embodiments, the zones may be switched as the fuel in one zone is depleted and it becomes desirable to force the fire front into the other zone.

Figure 64:
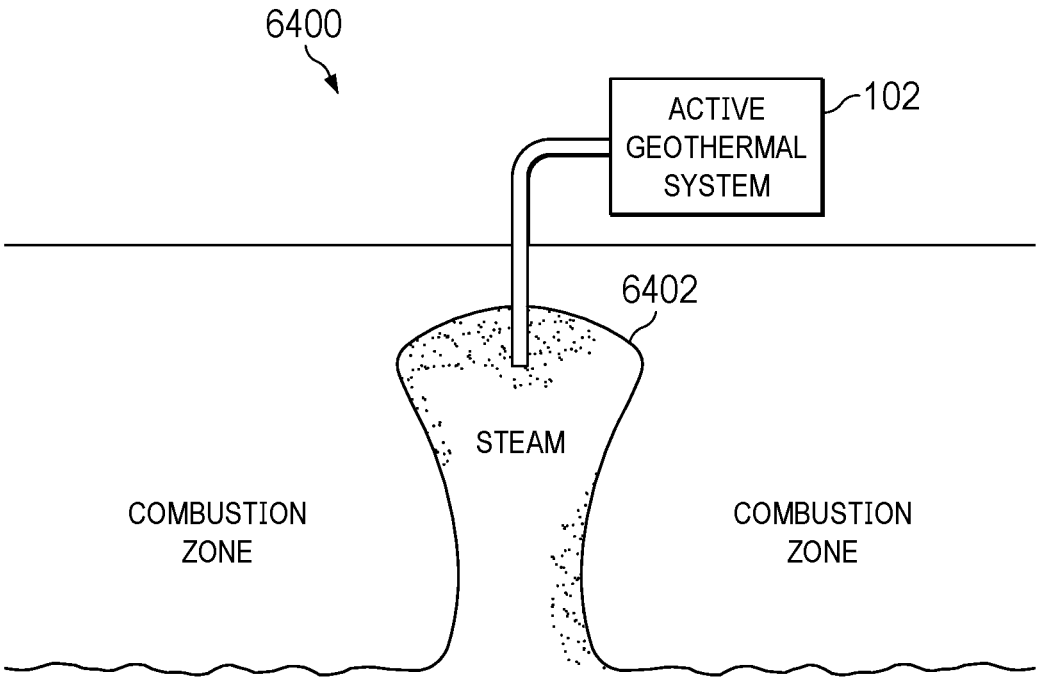
FIGS. 64 and 65 illustrate embodiments of a salt dome and a vertical well, respectively, being used in the creation of steam.
Figure 65:
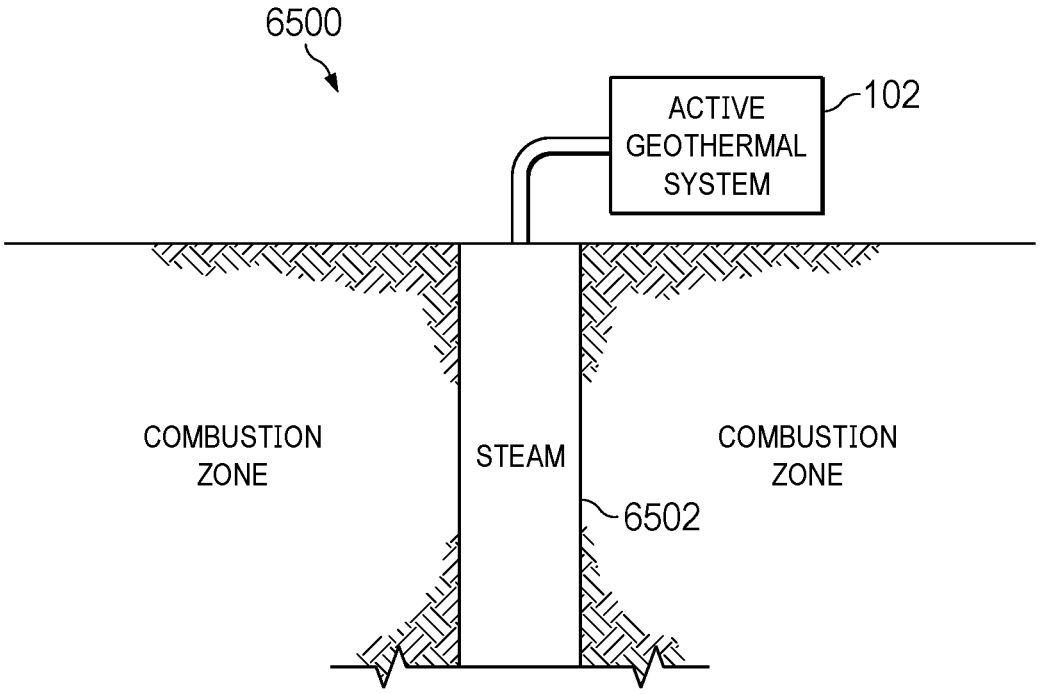

Referring to FIGS. 64 and 65, embodiments of environments 6400 and 6500, respectively, illustrate using water and/or other fluids to create steam within or around a combustion zone. Generally, a particular well may be viewed as having an economic return threshold. As oil and/or other hydrocarbons are extracted from the well, water is also extracted. This water is separated from the oil and may be pumped back into the well. As the well reaches its economic return threshold, the amount of water it produces relative to oil makes further attempts to extract oil no longer worthwhile from a profitability standpoint. At this point, fuel in the surrounding formation may be burned in order to heat the water. This process may be used to obtain energy from depleted wells or wells that are not otherwise economically viable from a conventional energy extraction standpoint. This process may also provide a way to sequester carbon dioxide and/or other gases while extracting additional energy from the wells.

Accordingly, as illustrated by the environment 6400 of FIG. 64, a salt dome 6402 is adjacent to oil, natural or dry gas, and/or other hydrocarbon reserves. Thermal energy may be provided to the edges of the salt dome 6402 by igniting the hydrocarbons as described herein. This creates steam inside the dome from water that is injected into the dome and/or is already present. Heat may then be extracted from the top of the dome and/or other locations. As illustrated in FIG. 65, this process may also be used in an environment 6500 with vertical wells 6502 and horizontal wells (not shown). In such embodiments, the well or dome becomes a pressure cooker where water may be boiled or heated by setting the surrounding fuel on fire. The resulting steam or heated water may be recovered and used for energy, or the heat stored therein may be recovered.

Figure 66:
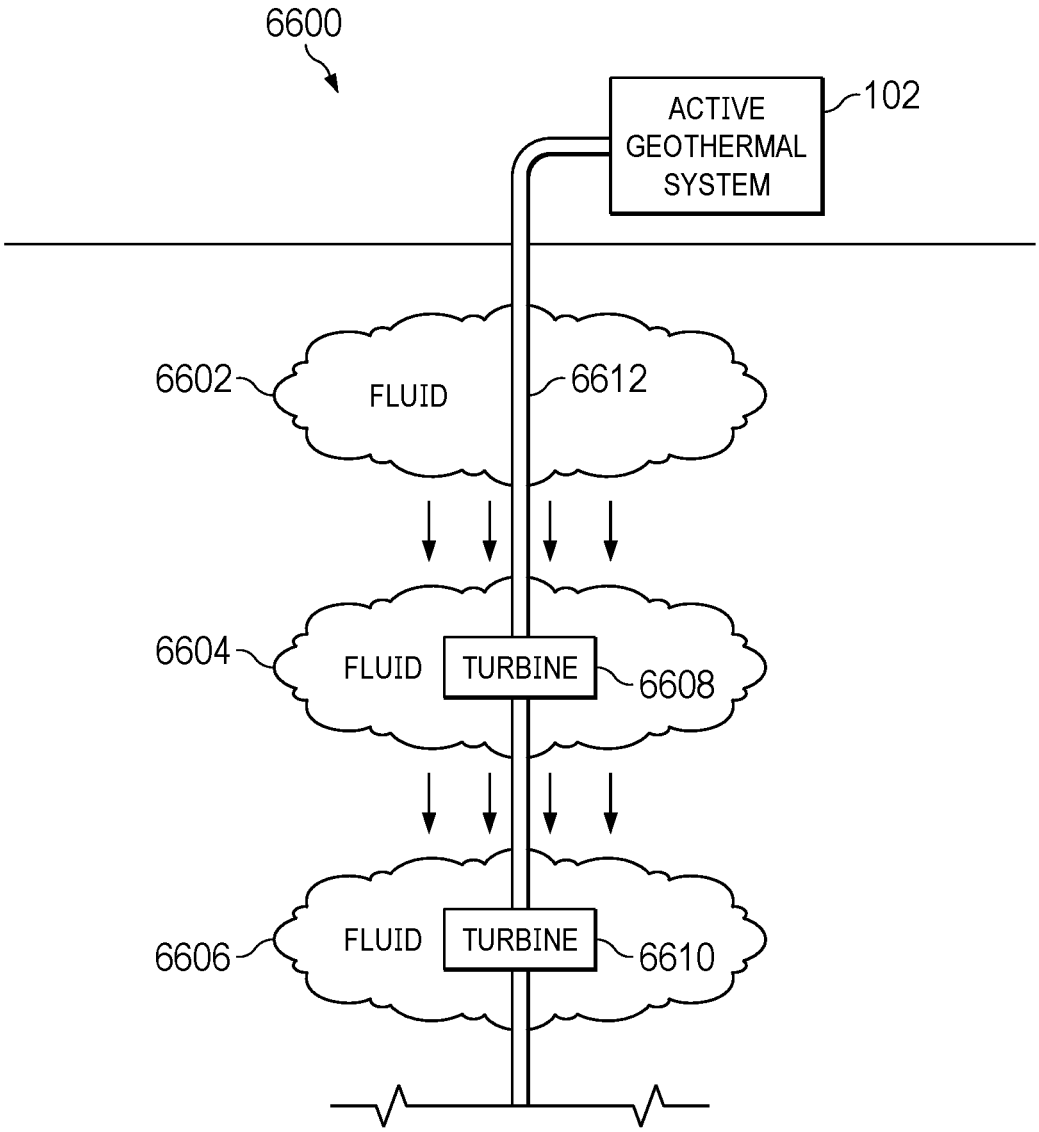
FIG. 66 illustrates one embodiment of the use of fluid displacement to generate power via downhole turbines.

Referring to FIG. 66, one embodiment of an environment 6600 illustrates using fluid reservoirs 6602, 6604, and 6606 to generate power. More specifically, water and/or other fluids may flow downwards due to gravity and/or created pressure. For example, fluid may flow from reservoir 6602 to reservoir 6604 and from reservoir 6604 to reservoir 6606. This fluid movement energizes turbines 6608 and 6610, which may in turn generate power. It is understood that the turbines 6608 and 6610 may be contained entirely within the wellbore 6612. In some embodiments, fluid may be pumped back up to higher level reservoirs to repeat the cycle or fluid being circulated for another purpose may be used for such power generation. It is understood that this process may be reversed in other embodiments, with water moving upward to power the turbines and then cycling down due to gravity and/or pump(s).

Figure 67:
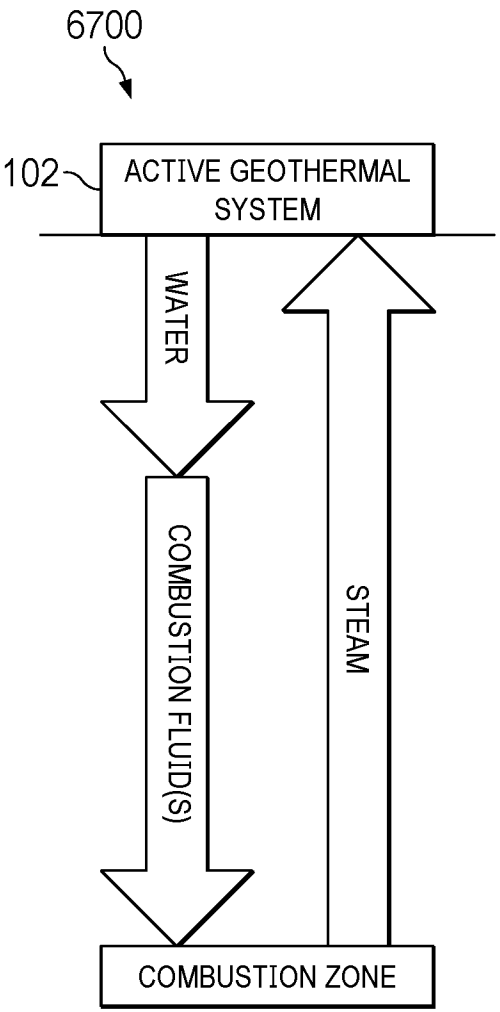
FIGS. 67 and 68 illustrate embodiments of a process whereby different fluids are injected into a well to create steam.
Figure 68:
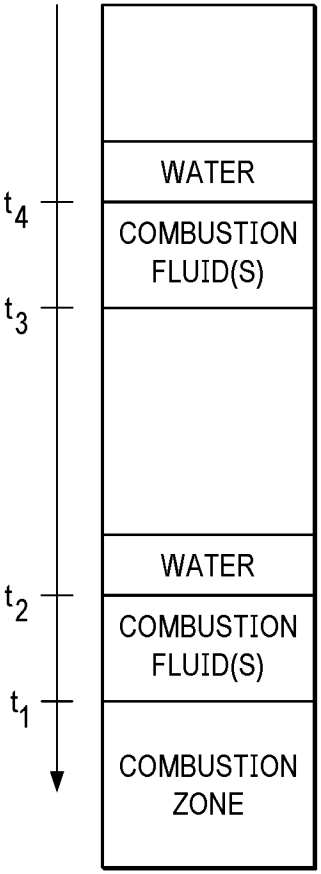

Referring to FIGS. 67 and 68, in some embodiments, a volume of water and/or other fluids may be injected into a well intermittently as shown with respect to an environment 6700. This injection may be separate from an injection of combustion fluid(s) or may be tied to the injection of combustion fluid(s). For example, at a time $t_1$, air may be injected as a combustion fluid at a set volume to combust a set amount of oil in a lateral or vertical well section. The air may be followed with a set volume of water (e.g., a water slug) at time $t_2$. Time $t_2$ may be measured relative to time $t_1$ (e.g., to produce a gap) or may immediately follow time $t_1$. In some embodiments, there may be a continuous or relatively continuous cycling of air and water, or gaps may exist between the injection sets as shown in FIG. 68 with the later injection set at times $t_3$ and $t_4$.

The water may act as a piston to compress the air and fuel mixture. The water may be converted to steam or heated but remain below the boiling point. In either case, the steam and/or heated water may be captured and returned to the surface. It is noted that the volume of water may be calculated to be small enough to not quench the combustion area. In some embodiments, the flow of water may be reversed before it reaches the combustion area to avoid quenching the fire while still allowing the water to be converted to steam.

Figure 69:
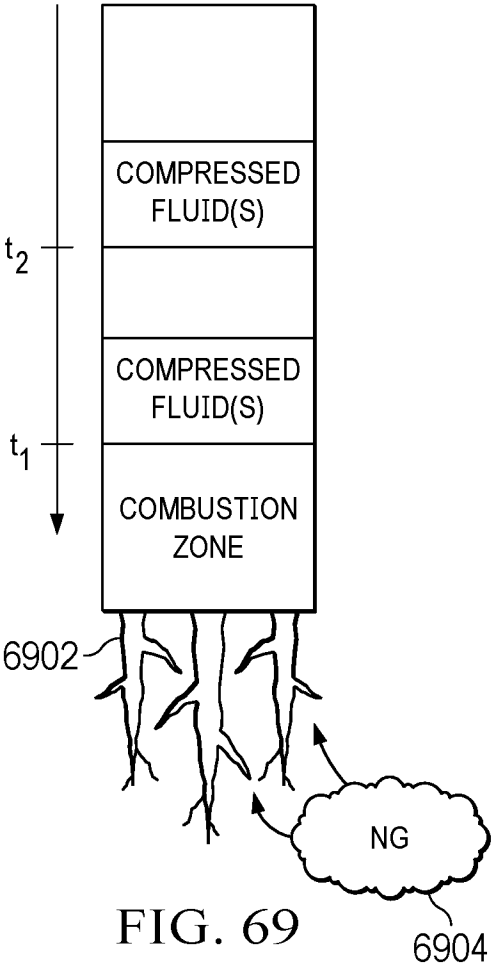
FIG. 69 illustrates one embodiment of a process whereby a compressed fluid is injected in a modulated manner into a well.

Referring to FIG. 69, in some embodiments, due to the heat and pressure in and around the combustion area, fuel (e.g., natural gas or oil) trapped in the formation may be released during the process and burned. For example, pockets of natural gas 6904 may be released into the combustion area as cracks 6902 in the formation propagate due to the heat and/or pressure, and the natural gas feeds into the combustion process. This may provide advantages such as aiding the efficiency of the combustion process, recovering additional fuel from the formation, and sequestering the carbon dioxide resulting from the combustion.

In some embodiments, pressure modulation may be employed to aid this recovery process. For example, compressed air and/or other fluids may be injected in a modulated manner as shown by times $t_1$ and $t_2$. The pressure may provide mechanical energy that aids in propagating fractures 6902 in the formation, releasing additional fuel. By modulating the injection of the compressed air, high and low pressures may be alternated in the combustion area. During the higher pressure created by injection, cracks 6902 may be created and/or extended in the formation. During the lower pressure formed when the injection process is stopped (or reversed in some embodiments), natural gas and/or other hydrocarbons 6904 may be pulled towards the lower pressure area of the combustion zone. Accordingly, modulating the injection of compressed fluids such as air may cause spikes that result in additional fuel flowing into the combustion area and igniting.

In some embodiments, wells with layered resources may use water to affect those resources. For example, a well may have a layer of natural gas positioned above a layer of oil, which is in turn positioned above a layer of water. In such embodiments, the water layer may be heated and/or vaporized to affect the extraction and/or combustion of the natural gas and/or oil layers. Using the combustion processes described herein, the water may be used to create pressure in order to drive the natural gas/oil to the pipe and/or towards another well. Alternatively, the water may be vaporized to add pressure to the natural gas/oil as the natural gas and/or oil are ignited.

Figure 70:
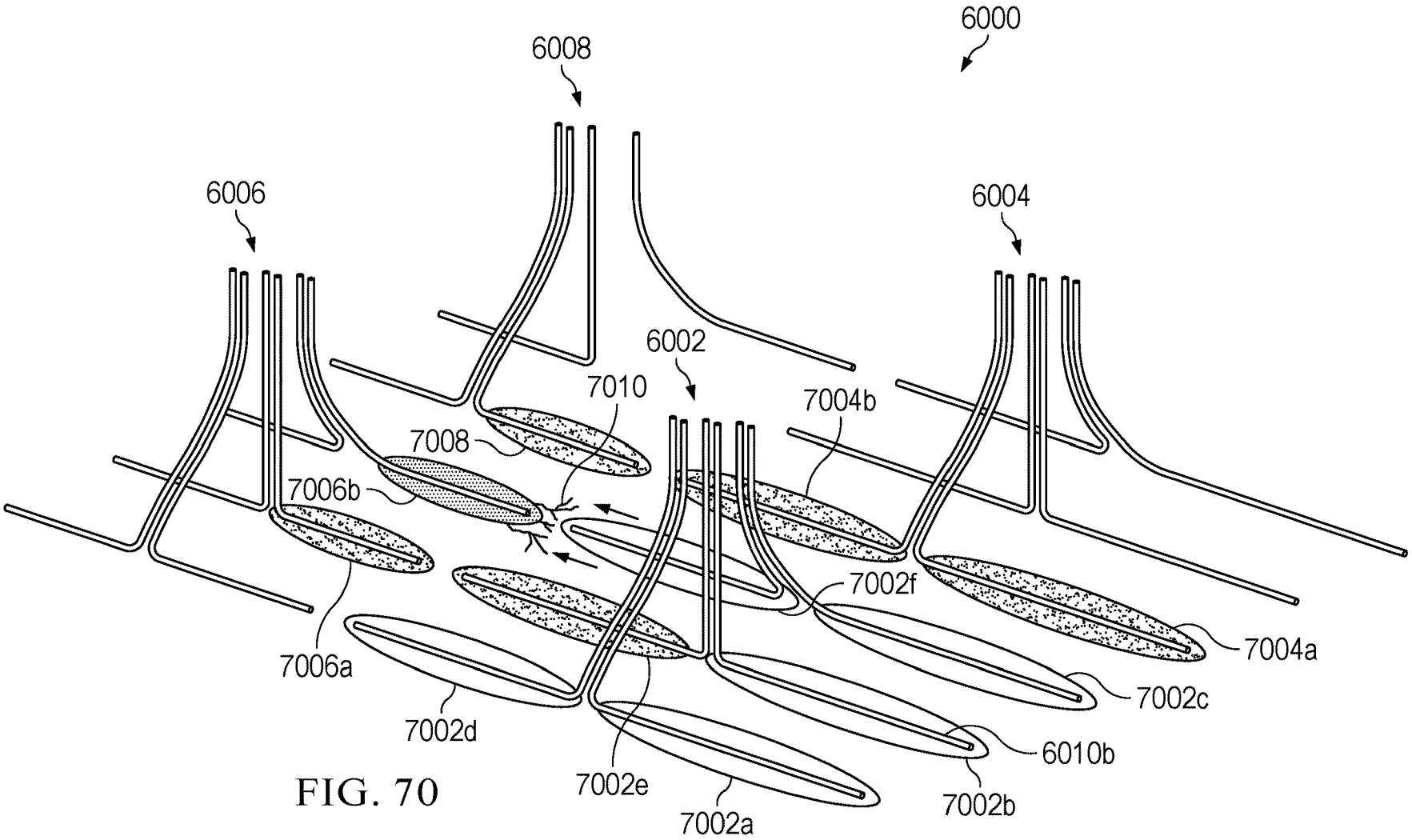
FIG. 70 illustrates one embodiment of the multiple well system of FIG. 60A with different zones used to steer combustion based on the fluid(s) injected into each zone.

Referring to FIG. 70, in some embodiments, various parameters of the combustion zone(s), such as direction and/or intensity, may be controlled using multiple wells within the environment 6000 of FIG. 60A. Although vertical wells are not shown with respect to FIG. 70, it is understood that many different arrangements of wells may be used, including existing wells, new wells drilled for use by the active geothermal system 102, vertical wells, horizontal wells, slant wells, standalone wells, groups of wells, and any combination thereof.

Rather than relying on a single well for use in the delivery of fluids to maximize or minimize combustion along that well, one or more adjacent wells may be used to provide additional fluids. The additional fluids may be injected into the formation from an adjacent well and those fluids may travel through fractures in the formation towards the combustion area. If the fluid(s) serve to support combustion, the combustion zone may move in the direction of the adjacent well and/or increase in intensity. If the fluid(s) serve to suppress combustion, the combustion zone may be directed away from the direction of the adjacent well with the fluid pushing the fuel in the desired direction.

As shown, combustion zones 7002*a*-7002*d* and 7002*f* are currently actively burning. Zones 7002*e*, 7004*a*, 7004*b*, 7006*a*, and 7008 contain combustion suppression fluid(s) that have been injected into the formation via the respective well/branch. As these fluids are pumped into the zones 7002*e*, 7004*a*, 7004*b*, 7006*a*, and 7008, fuel in the formation may be forced towards neighboring combustion zones. As described in previous embodiments, the fluids nearer the combustion zone may turn to vapor (e.g., steam) and aid in transferring heat from the fire front to the pipe in the combustion zone.

Zone 7006*b*, while not ignited, contains combustion fuel that has been injected into the formation via the respective well/branch. These combustion fluids may move towards the combustion zone 7002*f* via fractures 7010. The absence and/or presence of particular fluids in these zones may steer the combustion in zone 7002*f* towards zone 7006*b* and away from zones 7002*e*, 7004*a*, 7004*b*, 7006*a*, and 7008.

Accordingly, adjacent branches/wells may be used to "steer" the combustion zone(s), in addition to performing the safety monitoring described herein. It is understood that the effectiveness of such steering may depend on many different factors, including the size, number, and direction of fractures in the formation, the distance between wells (e.g., effectiveness may increase with more closely spaced wells such as infill wells), the type and amount of fluid(s) used, the injection pressure of the fluid(s), the type and amount of combustion material present in the formation, and/or the presence of non-flammable or more slowly burning formation areas.

Figure 71A:
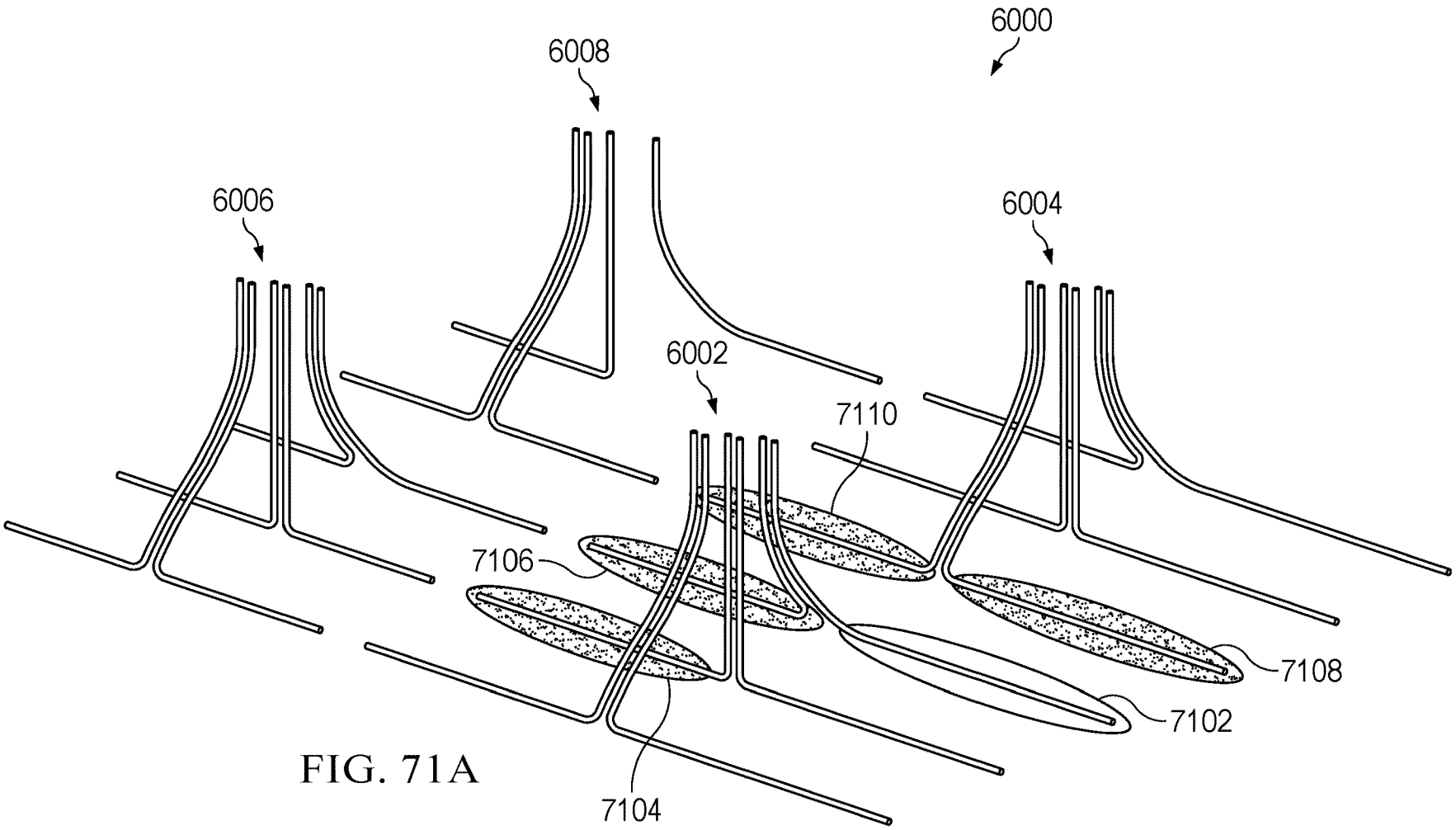
FIGS. 71A and 71B illustrate embodiments of the multiple well system of FIG. 60A whereby different fluids are injected into different zones.
Figure 71B:
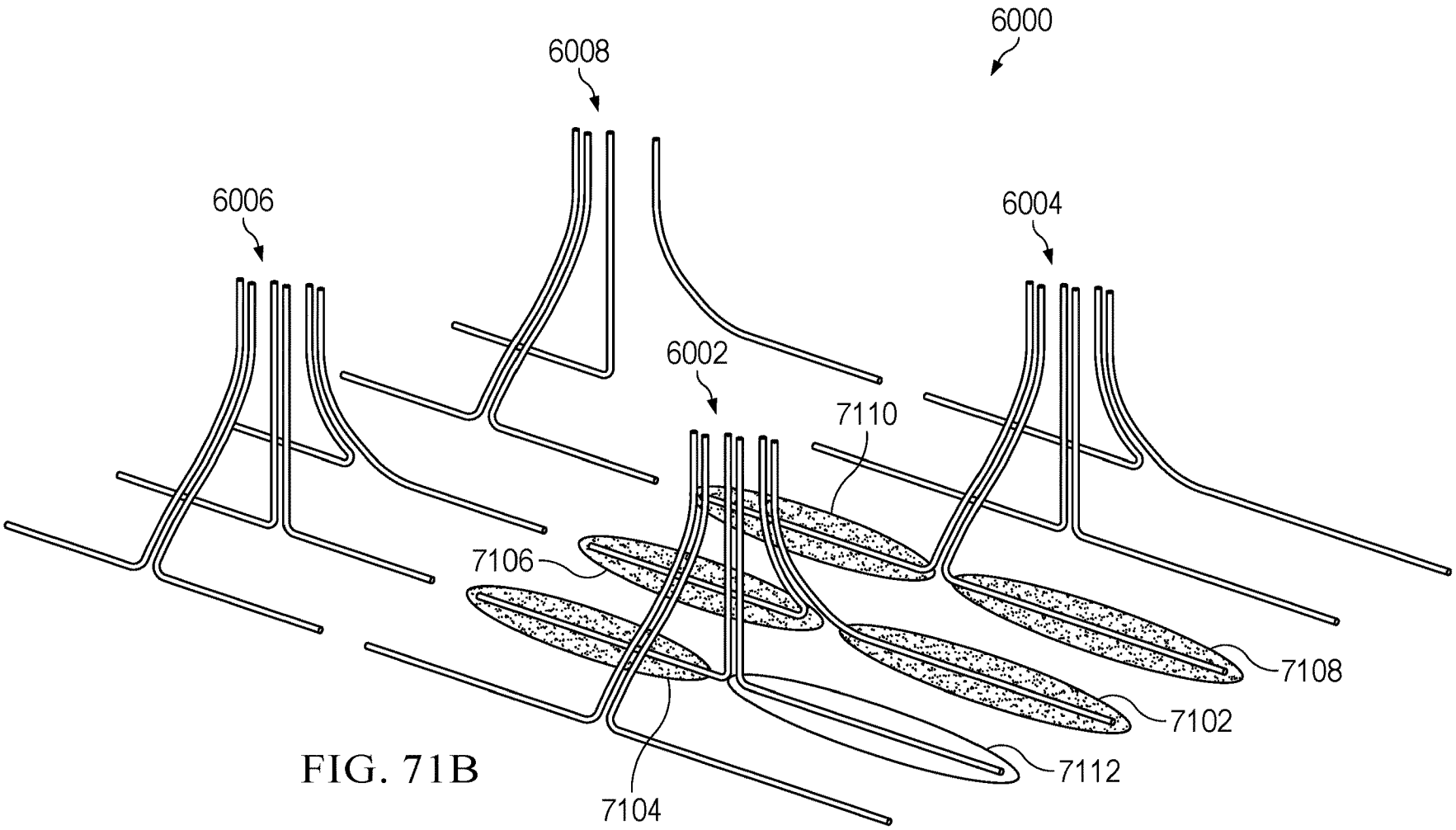

Referring to FIGS. 71A and 71B, in some embodiments, some zones may be used to provide fluid reservoirs for heating by an adjacent combustion zone within the environment 6000 of FIG. 60A. For example, as shown in FIG. 71A, zone 7102 is currently a combustion zone. Adjacent zones 7104, 7106, 7108, and 7110 contain one or more fluids, which is water for purposes of example. The thermal energy produced by the combustion zone 7102 propagates through the formation to the other zones 7104, 7106, 7108, and 7110, heating the water stored therein. The thermal energy transferred to the water may then be extracted as steam and/or heated water via the wells coupled to the fluid reservoirs. As zone 7102 depletes its fuel and burns away from the injection site, the water that reaches the zone from the adjacent zones may be turned into steam and serve as a thermal transfer mechanism as described previously.

As shown in FIG. 71B, as zone 7102 runs out of fuel, zone 7112 may be ignited and zone 7102 may be flooded and used as a reservoir. Adjacent zones may or may not be flooded. For example, the decision to flood or not flood an adjacent zone may be based on various factors, such as distance from the zone generating the thermal energy (e.g., effectiveness may increase with infill wells) and the cost of installing any needed infrastructure weighed against the estimated value of extracted energy.

In some embodiments, the zone that will be the next fire flood zone may be flooded to provide sufficient water for steam purposes. For example, zone 7112 would be flooded using a desired amount of water in FIG. 71A and would then create steam when ignited in FIG. 71B.

In some embodiments, the reservoir fluid of FIGS. 71A and 71B may be a fracking fluid that is heated and then extracted for thermal energy retrieval. In such embodiments, rather than using the fluid solely to serve as a heat transfer aid between the fire front and the heat exchange mechanism(s) of the pipes, the fluid itself may be used to transport thermal energy to the surface. Fluid separation, if needed, may be performed downhole or at the surface.

Figure 72:
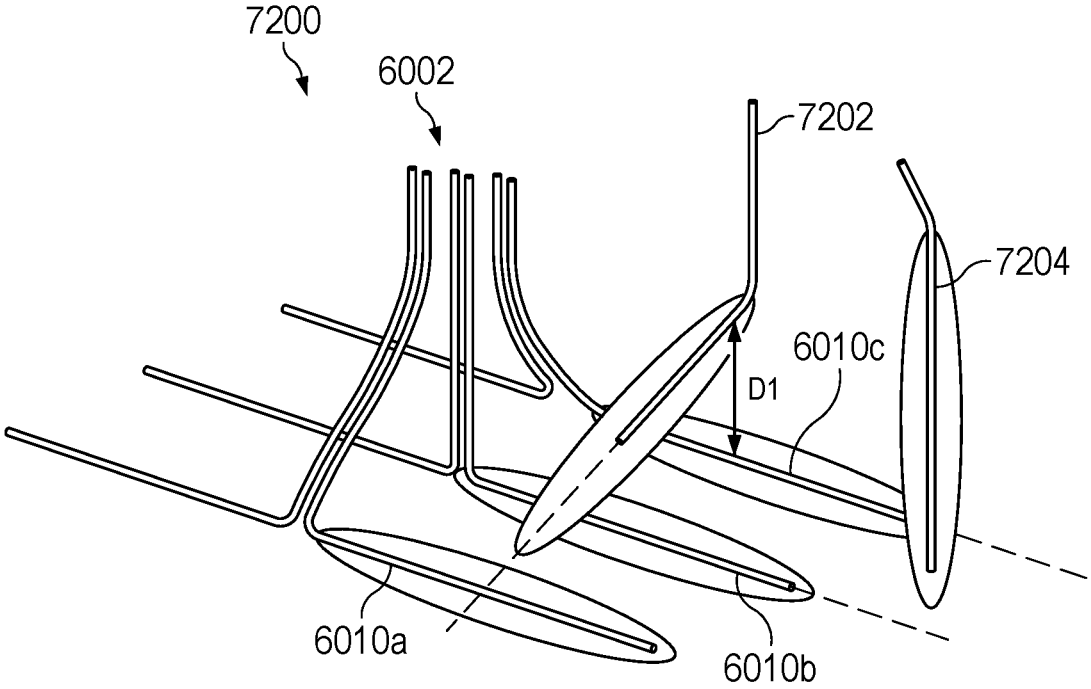
FIGS. 72 and 73 illustrate embodiments of a three-dimensional arrangement of wells.
Figure 73:
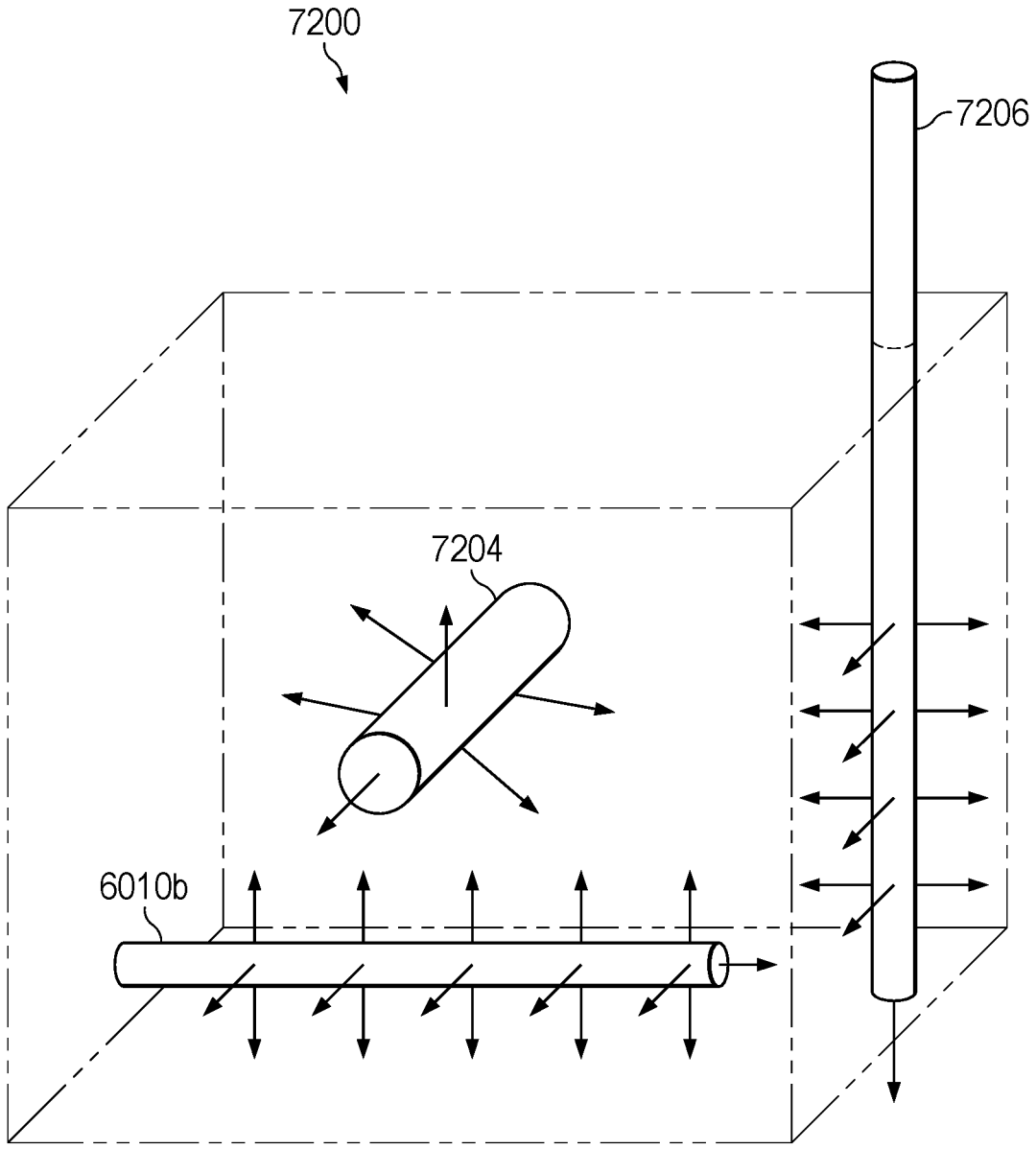
Figure 74:
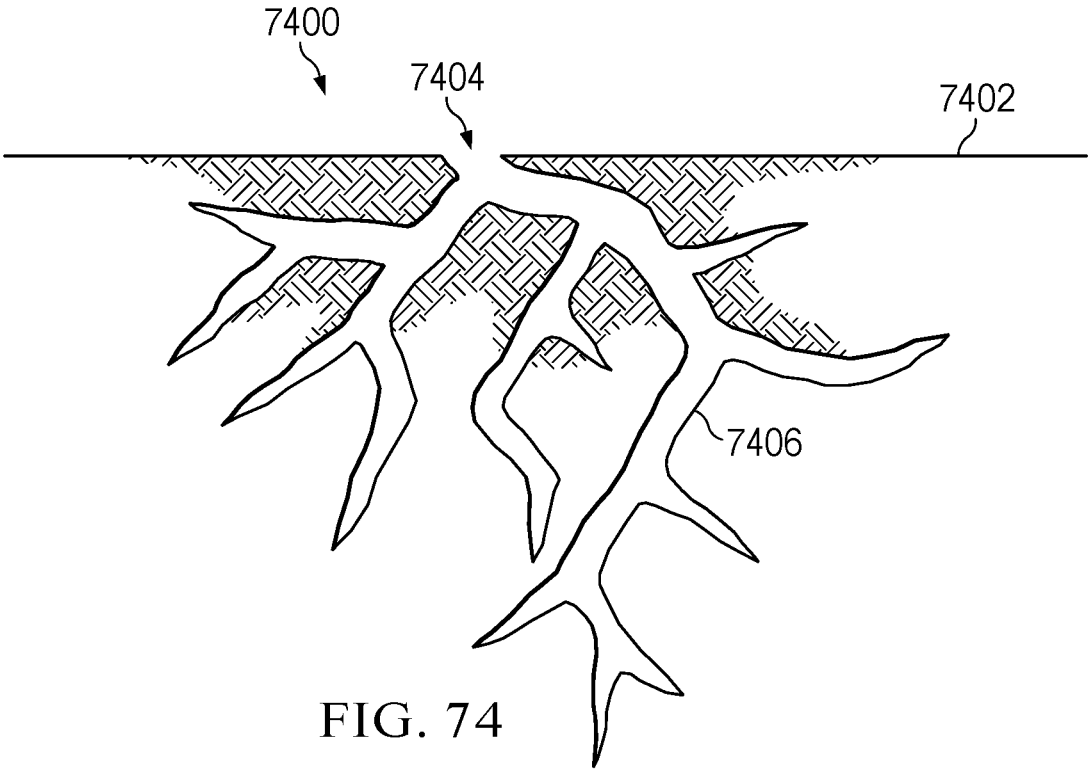
FIGS. 74-77 illustrate embodiments of a fracture in a formation that may be at least partially plugged.
Figure 75:
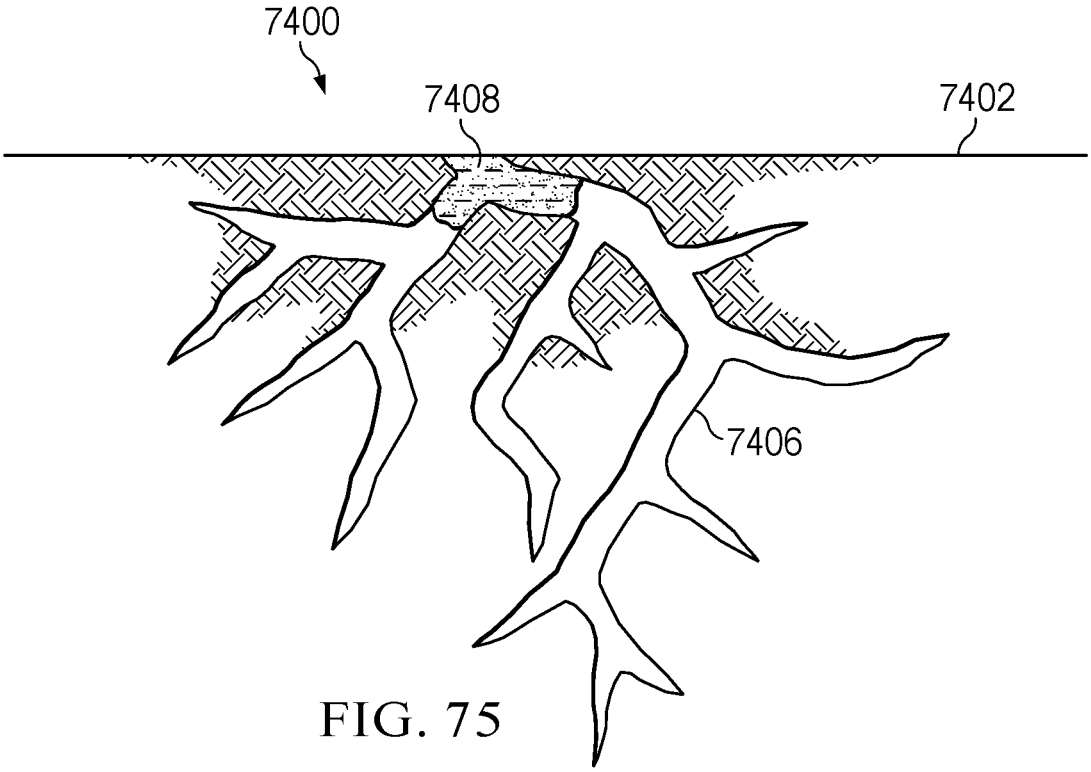

Referring to FIGS. 72 and 73, one embodiment of an environment 7200 illustrates the well 6002 of FIG. 60A in a three-dimensional arrangement with wells 7202 and 7204. In the present example, the horizontal well 7202 crosses above the branches 6010*a*, 6010*b*, and 6010*c*. While the horizontal well 7202 is vertically separated from the branch 6010*c* by a distance D1, the distance separating the well 7202 from the branches 6010*a* and 6010*b* may be more or less than D1. The depth of the vertical well 7204 may be shallower or deeper than some or all of the branches 6010*a*, 6010*b*, and 6010*c*. It is understood that one or more of the wells 6002, 7202, and 7204 may already exist when the active geothermal system 102 is configured to use the wells, and/or one or more of the wells may be drilled specifically for use by the active geothermal system for additional control of the processes described herein.

Each well 6002, 7202, and 7204 may provide a certain level of control over the adjacent area for purposes of combustion, suppression, monitoring, and/or other functions. When all three wells 6002, 7202, and 7204 are viewed as a single control system for the processes described herein, more granular tuning may be performed by individually manipulating each well. For example, the direction and intensity of a fire front, the injection of water, and similar actions may be coordinated across the wells 6002, 7202, and 7204. It is understood that many wells may be coordinated in this manner, and additional wells may be drilled as needed to provide further control. Accordingly, by viewing multiple wells as inputs and outputs for the active geothermal system 102, the processes described herein may be applied to relatively large areas. This may in turn increase the efficiency of the active geothermal system 102.

Referring to FIGS. 74-77, embodiments of an environment 7400 illustrate an opening 7404 in a formation 7402. The opening leads to a series of fractures 7406. Generally, it may be desirable to control the leading edge of the combustion process and prevent the combustion zone from expanding in unwanted directions and/or more rapidly than planned. However, a formation may have fractures of various sizes and, when the combustion fluids enter those fractures, combustion may move rapidly along the fractures rather than remaining in the desired area. This may create inefficiencies in the heat transfer process as heat from the fractures may be more difficult to capture and may result in less consistent burn planes. In addition, there may also be an increase in the likelihood of safety issues and/or the formation of unwanted combustion zones if the fractures lead in the direction of other wells.

Figure 76:
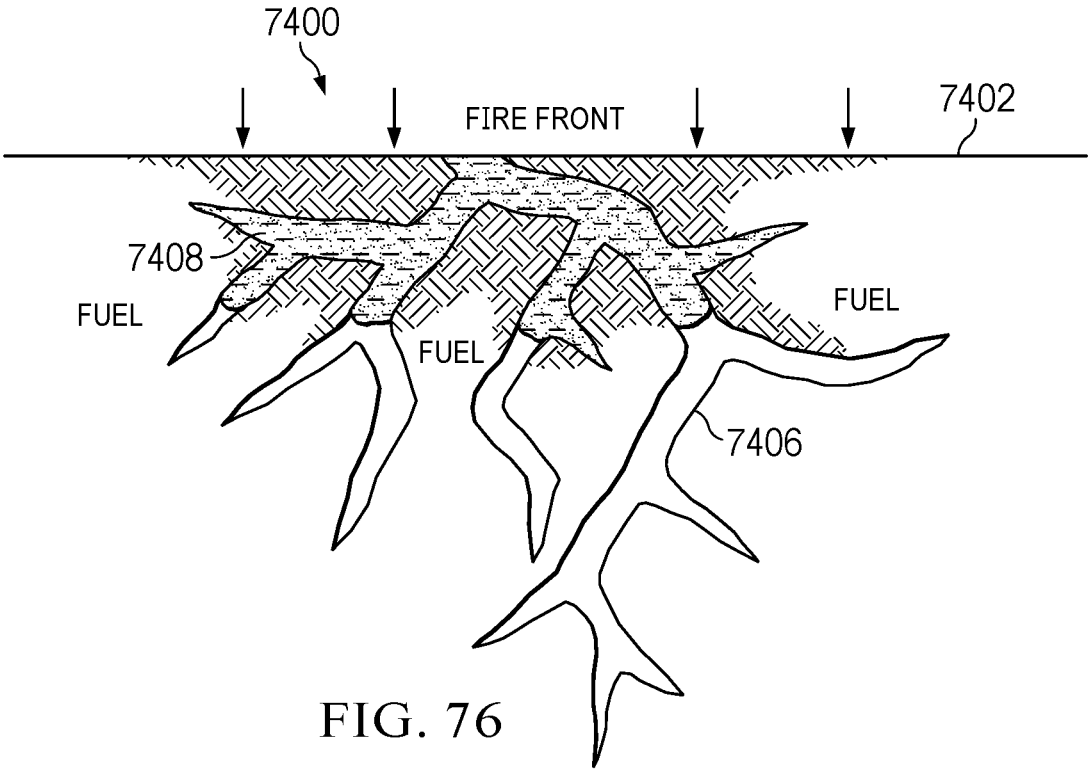
Figure 77:
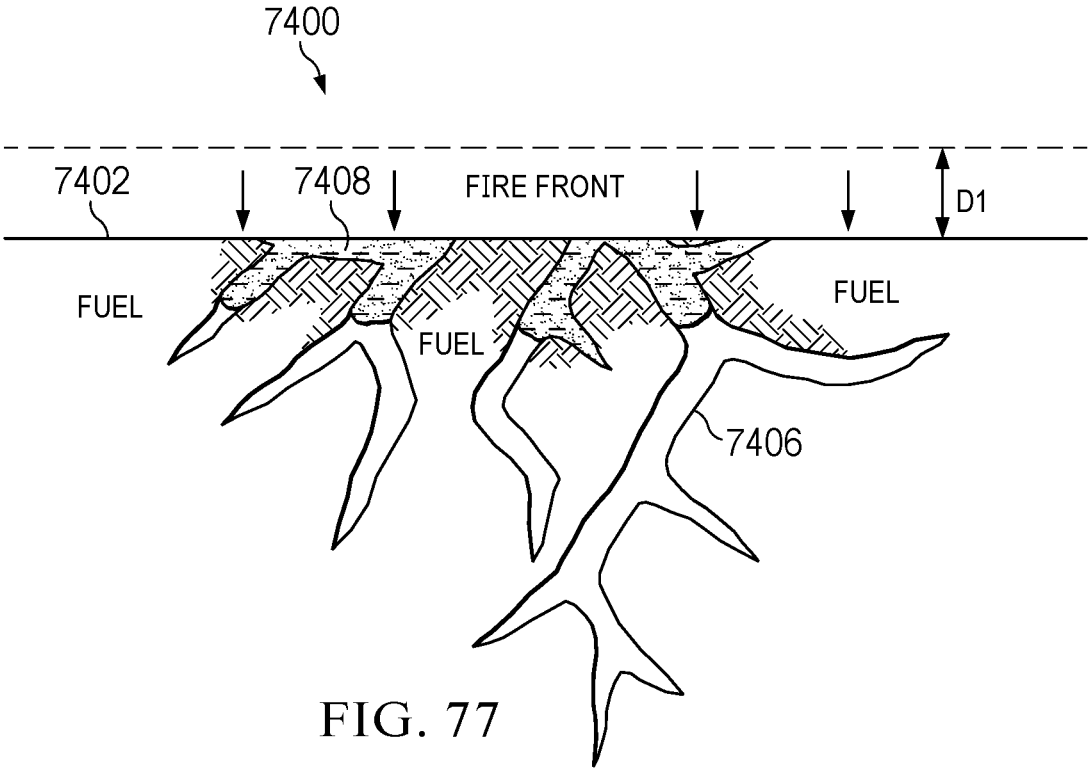

Accordingly, a chemical or chemical mixture 7408 may be injected into the formation 7402 in order to slow the spread of the combustion zone along such fractures 7406. The sealing process may involve a relatively simple plug (FIG. 75) or may be used to push sealant deeper into the fracture (FIGS. 76 and 77). The injection of combustion fluid(s) following the mixture's injection may aid in forcing the mixture into the various fractures. In some embodiments, a compressed fluid (e.g., air) may be used to force the mixture into the fractures before the combustion fluid is used. For example, air may be used as a compression fluid and then oxygen may be injected into the well prior to ignition.

The sealing process may be a single cycle process or multiple sealing cycles may be used. Such cycles may occur before combustion or may be interspersed with combustion cycles in order to seal fractures as the leading edge of the combustion zone moves through the formation. It is understood that some fractures may remain and the amount of sealing that occurs may depend on factors such as the dimensions of the fractures present in the formation, the composition of the mixture, and injection parameters of the mixture (e.g., the amount of mixture, how the mixture is injected and/or forced into the formation, and/or the number of sealing cycles used).

In some embodiments, pressure monitoring may be performed to ensure that the downhole pressures do not exceed what the sealants, whether solidified or in liquid form, can withstand. The detection of pressures above the threshold may result in actions to lower the pressure via reductions and/or other changes in the combustion fluid(s), air pressure, and/or similar inputs, as well as the release of steam and/or the reduction of other downhole pressure sources. Additionally, or alternatively, a different sealant composition may be applied that is able to withstand the higher pressures.

The chemical(s) forming the sealant used for the sealing process may depend on factors such as the formation's composition, the dimensions of the fractures, the type of fuel present in the formation, the expected burn rate, and similar factors. For example, a relatively thick chemical mixture (e.g., a paste) may be injected into the combustion zone before ignition occurs. The mixture may be designed for a particular burn rate. In one example, the mixture may be designed to burn at approximately the same rate as the formation 7402. As the fire front burns through the fuel in the formation 7402, it may also burn through the sealant, as shown in FIGS. 76 and 77 where the burn front has advanced a distance D1 between FIG. 76 and FIG. 77. In another example, the sealant may be designed to burn more slowly than the formation in order to ensure that the formation burns faster than the fractures will be opened.

In other examples, the mixture may be nonflammable (e.g., cement) or may be designed to burn faster than the formation, depending on the particular combustion plan and its parameters. Accordingly, the burn rate of the sealants or retardants may be tuned to achieve a desired result, and the tuning may be based on many different factors.

In other embodiments, the chemical(s) may be injected as pellets or other particulates of various sizes and shapes. Such pellets may become malleable when heated (e.g., wax-like), enabling them to be injected into the fractures and then melted to form a seal. The pellets may have different burn rates or may be nonflammable. Pellet size and shape may depend on such factors as the size of the delivery channel, the dimensions of the fractures, the composition of the pellets, and/or the delivery plan (e.g., how much pressure they must withstand to maintain their shape during delivery).

In some embodiments, the pressure within a producing well may be used for control and/or to drive additional combustion material towards the combustion zone. For example, movement of the burn front via fractures may be the result of pressure differences between the producing well and the combustion zone when the combustion zone is a higher pressure zone than the producing well. By increasing pressure in the production well, the difference in pressures may be offset or minimized, thereby slowing down the spread of the burn front through the fractures. In such embodiments, the pressure may be released occasionally in the producing well to recover hydrocarbons.

In other embodiments, sealants may be injected into the producing well, as described above with respect to fractures. In still other embodiments, the producing well may be fractured or refractured to create a pressure barrier between the producing well and the burn front. In some embodiments, it may be desirable to increase the pressure in the producing well in order to force fuel towards the burn front.

In some embodiments, it may be desirable to intentionally ignite the fuel near the tip of a fracture, as well as at the casing. This may result in pressure that pushes the oil and heat back towards the injection well. This may be accomplished in a single well or in wells that are relatively far apart, so breakthrough is not a concern.

Figure 78:
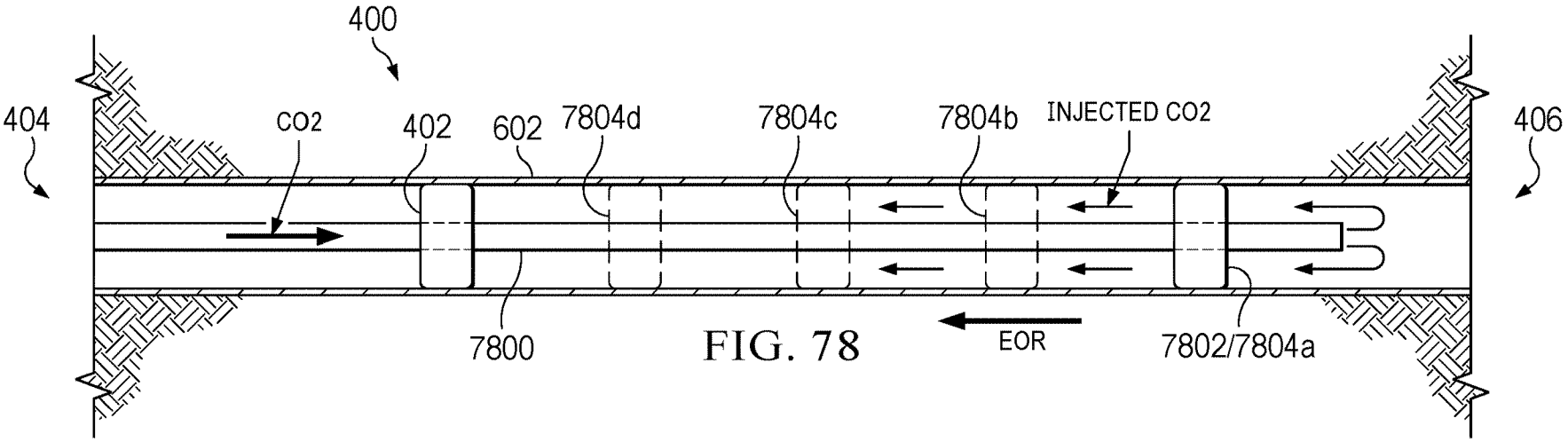
FIGS. 78 and 79 illustrate embodiments of a pipe within which carbon dioxide may be injected (FIG. 78) or created (FIG. 79)
Figure 79:
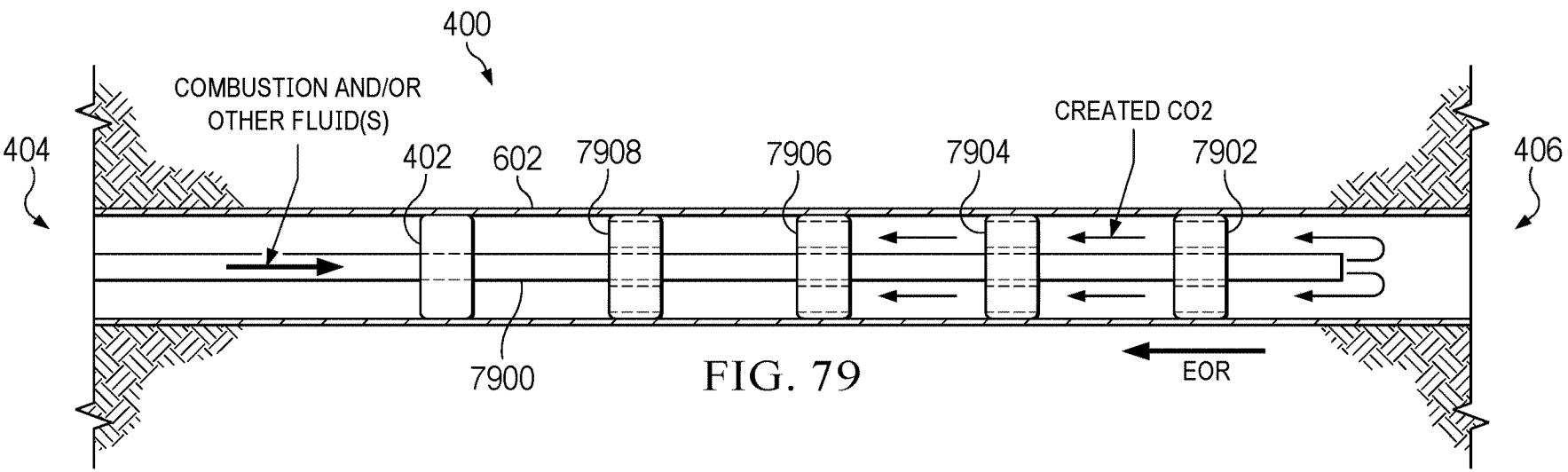

Referring to FIGS. 78 and 79, embodiments of a pipe section 400 within which carbon dioxide may be injected (FIG. 78) or created (FIG. 79) in order to facilitate EOR flow for a single well are illustrated. It is understood that both injection and creation may be used in a single embodiment, and that fluids other than, or in addition to, carbon dioxide may be injected and/or created. In the present example, rather than using formation combustion to create pressure for enhancing EOR flow, the injection and/or creation of carbon dioxide and/or other fluids may be used to create pressure.

As shown in FIG. 78, carbon dioxide may be pumped into the vertical and/or lateral portions of a well via fluid conduit 7800. Although only a single fluid conduit 7800 is shown for purposes of example, it is understood that additional fluid conduits may be used to deliver fluid(s) downhole and/or to move fluid(s) towards the surface. One or more plugs 402 and 7802 may be used to control the pressure of the carbon dioxide within the pipe 400 (e.g., by controlling the location of the carbon dioxide within the pipe and the size of the area into which it is pumped) and/or to prevent leakage and thereby improve sequestration of the carbon dioxide. By injecting carbon dioxide into the well, the carbon dioxide may be sequestered underground and, as the pressure may increase EOR flow, the process of sequestering the carbon dioxide may provide utility.

The plug 7802, which may be located at a position 7804*a*, may be moved towards the heel 404 as needed, as shown by positions 7804*b*, 7804*c*, and 7804*d*. By moving the plug, the portion of the pipe 400 into which the carbon dioxide is injected may be controlled. This movement may be used to provide control over the pressure exerted by the carbon dioxide and to allow the pressurized zone to expand towards the heel 404 as the EOR process pushes the hydrocarbons along the well. One or more plugs, such as the plug 402, may serve as barriers to minimize or prevent leakage of carbon dioxide out of the well. Alternatively, or in addition to controlling plug movement, the number of plugs and/or the distance between plugs may be used to control pressure and/or to prevent leakage.

As shown in FIG. 79, combustion fluid and/or other fluids may be pumped into the vertical and/or lateral portions of a well via fluid conduit 7900. Although only a single fluid conduit 7900 is shown for purposes of example, it is understood that additional fluid conduits may be used to deliver fluid(s) downhole and/or to move fluid(s) towards the surface. In the present example, air may be pumped into the well and mixed with natural gas from the well and/or from other wells. This mixture may be ignited within the pipe 400 and/or wellbore to create carbon dioxide. By igniting the mixture within the well, the carbon dioxide created by the burning fuel may be used beneficially to increase EOR flow while remaining sequestered within the well.

Rather than moving one or more plugs as shown in FIG. 78, the present example illustrates the use of multiple stationary plugs 7902, 7904, 7906, and 7908. The plugs 7902, 7904, 7906, and 7908 may include valves that can be controlled to allow fluid to pass through the valve to the next section. For example, the plug 7902 may include one or more valves that are initially closed. As the pressure between the plug 7902 and the toe 406 builds, one or more of the valves may be opened or partially opened, allowing the carbon dioxide to move into the space between the plug 7902 and the plug 7904. This process may be repeated as needed, with valves being opened in plugs 7904, 7906, and/or 7908 to expand the area available to the carbon dioxide.

As with the movement described with respect to FIG. 78, the valve(s) may be used to provide control over the pressure exerted by the carbon dioxide and to allow the pressurized zone to expand towards the heel 404 as the EOR process pushes the hydrocarbons along the well. Alternatively, or in addition to controlling the valves, the number of plugs and/or the distance between plugs may be used to control pressure and/or to prevent leakage.

Referring again to both FIGS. 78 and 79, it is understood that one or more of the plugs 7902, 7904, 7906, and 7908 of FIG. 79 may be movable as described with respect to the plug 7802 of FIG. 78, and the plug 7802 of FIG. 78 may have one or more valves as described with respect to the plugs 7902, 7904, 7906, and 7908 of FIG. 79. Furthermore, carbon dioxide and/or other fluids may be injected into and/or created in isolated areas, such as between the plugs 7904 and 7906, without being injected into and/or created in other areas. Accordingly, many different combinations and types of plugs and/or valves may be used to control the location(s), pressure(s), and movement of the fluid(s).

Generally, carbon dioxide may need to be released if it builds up downhole enough to suppress the combustion zone. Such intentional release need not be into the atmosphere, but can be a directed release to a storage facility, directed for use as a pressure source, injected into a pipeline, and/or dealt with using other mechanisms. Carbon dioxide may be released in a directed manner to power a turbine or other generator, with the carbon dioxide captured after moving past the turbine. If carbon dioxide migrates with hydrocarbons during an EOR event, such carbon dioxide may be separated and captured at a producing well.

Figure 80:
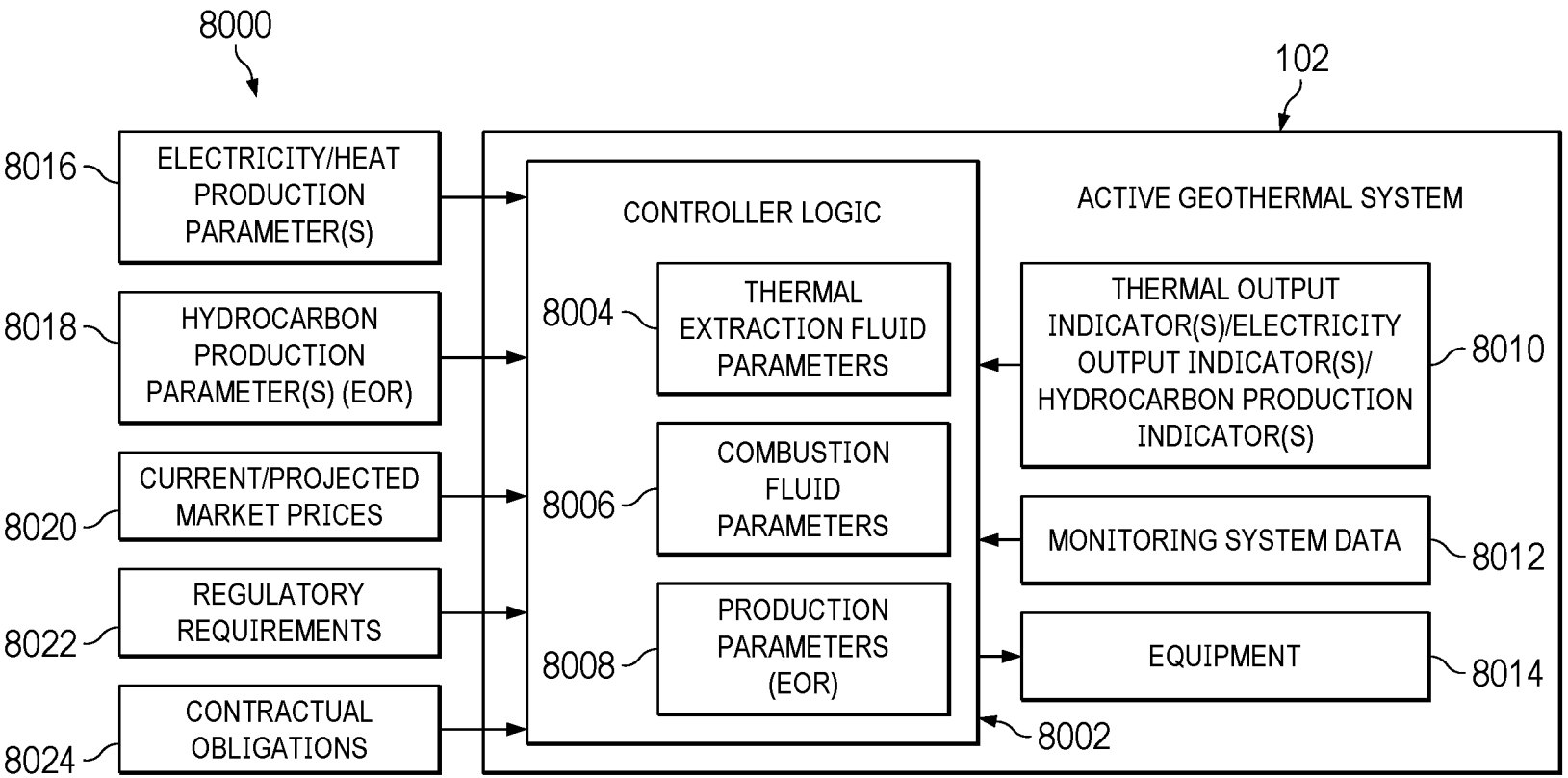
FIG. 80 illustrates one embodiment of a control flow that may be used to regulate one or more combustion zones.

Referring to FIG. 80, one embodiment of a control flow 8000 is illustrated that may be executed by the active geothermal system 102 of FIG. 1 to regulate combustion within a borehole or across multiple wells, such as combustion of one or more of the branches in FIGS. 60A-60D using equipment 8014 (e.g., pumps 202 and/or other components of FIG. 2). Generally, the control flow 8000 may be used to balance the flow rate(s) and mixture(s) of oxygen, air, and/or other fluids 8006 that support the combustion process, downhole pressure(s) (which may involve increasing or reducing pressure downhole), downhole humidity and/or other fluid presence measurements (which may involve using a mister or other humidity management device), the flow rate(s) and mixture(s) of one or more fluids (liquid or gas) 8004 being used to capture and transport the heat to the surface for conversion to energy, storage, or direct use, the location(s) of the fire front, and, if applicable, one or more production parameters 8008 for EOR activity. Some or all of these parameters may be individually manipulated to control fire front progression by increasing, maintaining, or decreasing the environmental factors that impact combustion. In any example herein describing a burn zone, thermal zone, burn front, fire front, and/or similar references, the location, intensity, and/or other parameters of the fire front or other references may be estimated and/or monitored relative to the current well, one or more other (e.g., adjacent) wells and/or other surface and/or subterranean locations, and such detection may use any type(s) of sensor technology and sensing methods.

The control flow 8000 may be applied to a single well, a single branch within a well, or multiple wells. Accordingly, the active geothermal system 102 may take into account many different factors when determining whether one or more combustion zones are producing a desired target result. Optimization may be performed by controller logic 8002 (which may be part of control system 218) based on desired output indicators 8010 representing desired thermal outputs, electrical outputs, and/or production targets using EOR. Data 8012 from monitoring system 212 may also be used. For example, such data may be used to monitor downhole temperatures in order to avoid temperatures that may compromise the structural integrity of downhole components. Air flow and other relevant factors may be taken into account in order to produce mathematical models. Although not shown, data from safety system 214 may be used to trigger recalculations if emergency action is taken or to proactively adjust operations based on safety forecasts of increasing pressures and/or other potential problems.

The optimization may account for desired production parameters for electricity/heat 8016 and desired production parameters for hydrocarbons 8018. The optimization may also account for the value of produced electricity/heat versus the value of hydrocarbons extracted through the application of EOR. For example, if monitoring indicates the EOR of a well due to combustion is higher than expected, the combustion process may be modified to optimize EOR at the expense of thermal energy output. However, if monitoring indicates the EOR of a well due to combustion is lower than expected, the combustion process may be modified to optimize thermal energy output at the expense of EOR. The optimization may also take into account different parameter priorities. For example, if a desired electrical or heat output value is to be maintained, the optimization may balance the inputs to optimize EOR while maintaining the electrical or heat output value.

The prioritization of EOR versus thermal energy output may be based on many factors, including current and projected market prices 8020 for electricity, heat, and extractable hydrocarbons. Environmental and other regulatory requirements 8022, contractual obligations 8024, and other factors may also be taken into account by the active geothermal system 102 when determining how to regulate the ignition and thermal range of a potential combustion zone, as well as the maintenance of existing combustion zones.

In some embodiments, one or more parameters may be monitored and/or regulated to minimize or eliminate thermal shock. For example, igniting the combustion zone with maximum levels of combustion fluids may cause fatigue to the materials forming the outer tube and/or fluid conduits due to the relatively rapid increase in temperature from the formation's ambient temperature to the combustion temperature. Accordingly, it may be desirable to ignite and/or control the temperature within the combustion zone more slowly to enable the materials to adjust over a greater span of time. Such parameters may be adjusted based on the type of materials, the expected heat differential, and/or similar factors. Thermal control valves and/or other devices may be used to mix hot and cold water in order to regulate heat levels within certain parts of the active geothermal system 102. Such devices may operate on a temperature differential or may be set to provide a desired temperature.

Figure 81:
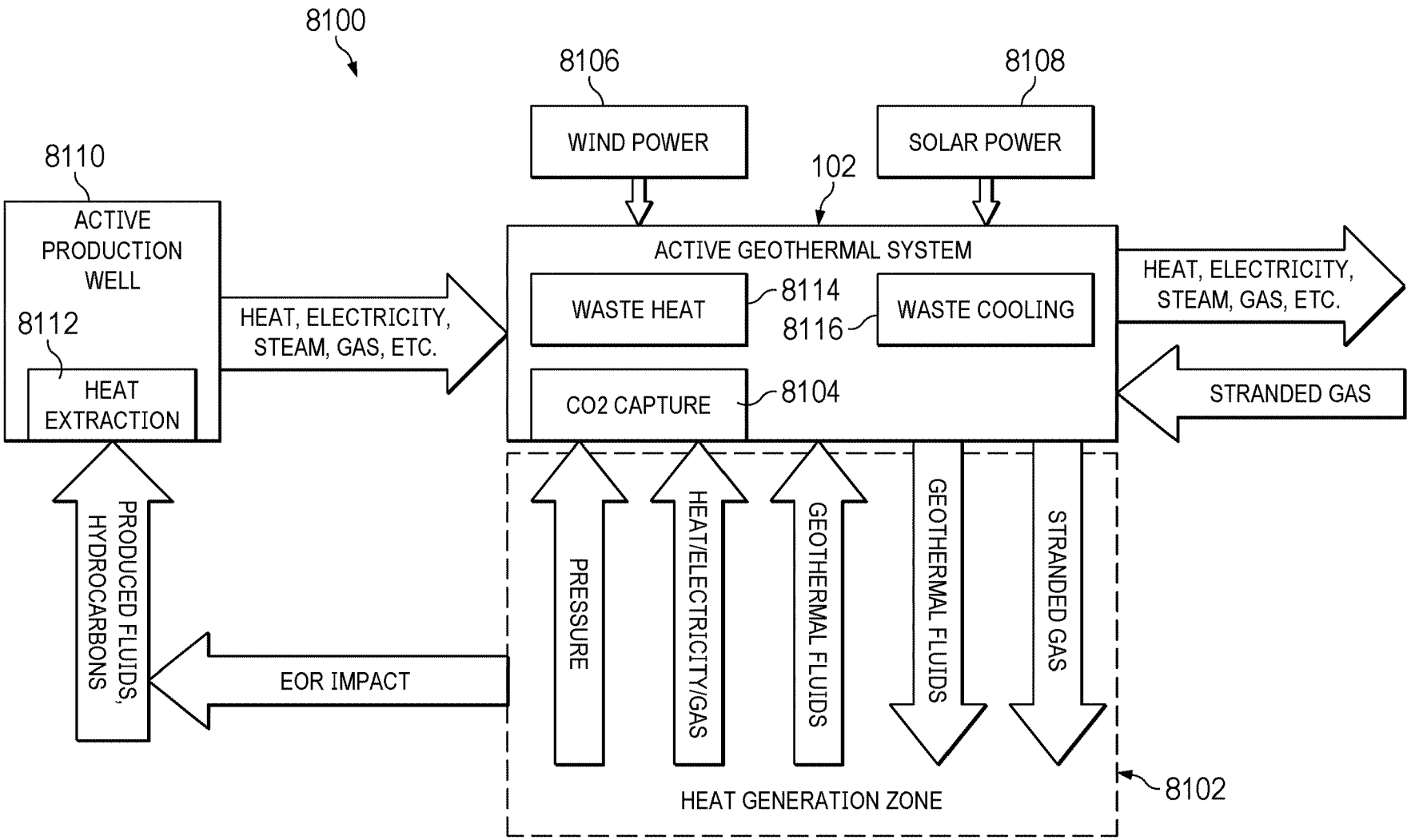
FIG. 81 illustrates one embodiment of an environment within which the active geothermal system of FIGS. 1, 2, and 80 may be used.

Referring to FIG. 81, one embodiment of an environment 8100 illustrates various inputs and outputs that may be associated with the active geothermal system of FIGS. 1, 2, and 80. In the present example, the active geothermal system 102 injects geothermal fluids into the ground to create a heat generation zone 8102. The active geothermal system 102 may extract pressure, heat, electricity, and/or gas from the heat generation zone 8102 as described herein. A carbon dioxide capture process 8104 may be used to isolate and sequester or use downhole carbon dioxide.

In some embodiments, the active geothermal system 102 may be configured to match the temperature control to green energy sources such as wind power 8106 and solar power 8108. For example, a solar panel array may be installed at a well site and used to raise the temperature of the active geothermal well to compensate for lack of sun at night or on cloudy days. Wind power may similarly be used. Such energy sources may be used to provide the active geothermal system 102 with an adaptive base load that works in concert with green energy on the surface to maximize the life of the active geothermal fuel consumption. The parameters of a particular solar/wind generation implementation may be based, for example, on total economics in both the planning stage and in active use to maximize profit.

In some embodiments, heated hydrocarbons and/or produced fluids such as water (e.g., resulting from the EOR impact caused by the heat generation zone 8102 on an active production well 8110) may undergo a heat extraction process 8112, with the resulting heat being passed to the active geothermal system 102. It is understood that the heat may be transferred as heat or may be converted to another form of energy before being transferred. The heat (or other form of energy) may be used by the active geothermal system 102 as an output or may be used to further the active geothermal process. In other embodiments, the heat or other form of energy may be transferred directly from the active production well 8110 without passing through the active geothermal system 102.

The pressure from downhole (e.g., extracted using the fluid conduit 1002 of FIG. 10) may be used to generate power. The downhole pressure may be released for safety reasons or the active geothermal system 102 may be configured to balance the economic value of pressure generation potential energy versus EOR value. Such a balance may be proportionally changed throughout the process. Furthermore, thermal production may be varied based on load demands or price advantaged markets to increase the temperature when power prices rise and lower the temperature when power prices drop.

When extracting pressurized gas from downhole, the oxygen/air may be modulated or even turned off based on the current mode. For example, rather than pump oxygen downhole only to have it returned via the pressure release or fluid conduit, oxygen may be injected and given enough time to be used in combustion before the pressurized gas is extracted. Staggering the injection of oxygen/air with the capture of pressurized gas may increase the efficiency of the overall process. Additionally, or alternatively, a flow loop balance (with or without check valves) may be used to minimize the waste of injected oxygen while still enabling the capture of pressurized gas. For example, oxygen/air may be injected into a particular portion of the available combustion zone and pressurized gas may be extracted from a different portion.

In some embodiments, the gas or gases being pumped downhole may be modulated to create a more desirable released pressurized gas. For example, a gas mixture may be selected that will have an advantaged chemical reaction downhole due to the temperature/pressure while still fueling the combustion.

In some embodiments, power generation and steam generation may be run as parallel tracks in an energy system, with the input of each track separately controlled in order to achieve a desired result. For example, the active geothermal system 102 may use the pressure release from the plug 402/fluid conduit 1002 and/or the heat energy (e.g., geothermal) as inputs in tandem and/or may run a compressor that feeds the air/oxygen down the borehole. It is understood that such a system, as with other systems described herein, may be modular, with particular sub-systems selected for use depending on the implementation parameters of a particular deployment.

In some embodiments, waste heat 8114 may be created while compressing the fluids (e.g., gas, oxygen, and/or air) that are pumped downhole and/or during other processes. For example, compressors (not shown) on the surface may generate waste heat 8114 during the compression process and that heat may be sent to another process (e.g., a Stirling or Rankine system process) to generate power. Additionally, depending on how carbon dioxide and/or other gases are released by the active geothermal system 102, waste cooling 8116 may be created during the pressure drop. This waste cooling 8116 may be used to create a larger temperature delta for the energy production system.

In some embodiments, heat generated by flaring may be used as additive heat for the active geothermal process. In addition, compressors and other equipment used by the active geothermal system 102 may be run using producing well gas on the pad or in the area, as well as run using power generated by the geothermal process itself.

In some embodiments, stranded gas may be recovered and injected into the active geothermal system 102. Stranded gas represents commonly produced gas volumes in the area of oil and gas wells that cannot be taken to market easily or economically. For example, an oil well may produce gas as a byproduct of oil production, but no gas pipeline infrastructure is yet available or the gas is not of sufficient volume or value to warrant the capital expenses involved in putting such a pipeline in place. Additionally, a pipeline may be blocked for legal or political reasons. Traditionally, such circumstances would often result in this gas being flared or burned off at the well. Not only is this wasteful, but regulations, such as environmental regulations, may make it difficult or impossible to burn off this excess gas by way of flaring.

Accordingly, with the active geothermal system 102, this stranded gas may be pumped down into the reservoir and combusted, adding to the heat and EOR capacity of the active geothermal system 102 while sequestering the carbon dioxide and/or other gasses that are generated by the combustion process. The stranded gas may be merged or mixed with other fluids (e.g., combustion fluids) and directed into the fluid conduits or may be injected into the well using a dedicated feed path. This process provides a way to extract the economic value of the stranded gas without needing extensive pipelines and, at the same time, aids in maintaining a positive environmental footprint.

The determination on whether to recover and/or use stranded gas may be based on many different factors. For example, a basic consideration may be whether it is more valuable to take the stranded gas to market or to burn the gas and sequester the carbon dioxide in the ground. Such a consideration may take into account the current and estimated value of the gas with cost to market, the value of carbon credits and costs, the value of burning the gas at the surface to generate heat for the geothermal process or to power an engine to run a compressor, and even the public perception of such actions.

In some embodiments, the active geothermal system 102 may be used for desalination, either as a side-process of geothermal energy extraction or as the main function of the system. Due to the temperatures at which the active geothermal system 102 may operate, desalination of salt water may occur using a distilling process as the water is being circulated through the system. This may be accomplished with minimal or no loss of potential energy by the surface equipment. Steps may be taken to address corrosion caused by the salt in such embodiments.

The flow charts described herein illustrate various exemplary functions and operations that may occur within various environments. Accordingly, these flow charts are not exhaustive and that various steps may be excluded to clarify the aspect being described. For example, it is understood that some actions, such as network authentication processes, notifications, and handshakes, may have been performed prior to the first step of a flow chart. Such actions may depend on the particular type and configuration of communications engaged in by the system(s) used. Furthermore, other communication actions may occur between illustrated steps or simultaneously with illustrated steps.

Figure 82:
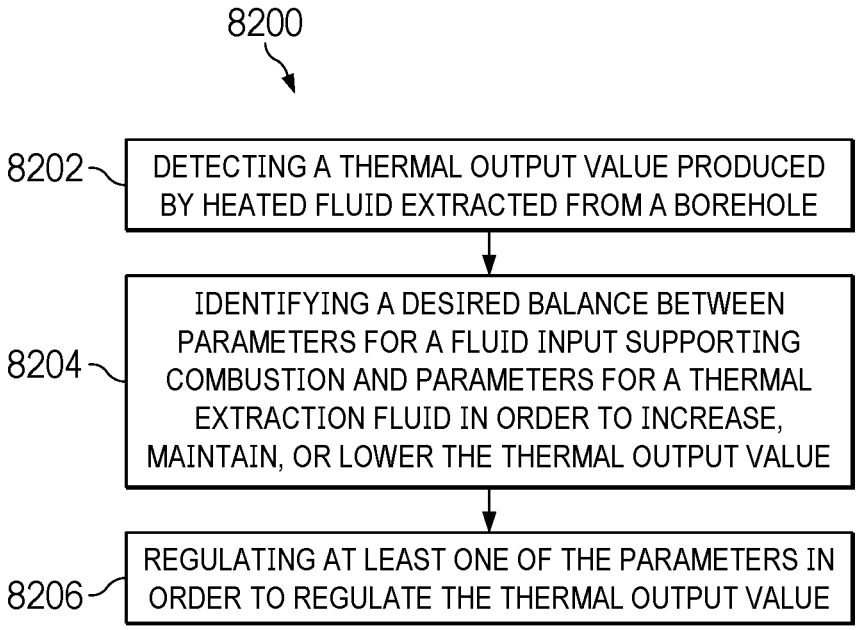
FIGS. 82-89 are flow charts illustrating embodiments of various processes that may be executed by the active geothermal system of FIGS. 1, 2, 80, and 81.

Referring to FIG. 82, one embodiment of a method 8200 is illustrated that may be executed by the active geothermal system 102 of FIG. 1 to regulate combustion within a borehole, such as combustion of one or more of the branches in FIGS. 60B-60D. For example, the method 8200 may be executed pursuant to the control flow 8000 of FIG. 80. Generally, the method 8200 may be used to balance the flow rate and mixtures of one or more fluids (e.g., oxygen, air, and/or other fluids and fluid mixes) that support the combustion process, the downhole pressure(s), the downhole humidity and/or other fluid presence measurements, and/or the flow rates and mixtures of one or more fluids (liquid or gas) being used to capture and transport the heat to the surface for conversion to energy, storage, or direct use.

In step 8202, a thermal output value (e.g., an indicator 8010 of FIG. 80) is detected for heated fluid that is being extracted from the borehole. For example, this may be fluid sent into the borehole via fluid conduit 606 (FIG. 6) and retrieved via fluid conduit 608. The thermal value may be used to determine the amount of heat energy contained in the fluid and is a factor in determining whether the combustion zone or zones are producing enough heat. In wells that use the active geothermal system 102 for EOR, the thermal value may be used to determine whether the subsurface temperatures are within a desired range for maximizing EOR. The thermal value may be used in conjunction with other EOR parameters, such as a production value that represents production resulting from the EOR activity. Accordingly, the thermal energy output may be taken into account for a number of different purposes when monitoring the performance of a combustion area in a single branch or across multiple branches or wells.

In step 8204, a desired balance for increasing, maintaining, or decreasing the thermal output value may be determined between a flow rate and/or mixture of fluid being pumped into the well to maintain combustion and/or regulate thermal output, and a flow rate of a fluid being used to extract the thermal energy. It is noted that if the only purpose of the combustion is EOR, the flow rate of an extraction fluid may not be a factor. The relationship enables the active geothermal system 102 to regulate the thermal energy output by modifying the rate of combustion and/or by modifying the parameters of the extraction fluid(s).

Modifying the rate of combustion may be done by modifying the parameters 8006 of the combustion supporting fluid, such as increasing or decreasing the flow rate and/or altering the fluid mixture (e.g., to provide less or more oxygen to the combustion zone). This enables the active geothermal system 102 to increase or lower the level of heat, although this process may depend on factors such as the density of combustible material within the formation, how effectively oxygen/air can be injected into the formation, and similar factors. In some embodiments, the pumps may be cycled off, put on standby, or reduced to minimal activity in order to provide soak time prior to ignition in order to allow the oxygen or oxygen mixture to soak into the formation before being ignited. As described with respect to FIGS. 11A and 11B, this may involve balancing opposing fluid flows within a closed loop system.

Modifying the parameters 8004 of the extraction fluid may be done by increasing or decreasing the flow rate, and/or using a different fluid or fluid mixture. Increasing the flow rate may provide less time for the fluid to be heated, thereby lowering the thermal output value. Decreasing the flow rate may provide more time for the fluid to be heated, thereby raising the thermal output value. Different fluids or fluid mixtures may affect the capacity of the fluid to hold and efficiently transfer heat. In some embodiments, the pumps may be cycled off, put on standby, or reduced to minimal activity in order to provide soak time where the fluid is not moving or moving very slowly. As described with respect to FIGS. 11A and 11B, this may involve balancing opposing fluid flows within a closed loop system.

In step 8206, the thermal output value may be regulated by modifying one or more of the fluid flow rate/mixture used to maintain combustion and the parameter(s) of the extraction fluid. It is understood that the method 8200 may be executed repeatedly in order to maintain a desired thermal output value. For example, as fuel is depleted near the pipe, additional oxygen may be required, or additional pressure may be needed to inject oxygen further into the formation. Accordingly, maintaining a desired thermal output value may involve repeated adjustments over time to account for changes in the combustion zone(s).

In embodiments where the energy conversion occurs downhole, an electrical output value may be used rather than a thermal output value. This enables the combustion process to be controlled for a desired electrical output.

Figure 83:
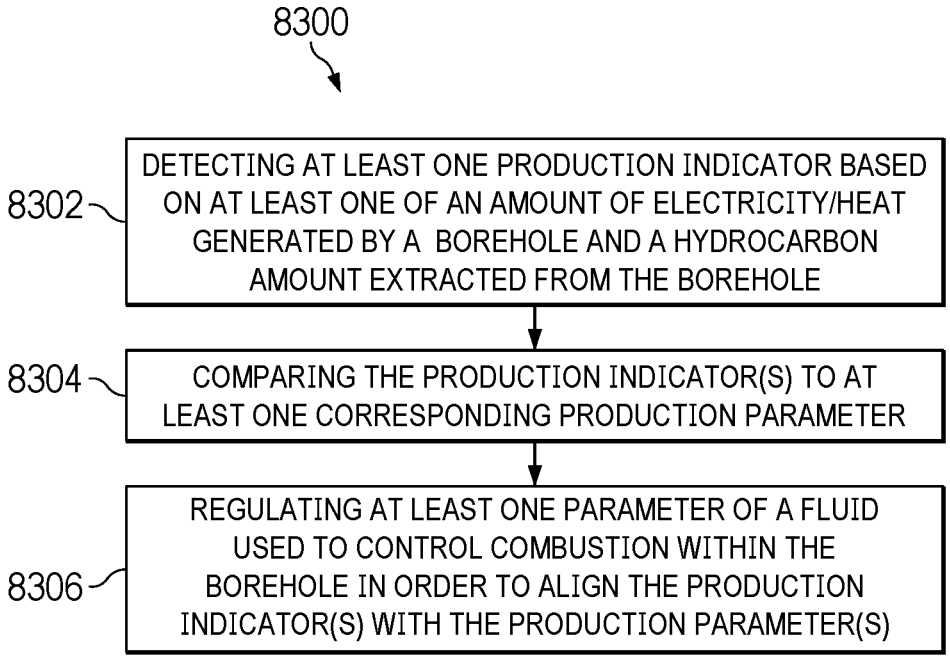

Referring to FIG. 83, one embodiment of a method 8300 is illustrated that may be executed by the active geothermal system 102 of FIG. 1 to regulate combustion within a borehole, such as combustion of one or more of the branches in FIGS. 60B-60D. For example, the method may be executed pursuant to the control flow 8000 of FIG. 80. Generally, the method 8300 may be used to balance the flow rate of a fluid (e.g., oxygen, air, and/or other fluids and fluid mixes) that support the combustion process in order to regulate the production of electricity, heat, and/or hydrocarbons.

In step 8302, at least one production indicator (e.g., an indicator 8010 of FIG. 80) may be detected from the borehole. For example, this may be fluid sent into the borehole via fluid conduit 606 (FIG. 6) and retrieved via fluid conduit 608. The production indicator may be used to determine the amount of electricity/heat and/or hydrocarbon volume being produced by the well.

In step 8304, the production indicator may be compared to one or more corresponding production parameters (e.g., the production parameter values 8016 and 8018 of FIG. 80). The comparison may be used to determine how to optimize production and/or to regulate the combustion to align the production indicator(s) with the production parameter(s). Accordingly, in step 8306, at least one parameter of the combustion supporting fluid may be regulated in order to modify the combustion process to align the production indicator(s) with the production parameter(s).

Figure 84:
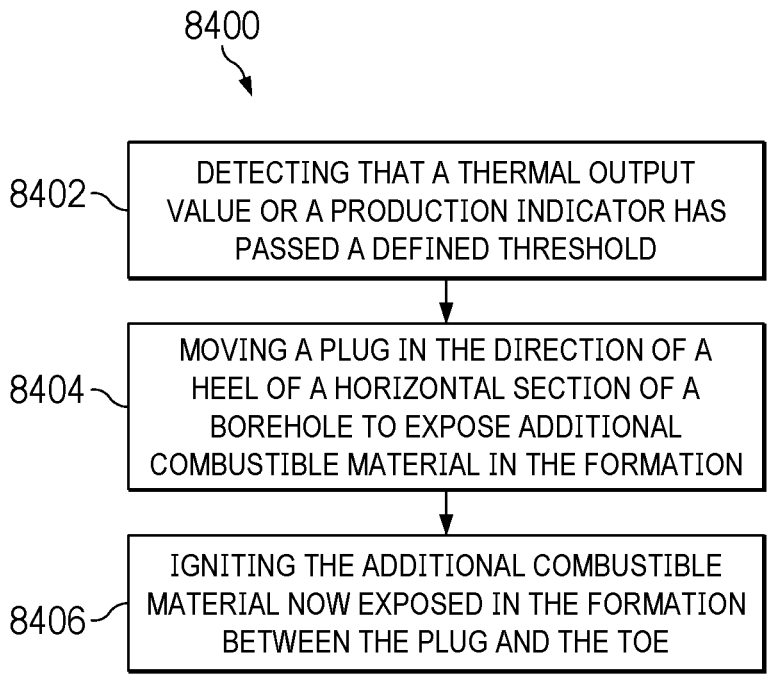

Referring to FIG. 84, one embodiment of a method 8400 is illustrated that may be executed by the active geothermal system 102 of FIG. 1 to regulate combustion within a borehole, such as combustion of one or more of the branches in FIGS. 60B-60D. For example, the method may be executed pursuant to the control flow 8000 of FIG. 80.

In step 8402, the method 8400 may detect that a thermal output value or a production indicator has passed (e.g., exceeded or dropped below) a defined threshold. For example, electrical, heat, or hydrocarbon production may have dropped below a desired amount. In step 8404, a plug may be moved within the borehole to expose additional combustible material as described previously. In step 8406, the additional combustible material may be ignited. This process may continue, with the plug being sequentially moved uphole relative to its previous location and the newly exposed combustible material being ignited.

Figure 85:
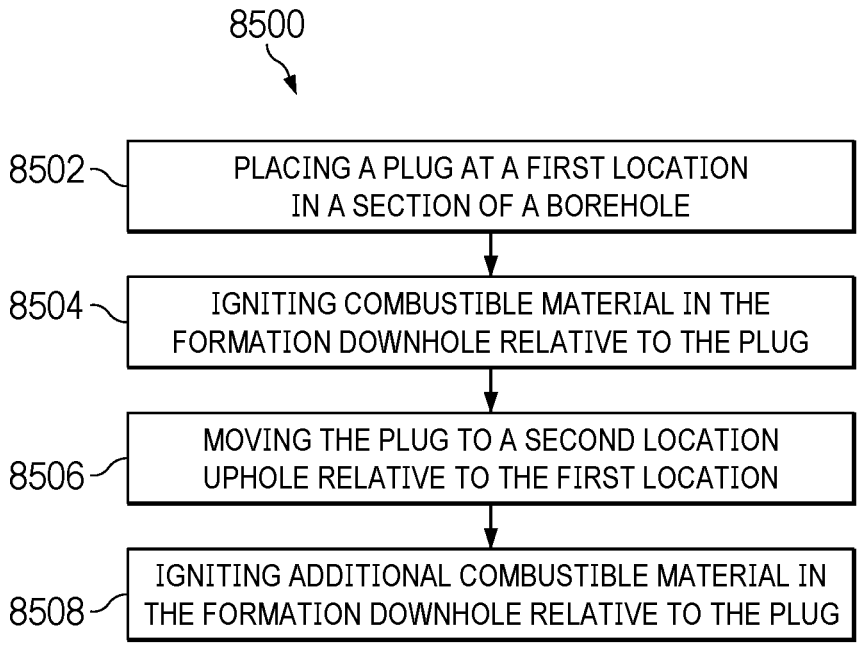

Referring to FIG. 85, one embodiment of a method 8500 is illustrated that may be executed by the active geothermal system 102 of FIG. 1 to control plug movement and the ignition of portions of the fuel-bearing formation. In step 8502, a plug is placed at a first location in a section of a borehole. In step 8504, the combustible material in the formation downhole relative to the plug is ignited. In step 8506, which may occur at some later time, the plug is moved to a second location uphole relative to the first location. In step 8508, additional combustible material in the formation downhole relative to the plug is ignited. This process may continue, with the plug being sequentially moved uphole relative to its previous location and the newly exposed combustible material being ignited.

Figure 86:
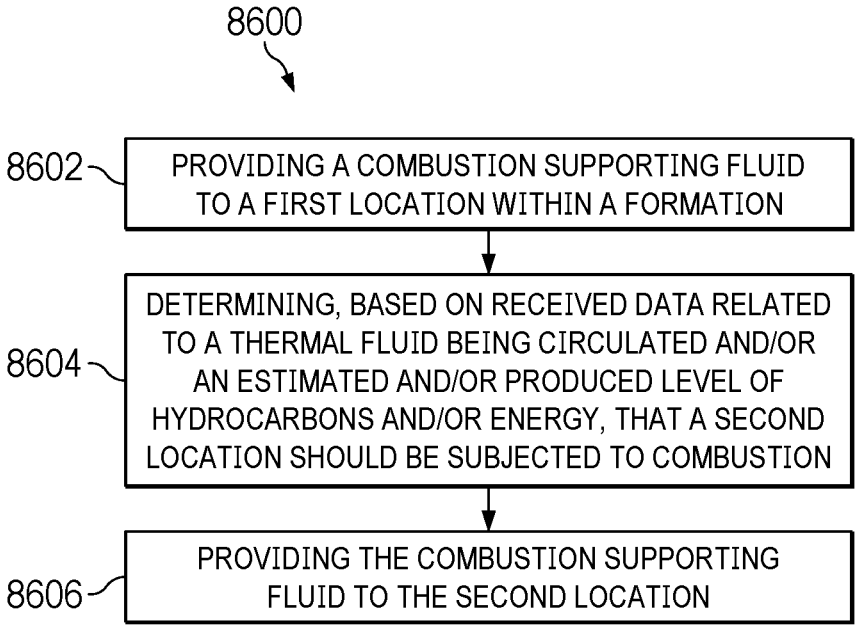

Referring to FIG. 86, one embodiment of a method 8600 is illustrated that may be executed by the active geothermal system 102 of FIG. 1 to regulate combustion within the fuel-bearing formation. In step 8602, a combustion supporting fluid is provided to a first location within the formation. In step 8604, a determination is made, based on received data related to a thermal fluid being circulated and/or an estimated and/or produced level of hydrocarbons and/or energy, that a second location should be subjected to combustion. In step 8606, the combustion supporting fluid is provided to the second location.

Figure 87:
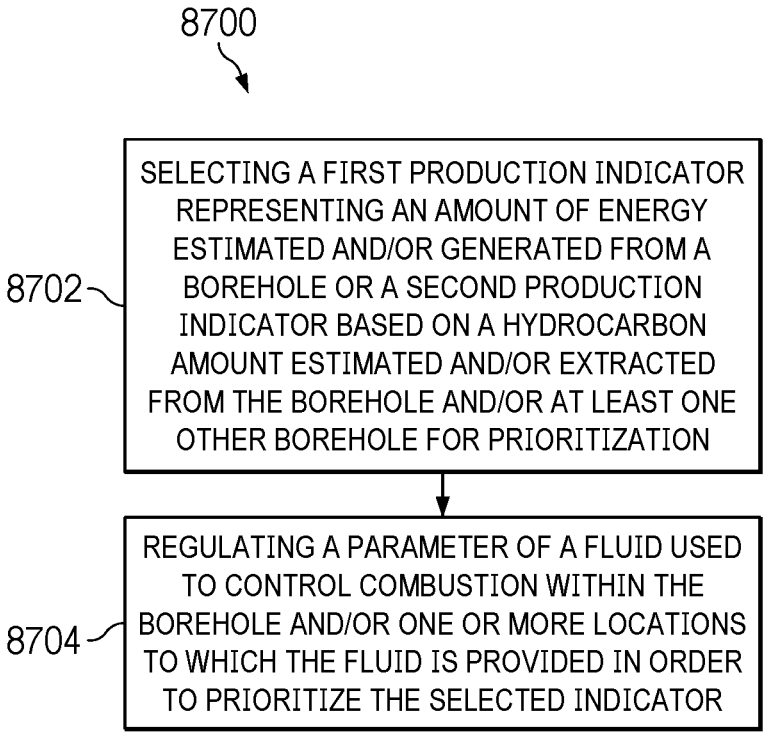

Referring to FIG. 87, one embodiment of a method 8700 is illustrated that may be executed by the active geothermal system 102 of FIG. 1 to prioritize either energy or hydrocarbon extraction. In step 8702, a first production indicator that represents an amount of energy estimated and/or generated from a borehole or a second production indicator based on a hydrocarbon amount estimated and/or extracted from the borehole and/or at least one other borehole is selected for prioritization. In step 8704, a parameter of a fluid used to control combustion within the borehole and/or one or more locations to which the fluid is provided is regulated in order to prioritize the selected indicator.

Figure 88:
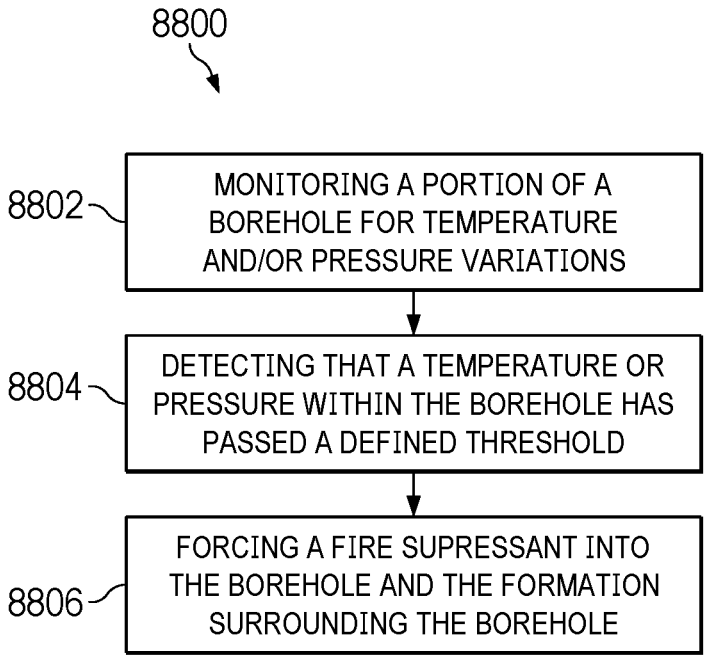

Referring to FIG. 88, one embodiment of a method 8800 is illustrated that may be executed by the active geothermal system 102 of FIG. 1 for safety. In step 8802, a portion of a borehole may be monitored for variations, such as temperature and/or pressure variations. Monitoring may be accomplished using surface and/or downhole sensors and other equipment. In step 8804, the monitoring detects that a temperature or pressure of the borehole has passed a defined threshold. In step 8806, a fire suppressant into the combustion zone surrounding the borehole in order to reduce the temperature and/or pressure.

Figure 89:
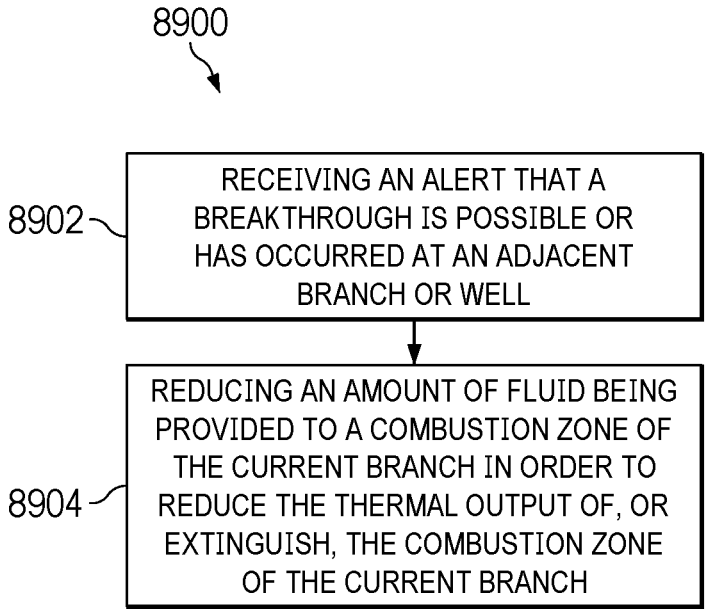

Referring to FIG. 89, one embodiment of a method 8900 is illustrated that may be executed by the active geothermal system 102 of FIG. 1 for safety. In step 8902, an alert may be received that a breakthrough is possible or has occurred at an adjacent branch or well. In step 8904, an amount of fluid being provided to a combustion zone of the current branch is reduced in order to reduce the thermal output of, or extinguish, the combustion zone of the current branch.

Figure 90:
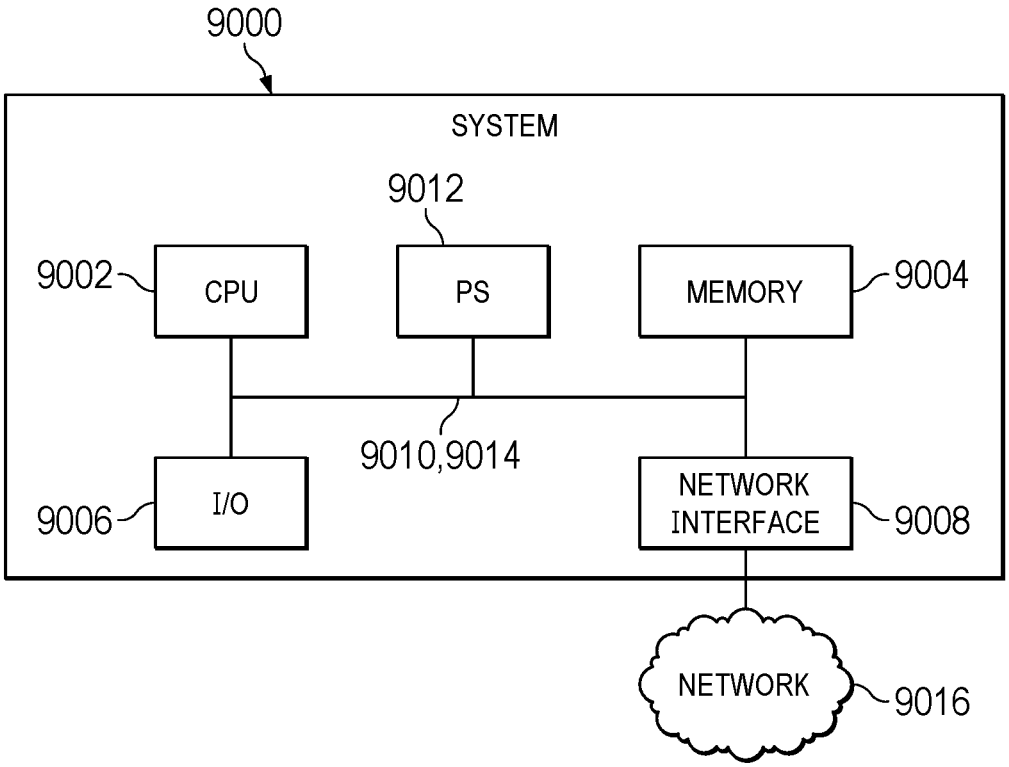
FIG. 90 is a simplified diagram of one embodiment of a computer system that may be used in embodiments of the present disclosure.

Referring to FIG. 90, one embodiment of a computer system 9000 is illustrated. The computer system 9000 is one possible example of a system component or computing device that may be used as part of the active geothermal system 102 of FIGS. 1 and 2. The computer system 9000 may include a controller (e.g., a central processing unit ("CPU")) 9002, a memory unit 9004, an input/output ("I/O") device 9006, and a network interface 9008. The components 9002, 9004, 9006, and 9008 are interconnected by a transport system (e.g., a bus) 9010. A power supply (PS) 9012 may provide power to components of the computer system 9000, such as the CPU 9002 and memory unit 9004. It is understood that the computer system 9000 may be differently configured and that each of the listed components may actually represent several different components. For example, the CPU 9002 may actually represent a multiprocessor or a distributed processing system; the memory unit 9004 may include different levels of cache memory, main memory, hard disks, and remote storage locations; the I/O device 9006 may include monitors, keyboards, and the like; and the network interface 9008 may include one or more network cards providing one or more wired and/or wireless connections to a network 9016. Therefore, a wide range of flexibility is anticipated in the configuration of the computer system 9000.

The computer system 9000 may use any operating system (or multiple operating systems), including various versions of operating systems provided by Microsoft (such as WINDOWS), Apple (such as Mac OS X), UNIX, and LINUX, and may include operating systems specifically developed for handheld devices, personal computers, and servers depending on the use of the computer system 9000. The operating system, as well as other instructions (e.g., for the processes and message sequences described herein), may be stored in the memory unit 9004 and executed by the processor 9002. For example, if the computer system 9000 is the control system 218, the memory unit 9004 may include instructions for performing some or all of the methods described in the present disclosure.

The network 8816 may be a single network or may represent multiple networks, including networks of different types. For example, components within the active geothermal system 102 may be coupled to a network that includes a cellular link coupled to a data packet network, or data packet link such as a wide local area network (WLAN) coupled to a data packet network. Accordingly, many different network types and configurations may be used to establish communications between components within the active geothermal system 102 and with other device and systems.

Exemplary network, system, and connection types include the internet, WiMax, local area networks (LANs) (e.g., IEEE 802.11a and 802.11g wi-fi networks), digital audio broadcasting systems (e.g., HD Radio, T-DMB and ISDB-TSB), terrestrial digital television systems (e.g., DVB-T, DVB-H, T-DMB and ISDB-T), WiMax wireless metropolitan area networks (MANs) (e.g., IEEE 802.16 networks), Mobile Broadband Wireless Access (MBWA) networks (e.g., IEEE 802.20 networks), Ultra Mobile Broadband (UMB) systems, Flash-OFDM cellular systems, and Ultra wideband (UWB) systems. Furthermore, the present disclosure may be used with communications systems such as Global System for Mobile communications (GSM) and/or code division multiple access (CDMA) communications systems. Connections to such networks may be wireless or may use a conduit (e.g., digital subscriber conduits (DSL), cable conduits, and fiber optic conduits).

Communication may be accomplished using predefined and publicly available (i.e., non-proprietary) communication standards or protocols (e.g., those defined by the Internet Engineering Task Force (IETF) or the International Telecommunications Union-Telecommunications Standard Sector (ITU-T)), and/or proprietary protocols. For example, signaling communications (e.g., session setup, management, and teardown) may use a protocol such as the Session Initiation Protocol (SIP), while data traffic may be communicated using a protocol such as the Real-time Transport Protocol (RTP), File Transfer Protocol (FTP), and/or HyperText Transfer Protocol (HTTP). Communications may be connection-based (e.g., using a protocol such as the transmission control protocol/internet protocol (TCP/IP)) or connection-less (e.g., using a protocol such as the user datagram protocol (UDP)). It is understood that various types of communications may occur simultaneously, including, but not limited to, voice calls, instant messages, audio and video, emails, document sharing, and any other type of resource transfer, where a resource represents any digital data.

While the preceding description shows and describes one or more embodiments, it will be understood by those skilled in the art that various changes in form and detail may be made therein without departing from the spirit and scope of the present disclosure. For example, various steps illustrated within a particular sequence diagram or flow chart may be combined or further divided. In addition, steps described in one diagram or flow chart may be incorporated into another diagram or flow chart. Furthermore, the described functionality may be provided by hardware and/or software, and may be distributed or combined into a single platform. Additionally, functionality described in a particular example may be achieved in a manner different than that illustrated, but is still encompassed within the present disclosure. Therefore, the claims should be interpreted in a broad manner, consistent with the present disclosure.

What is claimed is:

1. A method for managing a production of thermal energy underground, the method comprising:

providing a circulation fluid within a circulation conduit positioned within a borehole in a formation to expose the circulation fluid to heat from a thermal zone in the formation;

providing a combustion fluid into the formation at a first location of a plurality of locations via a delivery conduit positioned within the borehole, wherein the formation contains a combustible material that, when combusted by the combustion fluid, provides heat to the thermal zone;

providing the combustion fluid into the formation at a second location of the plurality of locations only after a defined event occurs; and monitoring a temperature of the circulation fluid after the circulation fluid is retrieved from the thermal zone via the circulation conduit, wherein the defined event occurs when the temperature passes a threshold.

2. The method of claim 1 further comprising regulating a flow rate of the circulation fluid within the circulation conduit to control an amount of time during which the circulation fluid is heated by the thermal zone.

3. The method of claim 2 further comprising altering the flow rate of the circulation fluid to align a temperature of the circulation fluid after the circulation fluid is retrieved from the thermal zone with a desired temperature value.

4. The method of claim 1 further comprising directing a suppression fluid into the formation at one or more of the plurality of locations to inhibit combustion of the combustible material at the one or more locations.

5. The method of claim 1 further comprising:

receiving monitoring data indicating that at least one of a temperature of the combustible material and a pressure within the borehole has exceeded a safety threshold; and providing a suppression fluid into the borehole simultaneously with the combustion fluid in response to receiving the monitoring data, wherein the suppression fluid inhibits combustion of the combustible material.

6. The method of claim 5 wherein the suppression fluid replaces the combustion fluid within the delivery conduit.

7. The method of claim 1 further comprising:

monitoring an energy output level resulting from a temperature of the circulation fluid;

estimating a level of enhanced oil recovery (EOR) of a hydrocarbon extraction process resulting from the burning of the combustible material; and adjusting the combustion rate of the combustible material to maintain a desired balance between the energy output level and the EOR level.

8. A system for obtaining thermal energy from a borehole, the system comprising:

a delivery conduit positioned within a borehole in a formation for carrying a combustion fluid into the borehole, wherein the formation contains a combustible material that, when combusted by the combustion fluid, provides heat to a thermal zone within the formation;

a circulation conduit positioned within the borehole for carrying a circulation fluid into the borehole to be heated by the thermal zone, wherein the circulation conduit includes a flow crossover that includes:

a first crossover channel configured to redirect the circulation fluid from a first channel of the circulation conduit to a second channel of the circulation conduit, wherein the first channel of the circulation conduit is more thermally isolated from the formation than the second channel of the circulation conduit; and a second crossover channel configured to redirect the circulation fluid from the second channel of the circulation conduit to the first channel of the circulation conduit.

9. The system of claim 8 further comprising a control system having a processor coupled to a memory, wherein the memory contains a plurality of computer executable instructions, including instructions for pumping the circulation fluid through the circulation conduit.

10. The system of claim 9 further including instructions for regulating a flow rate of the circulation fluid to control a thermal window during which the circulation fluid is exposed to heat in the thermal zone.

11. The system of claim 9 further comprising:

one or more sensors configured to detect at least one of a temperature of the combustible material and a pressure within the borehole;

instructions for identifying data from the sensors indicating that at least one of the combustible material's temperature and the pressure within the borehole has exceeded a safety threshold; and instructions for reducing the combustion fluid flow rate in response to the identified data.

12. The system of claim 9 further comprising:

one or more sensors configured to detect at least one of a temperature of the combustible material and a pressure within the borehole;

instructions for identifying data from the sensors indicating that at least one of the combustible material's temperature and the pressure within the borehole has exceeded a safety threshold; and instructions for pumping a suppression fluid into the borehole in response to identifying the data, wherein the suppression fluid inhibits combustion of the combustible material.

13. The system of claim 9 further comprising instructions for:

pumping the combustion fluid into the borehole at a first location of a plurality of locations via the delivery conduit positioned within the borehole;

monitoring a temperature of the circulation fluid after the circulation fluid is retrieved from the thermal zone via the circulation conduit; and pumping the combustion fluid into the formation at a second location of the plurality of locations when the temperature passes a threshold.

14. The system of claim 9 further comprising instructions for:

pumping the combustion fluid into the borehole at a first location of a plurality of locations via the delivery conduit positioned within the borehole; and pumping the combustion fluid into the formation at a second location of the plurality of locations when a period of time expires.

15. A method for managing a production of thermal energy underground, the method comprising:

directing a combustion fluid into a delivery conduit positioned within a borehole in a formation, wherein the formation contains a combustible material that, when combusted by the combustion fluid, provides heat to a thermal zone within the formation, and wherein the delivery conduit is adapted to direct the combustion fluid into the formation at a plurality of locations;

directing a circulation fluid into a circulation conduit positioned within the borehole to expose the circulation fluid to heat from the thermal zone; and directing a suppression fluid into the formation at one or more of the plurality of locations to inhibit combustion of the combustible material at the one or more locations.

16. The method of claim 15 further comprising receiving monitoring data indicating that a safety threshold has been reached, wherein the suppression fluid is pumped into the formation in response to the monitoring data.

17. The method of claim 15 wherein the suppression fluid is directed into the formation at the one or more of the plurality of locations in order to control a location of the thermal zone along the borehole, while the combustion fluid is simultaneously directed into the formation in at least one other location of the plurality of locations.

18. The method of claim 15 further comprising instructions for:

pumping the combustion fluid into the borehole at a first location of the plurality of locations via the delivery conduit;

monitoring a temperature of the circulation fluid after the circulation fluid is retrieved from the thermal zone via the circulation conduit; and pumping the combustion fluid into the formation at a second location of the plurality of locations when the temperature passes a threshold.

19. The method of claim 15 further comprising instructions for:

pumping the combustion fluid into the borehole at a first location of the plurality of locations; and pumping the combustion fluid into the formation at a second location of the plurality of locations when a period of time expires.

20. The method of claim 15 further comprising regulating an amount of time during which the circulation fluid is exposed to heat in the thermal zone by controlling a flow rate of the circulation fluid.

21. The method of claim 15 further comprising:

monitoring an energy output level resulting from a temperature of the circulation fluid;

estimating a level of enhanced oil recovery (EOR) of a hydrocarbon extraction process resulting from the burning of the combustible material; and adjusting the combustion rate of the combustible material to maintain a desired balance between the energy output level and the EOR level.

22. A method for managing a production of thermal energy underground, the method comprising:

providing a circulation fluid within a circulation conduit positioned within a borehole in a formation to expose the circulation fluid to heat from a thermal zone in the formation;

providing a combustion fluid into the formation at a first location of a plurality of locations via a delivery conduit positioned within the borehole, wherein the formation contains a combustible material that, when combusted by the combustion fluid, provides heat to the thermal zone; and providing the combustion fluid into the formation at a second location of the plurality of locations only after a defined event occurs, wherein the defined event occurs when a period of time expires.

23. The method of claim 22 further comprising regulating a flow rate of the circulation fluid within the circulation conduit to control an amount of time during which the circulation fluid is heated by the thermal zone.

24. The method of claim 23 further comprising altering the flow rate of the circulation fluid to align a temperature of the circulation fluid after the circulation fluid is retrieved from the thermal zone with a desired temperature value.

25. The method of claim 22 further comprising directing a suppression fluid into the formation at one or more of the plurality of locations to inhibit combustion of the combustible material at the one or more locations.

26. The method of claim 22 further comprising:

receiving monitoring data indicating that at least one of a temperature of the combustible material and a pressure within the borehole has exceeded a safety threshold; and providing a suppression fluid into the borehole simultaneously with the combustion fluid in response to receiving the monitoring data, wherein the suppression fluid inhibits combustion of the combustible material.

27. The method of claim 26 wherein the suppression fluid replaces the combustion fluid within the delivery conduit.

28. The method of claim 22 further comprising:

monitoring an energy output level resulting from a temperature of the circulation fluid;

estimating a level of enhanced oil recovery (EOR) of a hydrocarbon extraction process resulting from the burning of the combustible material; and adjusting the combustion rate of the combustible material to maintain a desired balance between the energy output level and the EOR level.

* * * * *